US011597560B2

(12) United States Patent
Apps et al.

(10) Patent No.: US 11,597,560 B2
(45) Date of Patent: Mar. 7, 2023

(54) CRATE WITH RETRACTABLE WALL

(71) Applicant: Rehrig Pacific Company, Los Angeles, CA (US)

(72) Inventors: William P. Apps, Alpharetta, GA (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 17/474,728

(22) Filed: Sep. 14, 2021

(65) Prior Publication Data

US 2022/0097905 A1 Mar. 31, 2022

Related U.S. Application Data

(60) Provisional application No. 63/165,908, filed on Mar. 25, 2021, provisional application No. 63/091,275, filed on Oct. 13, 2020, provisional application No. 63/077,929, filed on Sep. 14, 2020.

(51) Int. Cl.

| | |
|---|---|
| ***B65D 6/18*** | (2006.01) |
| ***B65D 25/00*** | (2006.01) |
| ***B65D 25/30*** | (2006.01) |

(52) U.S. Cl.

CPC ..... *B65D 11/184* (2013.01); *B65D 25/005* (2013.01); *B65D 25/30* (2013.01)

(58) Field of Classification Search

CPC .... B65D 11/184; B65D 25/005; B65D 25/30; B65D 11/18; B65D 11/1806; B65D 11/1813; B65D 11/182; B65D 11/1826; B65D 11/1833; B65D 5/36; B65D 5/3678; B65D 7/24; B65D 9/12; B65D 9/14; B65D 9/22; B65D 19/12; B65D 61/00; B65D 88/52

See application file for complete search history.

(56) References Cited

U.S. PATENT DOCUMENTS

| | | | | |
|---|---|---|---|---|
| 2,780,381 A | | 2/1957 | Coit, Jr. | |
| 3,360,180 A | | 12/1967 | Venturi | |
| 3,372,829 A | | 3/1968 | Averill | |
| 3,812,999 A | * | 5/1974 | Joseph | B65D 19/10 312/297 |
| 3,835,792 A | | 9/1974 | Wharton | |
| 3,981,410 A | | 9/1976 | Schurch | |

(Continued)

FOREIGN PATENT DOCUMENTS

| | | |
|---|---|---|
| DE | 4319099 A1 | 12/1994 |
| EP | 1225131 A1 | 7/2002 |

(Continued)

OTHER PUBLICATIONS

International Search Report for International Application No. PCT/US21/50264 dated Mar. 23, 2022.

*Primary Examiner* — Kareen K Thomas

(74) *Attorney, Agent, or Firm* — Carlson, Gaskey & Olds, P.C.

(57) ABSTRACT

A container includes a wall extending upward from a base. The wall includes a frame and a first wall portion pivotably connected to the frame. The wall further includes a latch selectively connecting the first wall portion to the frame. The latch is movable vertically relative to the frame to selectively release the first wall portion from the frame.

42 Claims, 81 Drawing Sheets

(56) References Cited

U.S. PATENT DOCUMENTS

| | | | | |
|---|---|---|---|---|
| 4,023,698 | A * | 5/1977 | Joseph | B65D 19/12 217/15 |
| 4,043,476 | A | 8/1977 | Joseph | |
| 4,406,380 | A | 9/1983 | Paige | |
| 4,662,532 | A | 5/1987 | Anderson et al. | |
| 4,674,647 | A | 6/1987 | Gyenge et al. | |
| 4,765,480 | A | 8/1988 | Malmanger | |
| 5,016,772 | A | 5/1991 | Wilk | |
| 5,161,709 | A | 11/1992 | Oestreich, Jr. | |
| 5,562,224 | A | 10/1996 | Pascal et al. | |
| 5,660,291 | A | 8/1997 | Dash | |
| 6,015,056 | A | 1/2000 | Overholt et al. | |
| 6,044,998 | A * | 4/2000 | Schearer | B65D 19/18 206/600 |
| 6,056,177 | A | 5/2000 | Schneider | |
| 6,098,827 | A | 8/2000 | Overholt et al. | |
| 6,209,742 | B1 | 4/2001 | Overholt et al. | |
| 6,290,081 | B1 | 9/2001 | Merey | |
| 6,305,566 | B1 | 10/2001 | Pigott et al. | |
| 6,601,724 | B1 * | 8/2003 | Koefelda | B65D 11/1833 220/4.28 |
| 6,691,885 | B2 | 2/2004 | Brown | |
| 6,918,502 | B1 | 7/2005 | Overholt et al. | |
| 7,011,225 | B2 | 3/2006 | Oster et al. | |
| 7,264,122 | B2 | 9/2007 | Koefelda et al. | |
| 8,863,971 | B2 * | 10/2014 | Cavalcante | B65D 85/32 220/601 |
| 9,422,082 | B2 * | 8/2016 | Nolan | E05C 1/10 |
| 10,065,763 | B2 * | 9/2018 | Wilcox | B65D 11/1833 |
| 11,352,168 | B2 * | 6/2022 | Green | B65D 11/1826 |
| 2002/0070215 | A1 | 6/2002 | Walsh et al. | |
| 2003/0000950 | A1 | 1/2003 | Murakami et al. | |
| 2004/0020821 | A1 | 2/2004 | Koefelda et al. | |
| 2004/0200833 | A1 | 10/2004 | Dubois et al. | |
| 2006/0231555 | A1 | 10/2006 | Smyers et al. | |
| 2006/0260976 | A1 | 11/2006 | Apps | |
| 2007/0158345 | A1 | 7/2007 | Booth et al. | |
| 2009/0101640 | A1 | 4/2009 | Hadar | |
| 2009/0134157 | A1 * | 5/2009 | Meers | B65D 25/005 220/6 |
| 2011/0049145 | A1 | 3/2011 | Yamauchi | |
| 2014/0251992 | A1 | 9/2014 | Cavalcante | |
| 2016/0272364 | A1 * | 9/2016 | Jian | B65D 19/18 |
| 2020/0247583 | A1 | 8/2020 | Sekowski et al. | |

FOREIGN PATENT DOCUMENTS

| | | | |
|---|---|---|---|
| EP | 1524170 | A2 | 4/2005 |
| EP | 1935792 | A1 | 6/2008 |
| EP | 2062827 | A1 | 5/2009 |
| FR | 1227059 | A | 8/1960 |
| FR | 2810020 | A1 | 12/2001 |
| GB | 2357078 | A | 6/2001 |
| GB | 2360762 | A | 10/2001 |
| GB | 2431922 | A | 5/2007 |
| GB | 2449502 | A | 11/2008 |
| NL | 2007184 | C2 | 1/2013 |
| WO | 9521773 | A1 | 8/1995 |
| WO | 9840199 | A1 | 9/1998 |
| WO | 03008275 | A2 | 1/2003 |
| WO | 2006010311 | A1 | 2/2006 |
| WO | 2008145977 | A1 | 12/2008 |

* cited by examiner

CRATE WITH RETRACTABLE WALL

BACKGROUND

Currently, some grocery items may be shipped to stores in metal crates or cardboard boxes. The grocery items must be unloaded and placed onto shelves for the customers to select and purchase. This requires labor for handling the grocery items in the store.

The assignee of the present application has developed several collapsible containers with retractable front walls. The front wall of the container can be reconfigured to a retracted position while another identical container is stacked on it. Retracting the front wall provides access to the grocery items within the container without the need to unload the grocery items onto a shelf. A stack of such containers can be placed on a floor or in a refrigerated area, the front walls can be retracted, and the consumers can retrieve grocery items directly from the containers.

SUMMARY

An example container includes a wall extending upward from a base. The wall includes a frame and a first wall portion pivotably connected to the frame. The wall further includes a latch selectively connecting the first wall portion to the frame. The latch is movable vertically relative to the frame to selectively release the first wall portion from the frame.

The latch may be slidably captured in the frame. A spring may bias the latch toward a latched position in which the latch connects the first wall portion to the frame. The spring may be formed integrally with the latch.

The container may also include a secondary latch and a cam. The secondary latch may be movable between a latched position preventing movement of the first wall portion relative to the frame and an unlatched position permitting movement of the first wall portion relative to the frame. Movement of the latch vertically causes the secondary latch to move from the latched position to the unlatched position via the cam.

The first wall portion may include a first horizontal wall portion and arms extending downward from the first horizontal wall portion when the first wall portion is in a deployed, closed position, the arms pivotably connected to the frame such that the first wall portion is pivotable between the deployed, closed position and a retracted, open position.

The container may further include a second wall portion pivotably connected to the frame and movable between a deployed, closed position and a retracted, open position.

The second wall portion may be connected to the first wall portion by links pivotably connected to the first wall portion and pivotably connected to the second wall portion.

The second wall portion may be nested within the first wall portion when the first wall portion and the second wall portion are moved to the retracted, open position.

The first wall portion and the second wall portion may lie flat against an upstanding flange of the base in the retracted, open position.

The second wall portion may include a second horizontal portion and arms extending downward from the second horizontal portion when the second wall portion is in the deployed, closed position, and such that the arms of the second wall portion are received between the arms of the first wall portion when the first wall portion and the second wall portion are in the retracted, open position.

The base may include an upstanding flange to which the wall is pivotably connected. The wall may be movable between an upright, use position and a collapsed position generally parallel to the base.

The container may further include a second wall perpendicular to the first wall. A wall latch may selectively connect the first wall to the second wall. The second wall may include a side flange extending parallel to the first wall. The wall latch may be disposed in the side flange. The wall latch may selectively secure the side flange to the frame.

The first wall may be pivotably connected to the base about a first axis, wherein the second wall may be pivotably connected to the base about a second axis. The first axis may be further from the base than may be the second axis.

The first wall may be pivotably connected to the base about a first axis and the second wall may be pivotably connected to the base about a second axis. The first axis may be closer to the base than may be the second axis.

A secondary latch may be movable between a latched position preventing movement of the second wall portion relative to the frame and an unlatched position permitting movement of the second wall portion relative to the frame. Movement of the latch vertically causes the secondary latch to move from the latched position to the unlatched position via the cam.

A container according to another example includes a wall extending upward from a base. The wall may include a frame and a first wall portion pivotably connected to the frame. The wall further may include a second wall portion pivotably connected to the frame. The first wall portion and the second wall portion may be movable between a deployed, closed position and a retracted, open position. The wall further may include a latch movable vertically relative to the frame and a secondary latch and a cam. The secondary latch may be movable between a latched position preventing movement of the second wall portion relative to the frame and an unlatched position permitting movement of the second wall portion relative to the frame. Movement of the latch vertically may cause the secondary latch to move from the latched position to the unlatched position via the cam.

The latch may be movable vertically between a latched position in which the latch secures the first wall portion to the frame and an unlatched position in which the first wall portion can pivot relative to the frame.

A container according to another example includes a wall extending upward from a base. The wall may include a frame and a first wall portion pivotably connected to the frame. The wall further may include a second wall portion pivotably connected to the frame. The first wall portion and the second wall portion may each be pivotable between a deployed, closed position and a retracted, open position. The second wall portion may be nestably received within the first wall portion when the first wall portion and the second wall portion are in the retracted, open position.

The first wall portion and the second wall portion may lie flat against a lower horizontal portion of the frame when the first wall portion and the second wall portion are in the retracted, open position.

The first wall portion and the second wall portion may each include a horizontal portion and a pair of arms extending from the horizontal portion. The pair of arms of the second wall portion may be received between the pair of arms of the first wall portion when the first wall portion and the second wall portion are in the retracted, open position.

The frame may include a lower horizontal portion and vertical portions extending upward from opposite ends of the lower horizontal portion. The pair of arms of the first wall portion may be pivotably connected to the vertical portions of the frame.

The pair of arms of the second wall portion may be pivotably connected to the vertical portions of the frame.

The container may further include a third wall portion having a horizontal portion and a pair of arms pivotably connected to the frame. The third wall portion may be nestably received within the second wall portion when the second wall portion and third wall portion are in the retracted, open position.

The horizontal portion of the second wall portion may be positioned between the arms of the first wall portion when the first wall portion and the second wall portion are in the deployed, closed position.

The horizontal portion of the third wall portion may be positioned between the arms of the second wall portion when the second wall portion and the third wall portion are in the deployed, closed position.

DETAILED DESCRIPTION

Figure 1:
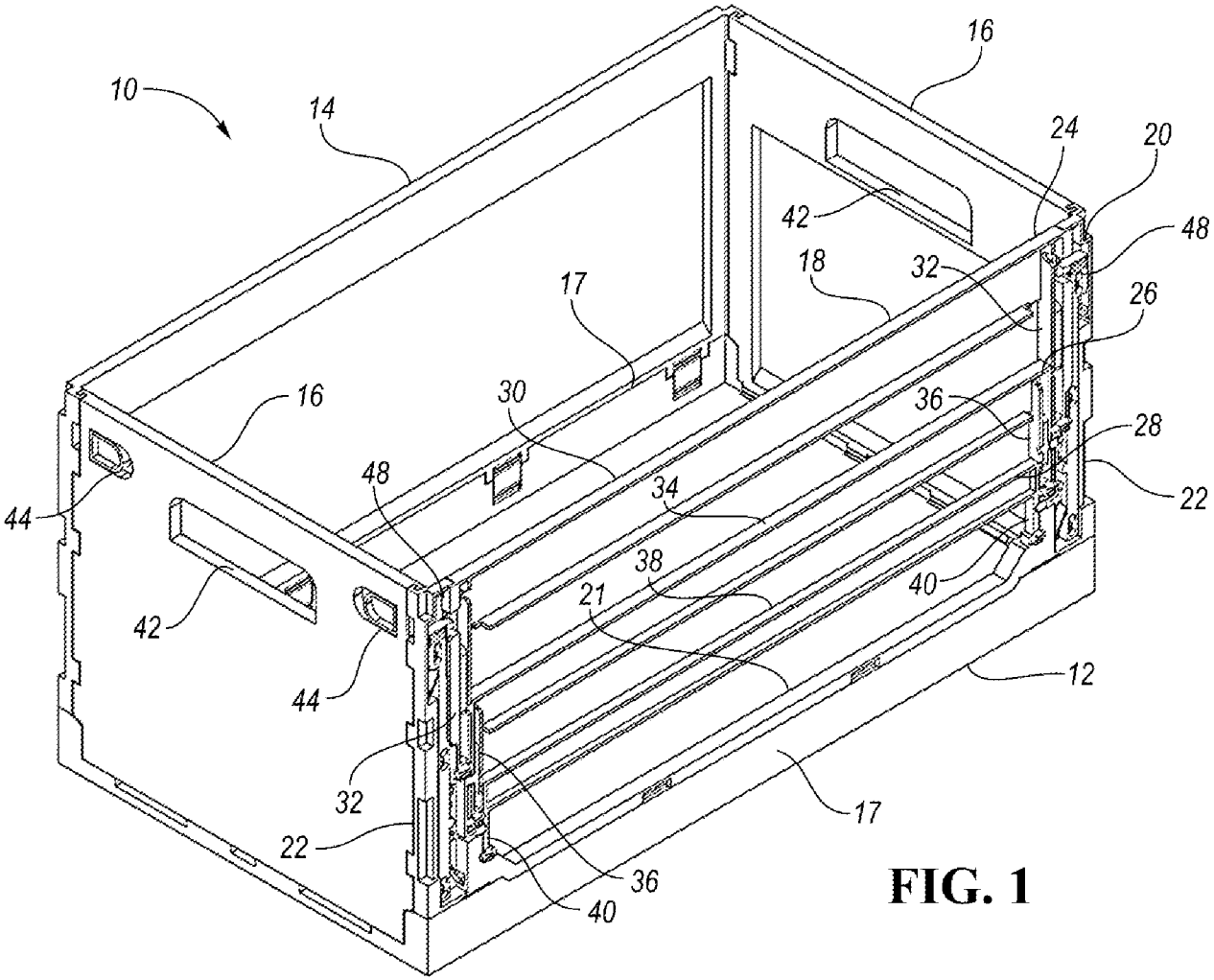
FIG. 1 is a perspective view of a first example collapsible container.

A collapsible container 10 according to a first embodiment is shown in FIGS. 1-25. In FIG. 1, the container 10 is in an upright, assembled position. The container 10 includes a base 12. A rear wall 14, end walls 16 and a front wall 18 are pivotably connected at a periphery of the base 12. The base 12 includes upstanding flanges 17 projecting upward from rear and front edges of the base 12 and formed integrally with the rest of the base 12. The end walls 16 are pivotably connected to end edges of the base 12 in a plane lower than are the front wall 18 and rear wall 14.

The front wall 18 includes a frame 20 pivotably connected to the flange 17 at the front of the base 12. The frame 20 includes a lower horizontal portion 21 and a pair of upright vertical portions 22, together forming a U shape. The front wall 18 further includes an upper (or "first") portion 24, a mid (or "second") portion 26 and a lower (or "third") portion 28 within the frame 20. In FIG. 1, the front wall 18 is in the closed position with the upper portion 24, mid portion 26 and lower portion 28 substantially closing the large opening in the frame 20.

The upper portion 24 includes a horizontal wall portion 30 and a pair of arms 32 extending from ends of the horizontal wall portion 30 in a direction generally in the plane of the horizontal wall portion 30 to form generally a U-shape (opening downward in FIG. 1). In FIG. 1, the upper portion 24 is selectively secured to the frame 20 in an upper, closed position by latches 48. The arms 32 of the upper portion 24 are pivotably connected to the vertical portions 22 of the frame 20.

The mid portion 26 includes a horizontal wall portion 34 and a pair of arms 36 extending from ends of the horizontal wall portion 34 in a direction generally in the plane of the horizontal wall portion 34 to form generally a U-shape (opening downward in FIG. 1). The mid portion 26 is partially received between the arms 32 of the upper portion 24. In this example, the horizontal wall portion 34 and upper portions of the arms 36 are received between lower portions of the arms 32 of the upper portion 24.

The lower portion 28 includes a horizontal wall portion 38 and a pair of arms 40 extending from ends of the horizontal wall portion 38 in a direction generally in the plane of the horizontal wall portion 38 to form generally a U-shape (opening downward in FIG. 1). The lower portion 28 is partially received between the arms 36 of the mid portion 26. In this example, the horizontal wall portion 38 and upper portions of the arms 40 are received between lower portions of the arms 36 of the mid portion 26.

In FIG. 1, the walls 14, 16, 18 are in their upright, use position. The front wall 18 is in its deployed, closed position, with the horizontal wall portions 30, 34, 38 of the upper, mid and lower portions 24, 26, 28 extending across an upper portion, a mid-portion, and a lower portion respectively, of a large opening defined by the frame 20. In the deployed, closed position, the front wall 18 keeps objects, such as egg cartons, in the container 10.

The end walls 16 are pivotably connected to end edges of the base 12. Each end wall includes a handle opening 42 near an upper edge thereof. Each end wall 16 includes a pair of latches 44 mounted therein for selectively securing the end wall 16 to the rear wall 14 and to the front wall 18 (more specifically to the frame 20). The latches 44 are spring-biased into recesses in the rear wall 14 and frame 20.

Figure 2:
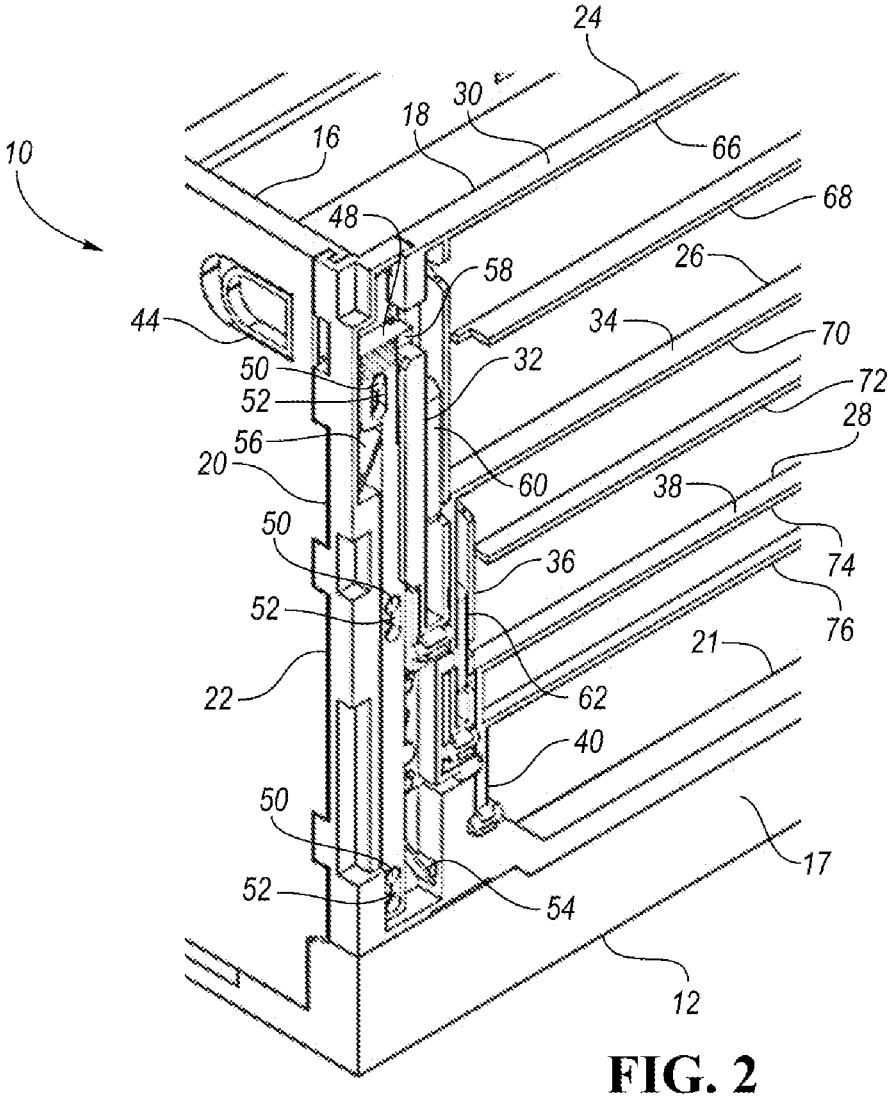
FIG. 2 is an enlarged perspective view of one front corner of the container of FIG. 1.

FIG. 2 is an enlarged perspective view of one front corner of the container 10 of FIG. 1. The other front corner would be mirror image. The latch 48 is shown in more detail. The latch 48 is an elongated vertical member slidably mounted for vertical translation within a vertical channel molded into the vertical portion 22 of the frame 20, and secured to a plurality (three, in this example) of pins 50 received in vertically elongated apertures 52 (or slots) in the latch 48. The pins 50 are integrally molded with the vertical portions 22 of the frame 20. A lower spring 54 and an upper spring 56 are integrally molded with the latch 48 and bias the latch 48 downward relative to the frame 20. In FIG. 2, the latch 48 is shown in the downward, latched position. A locking projection 58 projects inward over a portion of the arm 32 of the upper portion 24 to retain the upper portion 24 in the closed position.

As can be seen in FIG. 2, the arms 32 of the upper portion 24 each have an elongated recess for receiving a link 60 pivotably securing the upper portion 24 to the mid portion 26. The arms 36 of the mid portion 26 each have an elongated recess for receiving a link 62 pivotably securing the mid portion 26 to the lower portion 28.

The upper portion 24 includes the horizontal wall portion 30 and an upper horizontal rib 66 projecting outward from an upper edge thereof and a lower horizontal rib 68 projecting outward from a lower edge thereof. The upper horizontal rib 66 extends the full length of the upper portion 24. The lower horizontal rib 68 does not extend all the way to the edges of the upper portion 24.

The mid portion 26 includes the horizontal wall portion 34 and an upper horizontal rib 70 projecting outward from an upper edge thereof and a lower horizontal rib 72 projecting outward from a lower edge thereof. The upper horizontal rib 70 extends the full length of the mid portion 26. The lower horizontal rib 72 does not extend all the way to the edges of the mid portion 26. The horizontal wall portion 34 of the mid portion 26 is disposed between lower ends of the arms 32 of the upper portion 24.

The lower portion 28 includes the horizontal wall portion 38 and an upper horizontal rib 74 projecting outward from an upper edge thereof and a lower horizontal rib 76 projecting outward from a lower edge thereof. The upper horizontal rib 74 extends the full length of the lower portion 28. The lower horizontal rib 76 extends all the way to the edges of the lower portion 28. The horizontal wall portion 38 of the lower portion 28 is positioned partially between the arms 36 of the mid portion 26.

Figure 3:
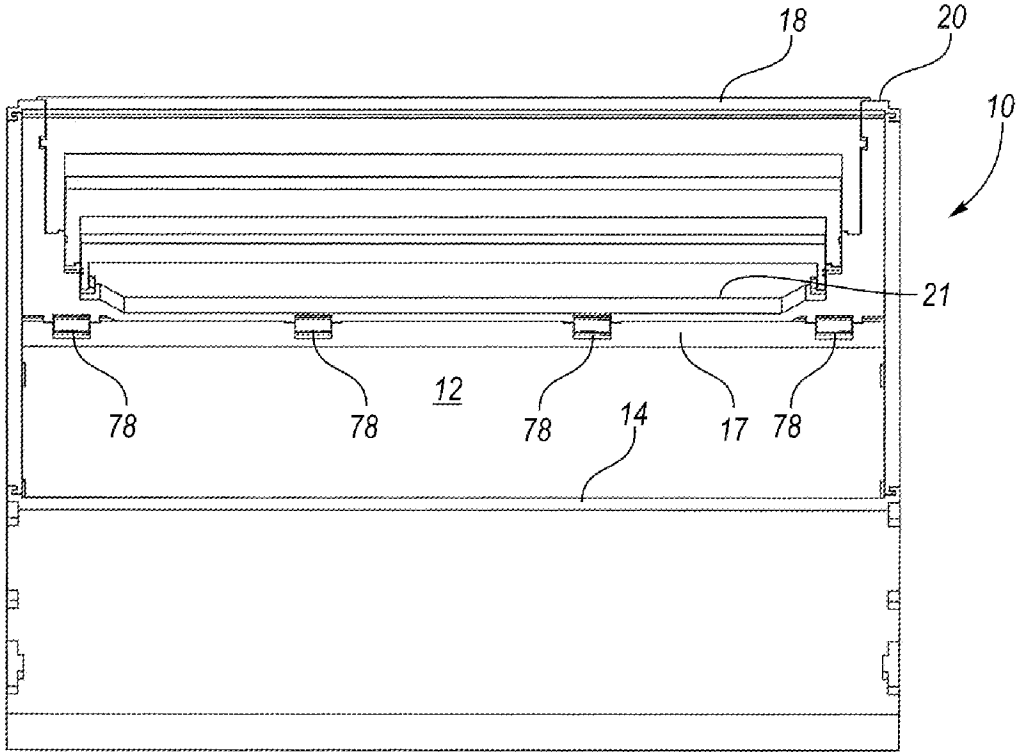
FIG. 3 is a rear upper perspective view of the container of FIG. 1.
Figure 4:
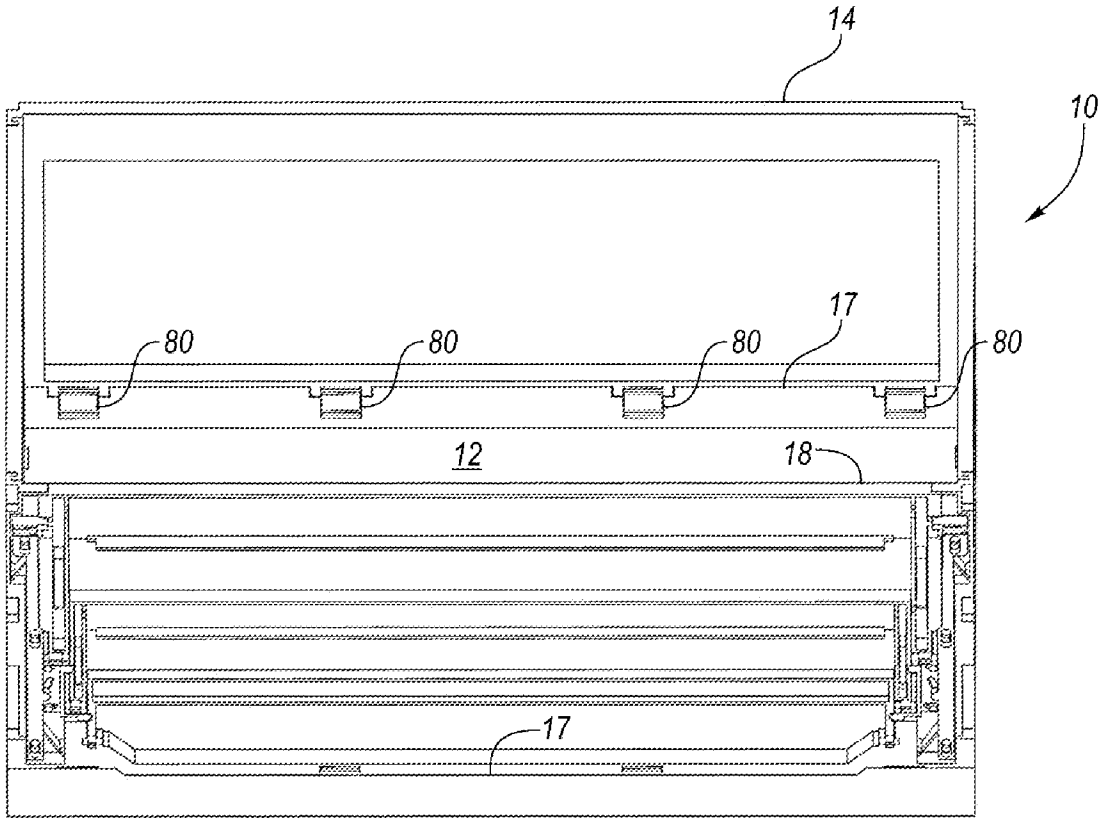
FIG. 4 is a front upper perspective view of the container of FIG. 1.

FIG. 3 is a rear upper perspective view of the container 10. Double-axis hinges 78 connect the frame 20 to the upstanding flange 17 of the base 12. These hinges reduce the collapsed height of the container 10. FIG. 4 is a front upper perspective view of the container 10. Double-axis hinges 80 connect the rear wall 14 to the upstanding flange 17 of the base 12. Again, these hinges reduce the collapsed height of the container 10.

Figure 5:
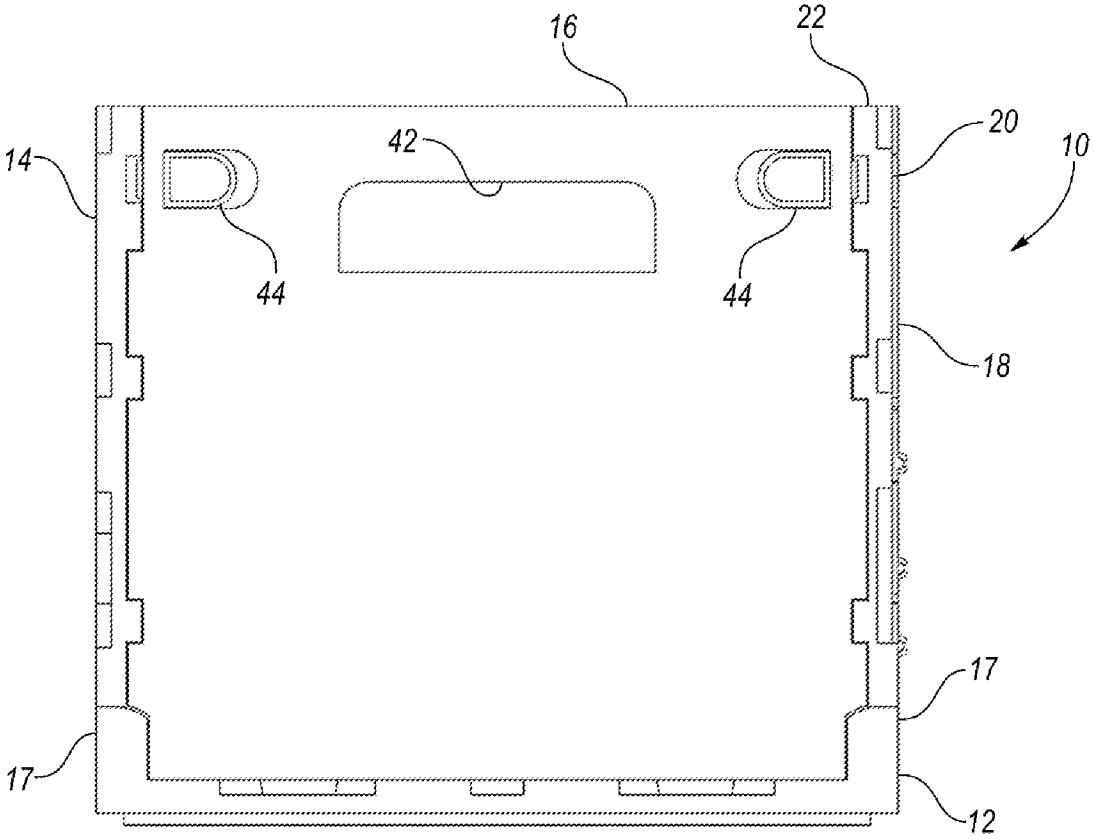
FIG. 5 is an end view of the container of FIG. 1.

FIG. 5 is an end view of the container 10. Each end wall 16 includes the handle opening 42 near an upper edge thereof. Each end wall 16—includes the pair of latches 44 mounted therein for selectively securing the end wall 16 to the rear wall 14 and to the front wall 18 (more specifically to the frame 20). The latches 44 are spring biased into recesses in the rear wall 14 and frame 20. The latches 44 can be released by moving them toward one another. Then the end wall 16 can be pivoted inward onto the base 12.

Figure 6:
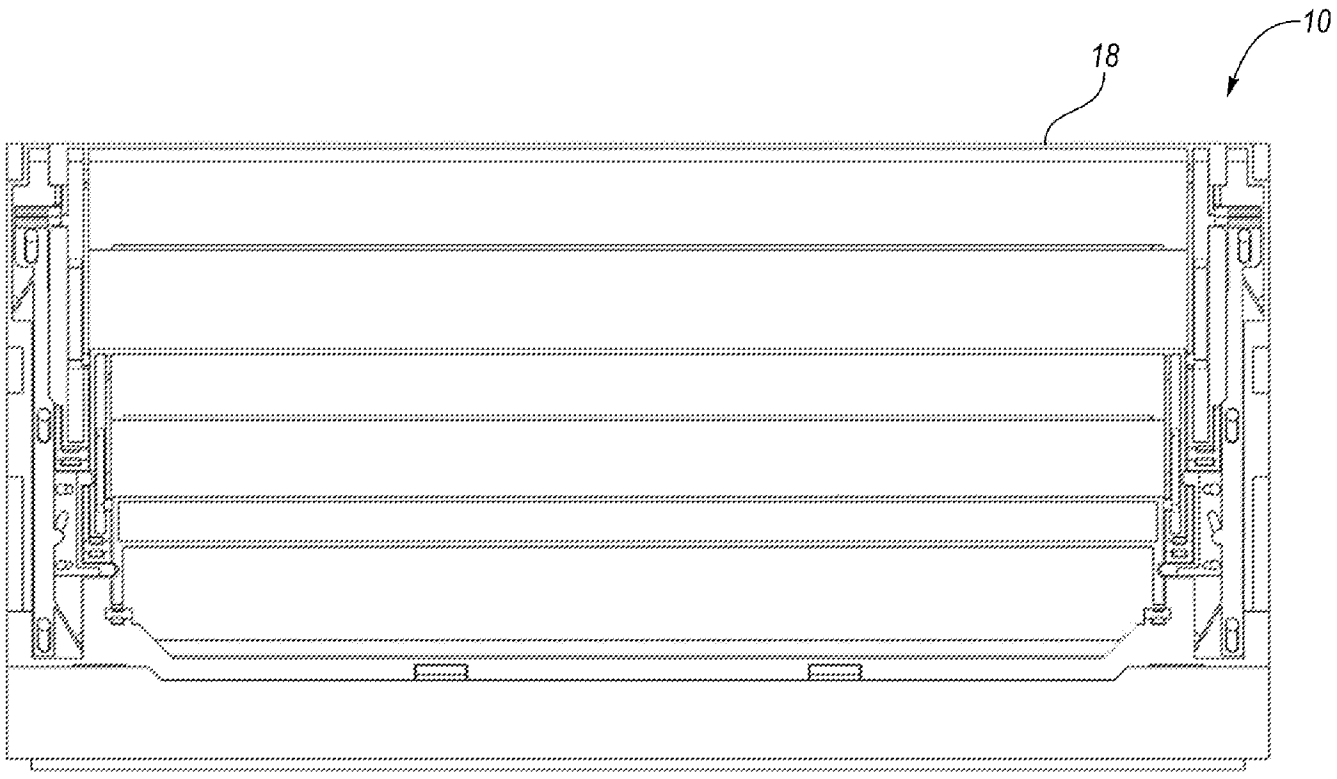
FIG. 6 is a front view of the container of FIG. 1.
Figure 7:
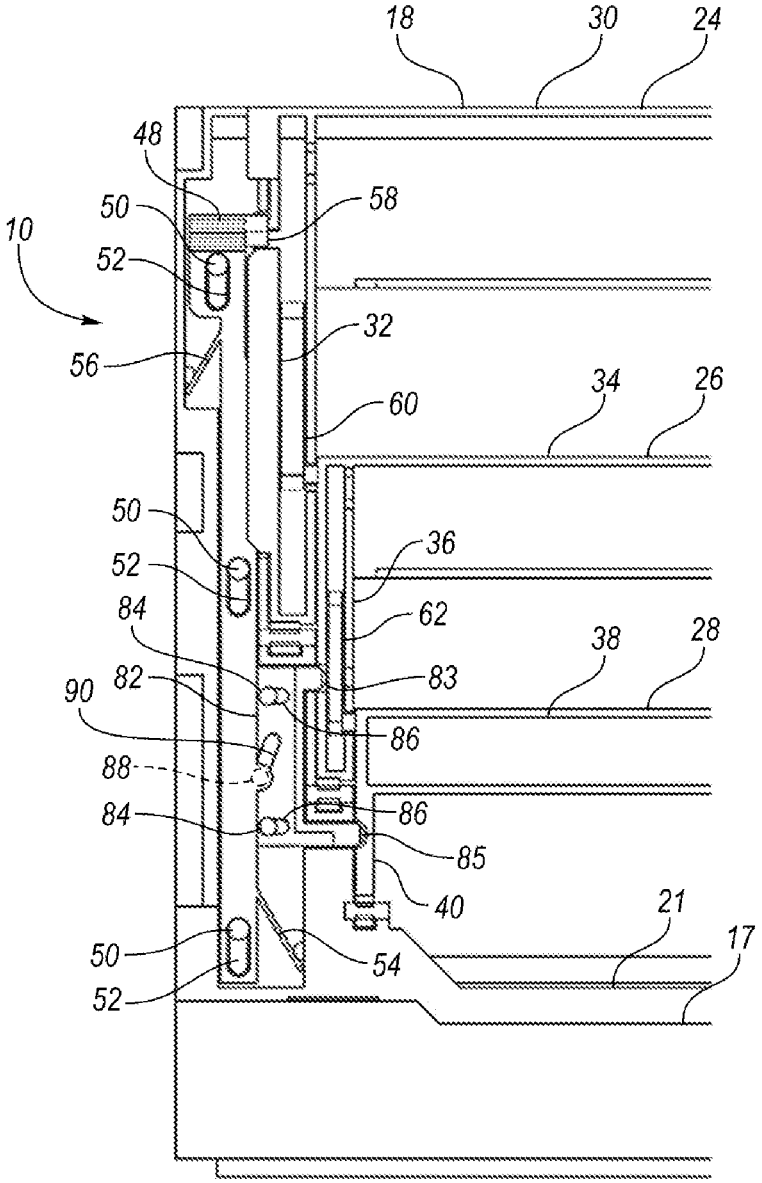
FIG. 7 is an enlarged view of the left end of the front of the container of FIG. 6.

FIG. 6 is a front view of the container 10. FIG. 7 is an enlarged view of the left end of the front of the container 10 of FIG. 6. Again, the right end would be mirror image. The latch 48 is mounted to slide vertically relative to the frame 20. A secondary latch 82 is also slidably mounted to the frame 20. The secondary latch 82 is mounted to slide horizontally relative to the frame 20 (i.e. right and left in FIG. 7). In FIG. 7, the secondary latch 82 is shown in the latched position (to the right) where it retains the mid portion 26 and lower portion 28 in the closed position. The secondary latch 82 includes an upper locking member 83 positioned outward of the arm 36 of the mid portion 26. The secondary latch 82 also includes a lower locking member 85 positioned outward of the arm 40 of the lower portion 28.

The secondary latch 82 is slidably mounted to pins 84 that are integrally molded with the vertical portions 22 of the frame 20 and that are received in horizontally-elongated apertures 86 in the secondary latch 82. The secondary latch 82 is moved horizontally (left and right in FIG. 7) by a cam between the secondary latch 82 and the latch 48. The cam comprises a pin 88 integrally molded with the latch 48 and projecting rearward into an elongated aperture 90 in the secondary latch 82. The elongated aperture 90 extends at an angle upward and inward, such that when the user slides the latch 48 upward, the cam causes the secondary latch 82 to move outward (left in FIG. 7). The cam could alternatively have the pins formed on the secondary latch 82 and have the pins received in an angled slot on the latch 48.

The arms 36 of the mid portion 26 are between the arms 32 of the upper portion 24. The arms 40 of the lower portion 28 are between the arms 36 of the mid portion 26. The arms 32, 36, 40 are configured, by virtue of their length and the position at which they are hingeably connected to the frame 20, such that the horizontal wall portions 30, 34, 38 can nest when they are in the retracted, open position (discussed below).

Figure 8:
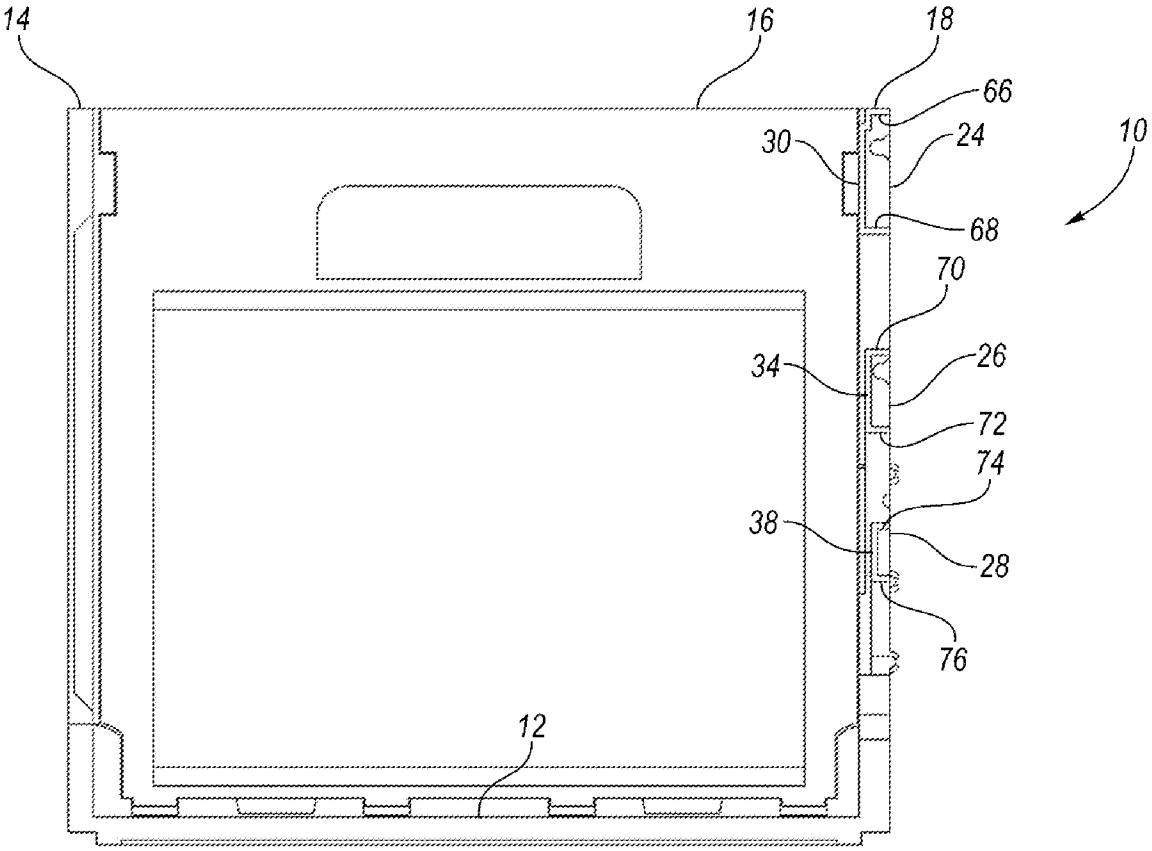
FIG. 8 is a section view of the container of FIG. 1.

FIG. 8 is a section view of the container 10. The upper portion 24 includes the horizontal wall portion 30 and the upper horizontal rib 66 projecting outward from an upper edge thereof and the lower horizontal rib 68 projecting outward from a lower edge thereof. The mid portion 26 includes the horizontal wall portion 34 and the upper horizontal rib 70 projecting outward from the upper edge thereof and the lower horizontal rib 72 projecting outward from the lower edge thereof. The lower portion 28 includes the horizontal wall portion 38 and the upper horizontal rib 74 projecting outward from the upper edge thereof and the lower horizontal rib 76 projecting outward from the lower edge thereof. As can be seen, the horizontal wall portion 30 of the upper portion 24 is taller (i.e. has a greater vertical dimension) than the horizontal wall portion 34 of the mid portion 26, which is taller than the horizontal wall portion 38 of the lower portion 28.

Figure 9:
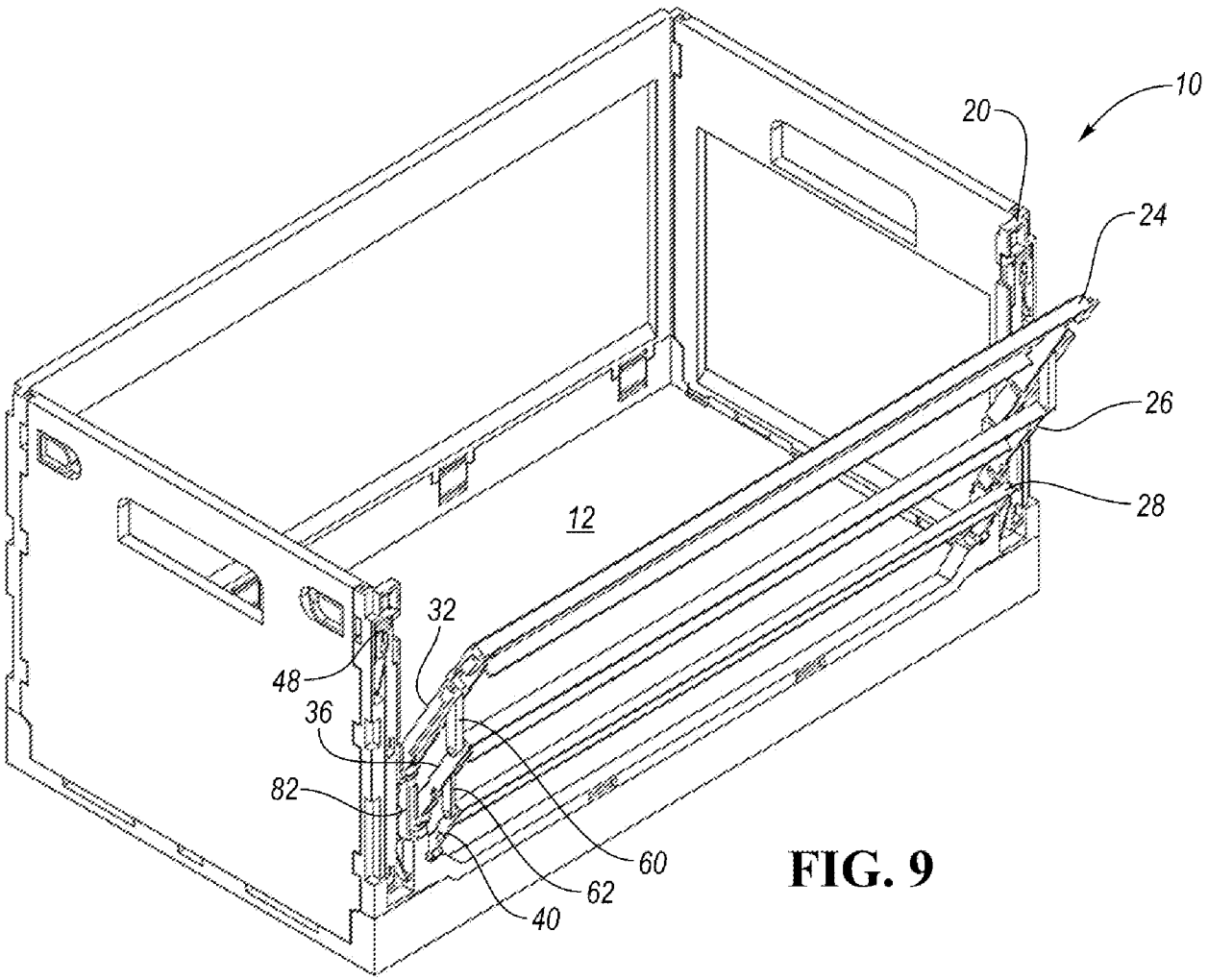
FIG. 9 shows the container of FIG. 1 with the latches released and the front wall beginning to be moved toward a retracted position.
Figure 10:
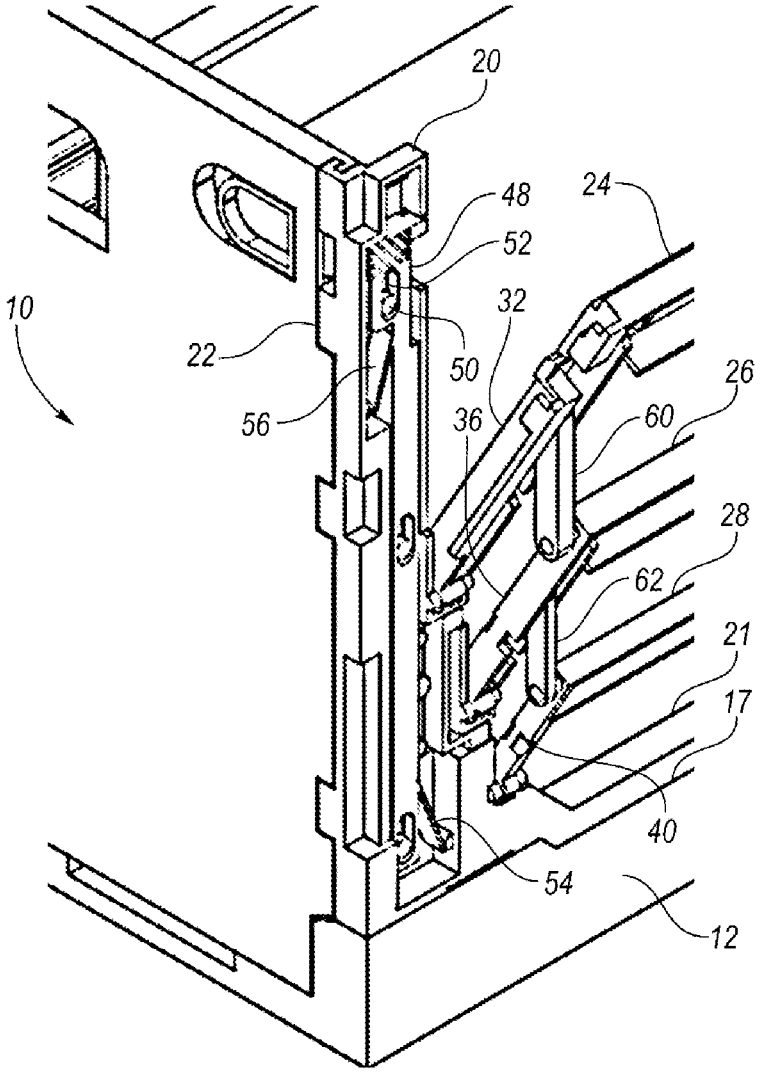
FIG. 10 is an enlarged view of one corner of FIG. 9.

In FIG. 9, the latches 48 have been slid upward relative to the frame 20, also causing the secondary latches 82 to slide outward (away from each other). This permits the upper portion 24, mid portion 26, and lower portion 28 to pivot outward of the frame 20. The links 60, 62 also pivot outward so that the upper portion 24, mid portion 26 and lower portion 28 all pivot and move together. The user can lift and lower all three portions 24, 26, 28 by moving any one of them. FIG. 10 is an enlarged view of one corner of FIG. 9. The links 60, 62 pivot outward of the recesses in the arms 32, 36.

Figure 11:
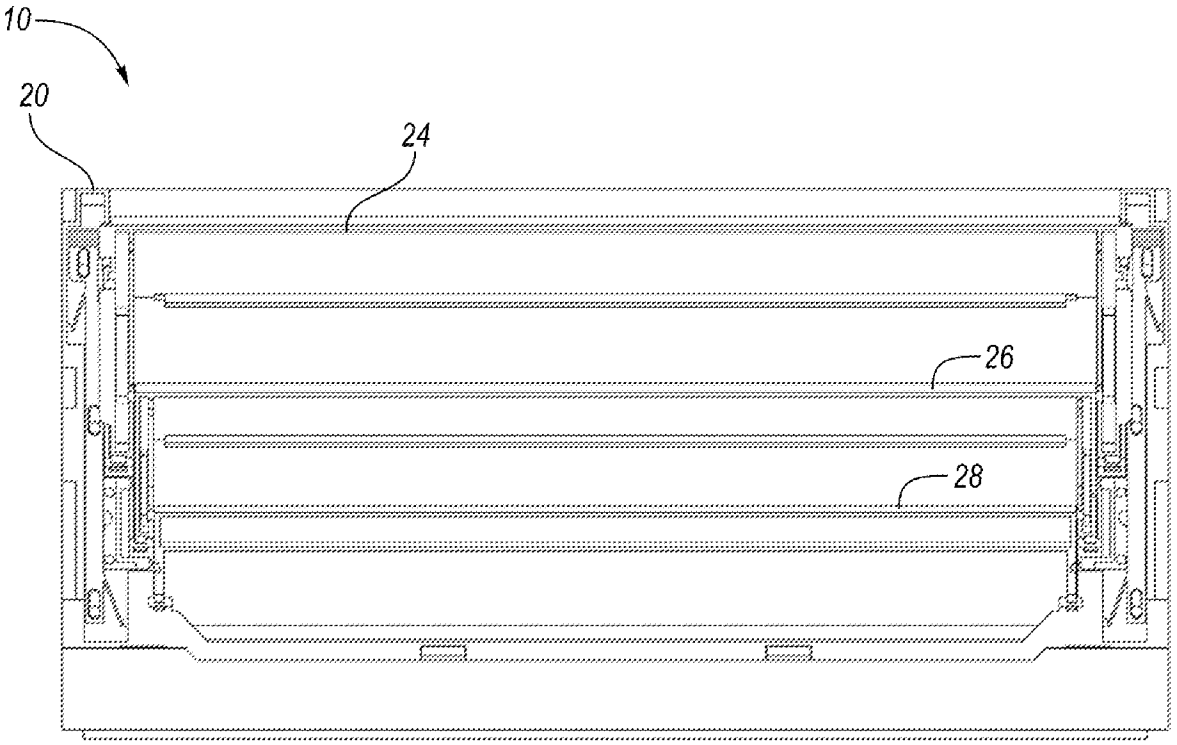
FIG. 11 is a front view of the container of FIG. 9.
Figure 12:
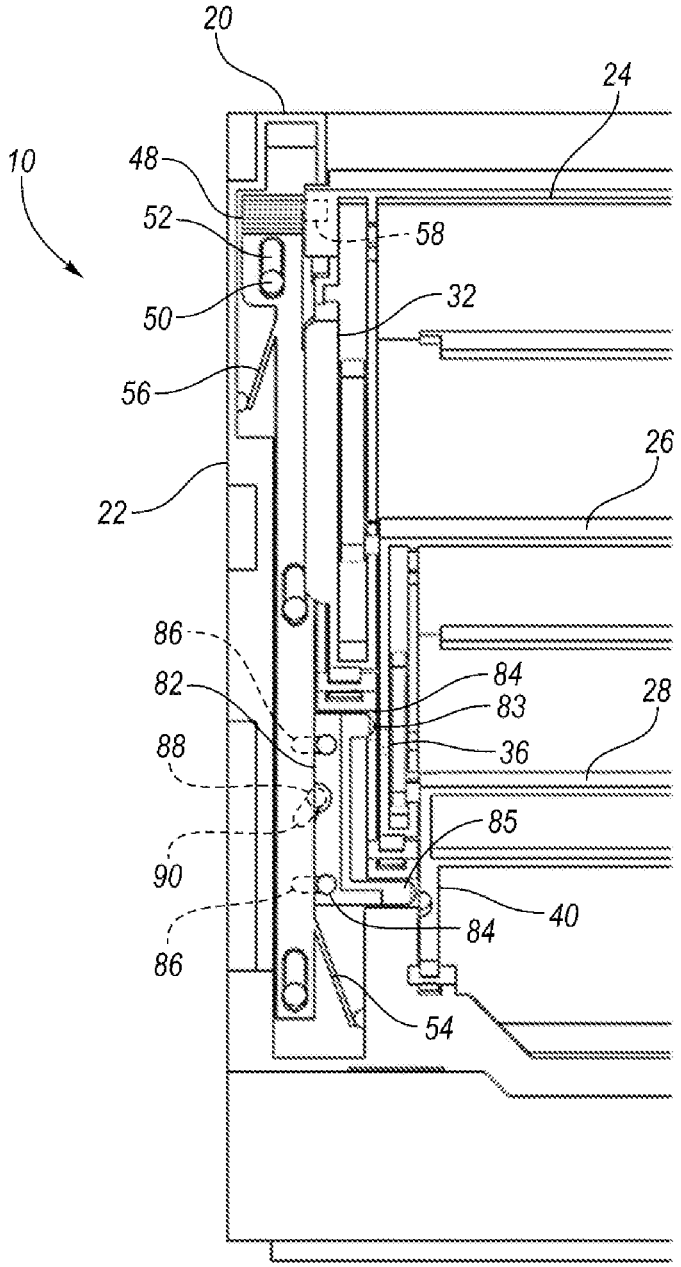
FIG. 12 is an enlarged view of one end of the front wall of the container of FIG. 11.
Figure 13:
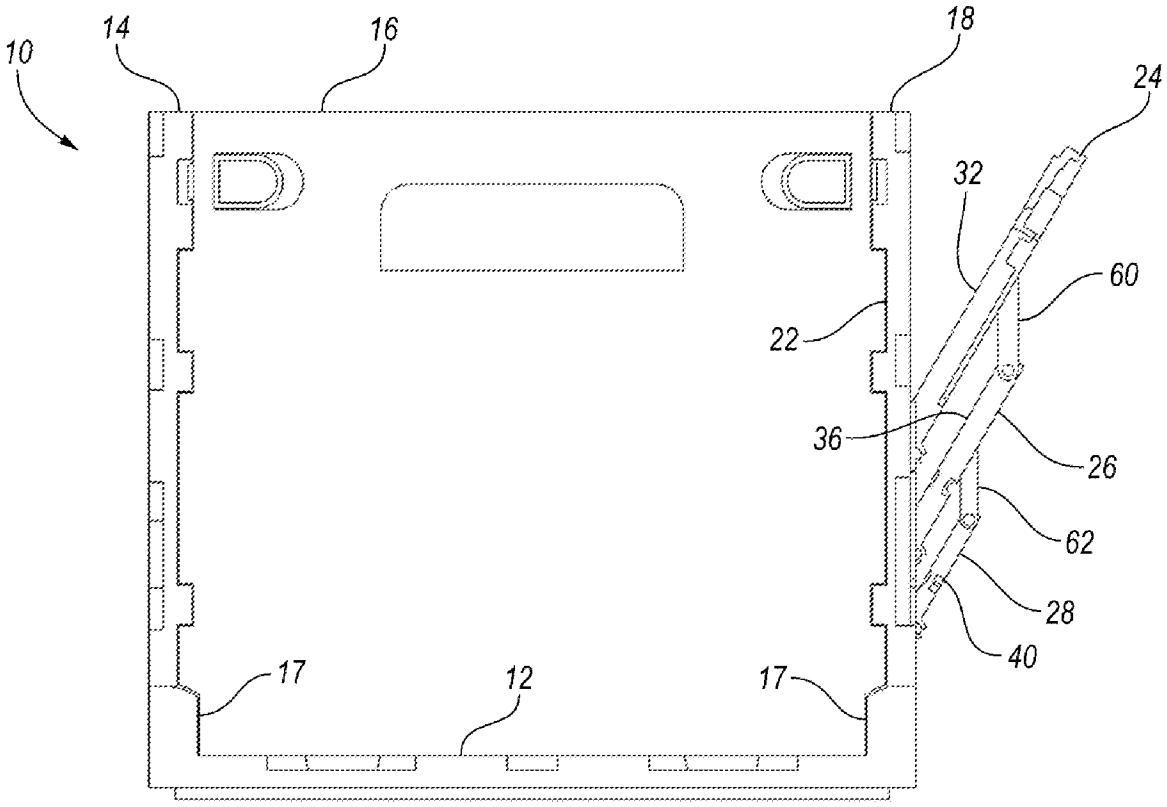
FIG. 13 is an end view of the container of FIG. 9.

FIG. 11 is a front view of the container 10 of FIG. 9. FIG. 12 is an enlarged view of one end of the front wall 18 of the container 10 of FIG. 11. The latch 48 has been slid upward relative to the frame 20 to an unlatched position, also causing the secondary latch 82 to slide outward (to the left in FIG. 12) to an unlatched position. As shown, the locking projection 58 releases the arm 32 of the upper portion 24. The pin 88 slides to the top of the angled aperture 90 in the secondary latch 82, causing the secondary latch 82 to move outward (to the left in FIG. 12). This moves the upper locking member 83 out from in front of the arm 36 and moves the lower locking member 85 out from in front of the arm 40. As shown, the upper portion 24, mid portion 26, and lower portion 28 can start to pivot outward of the frame 20. The upper spring 56 and lower spring 54 are elastically deformed, and bias the latch 48 downward back toward the latched position. FIG. 13 is an end view of the container 10 with the front wall 18 beginning to be retracted.

Figure 14:
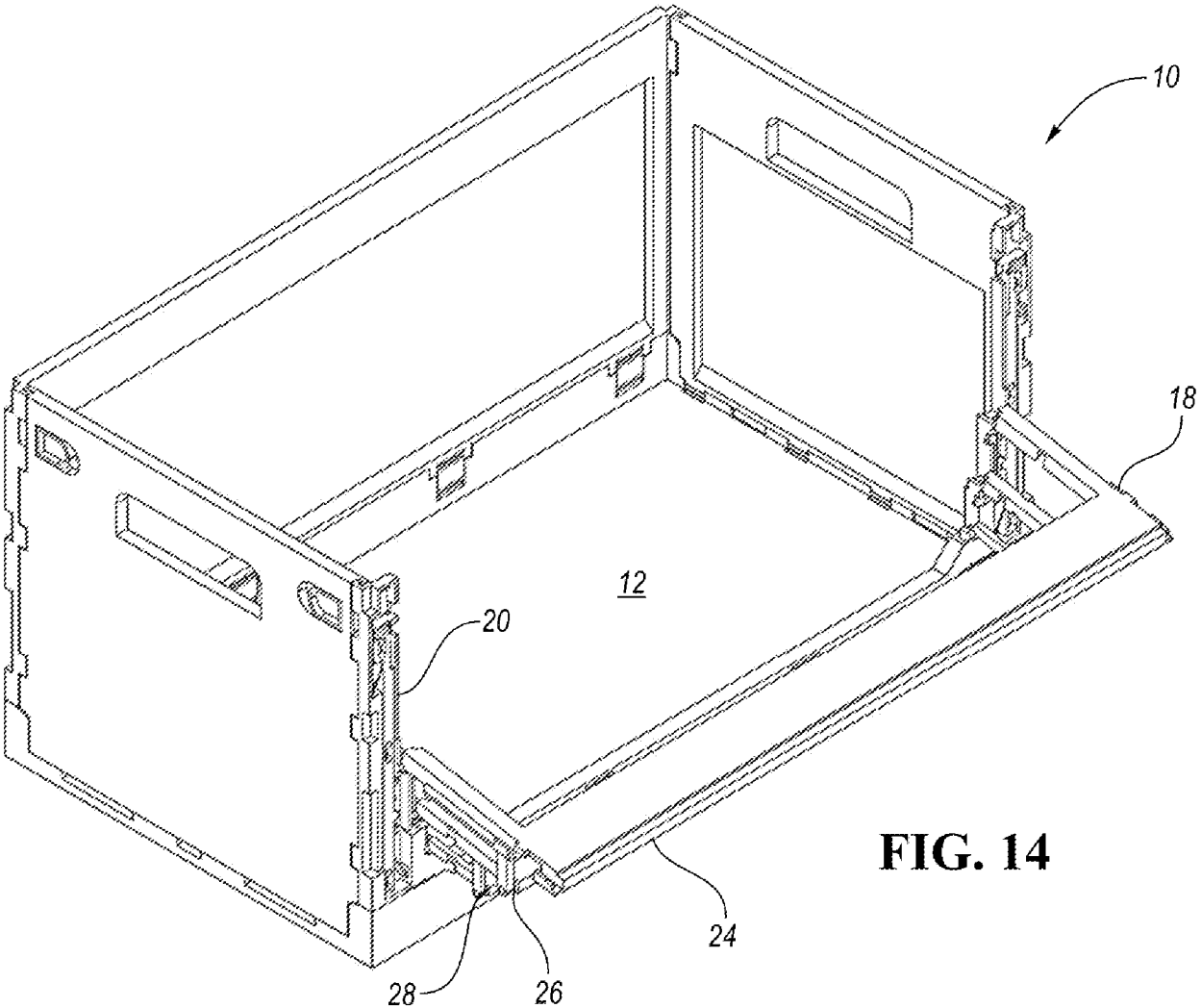
FIG. 14 is a perspective view of the container of FIG. 1 with the front wall in a second stage of being retracted.
Figure 15:
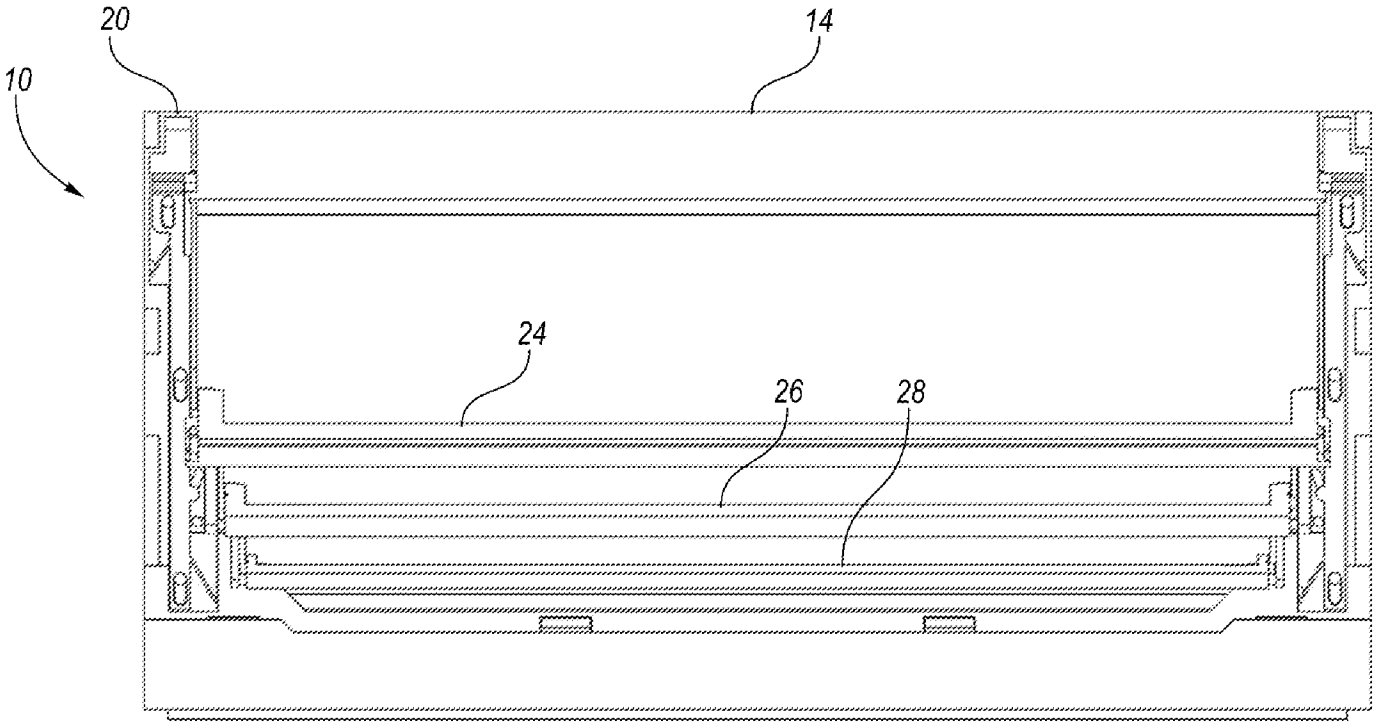
FIG. 15 is a front view of the container of FIG. 14.
Figure 16:
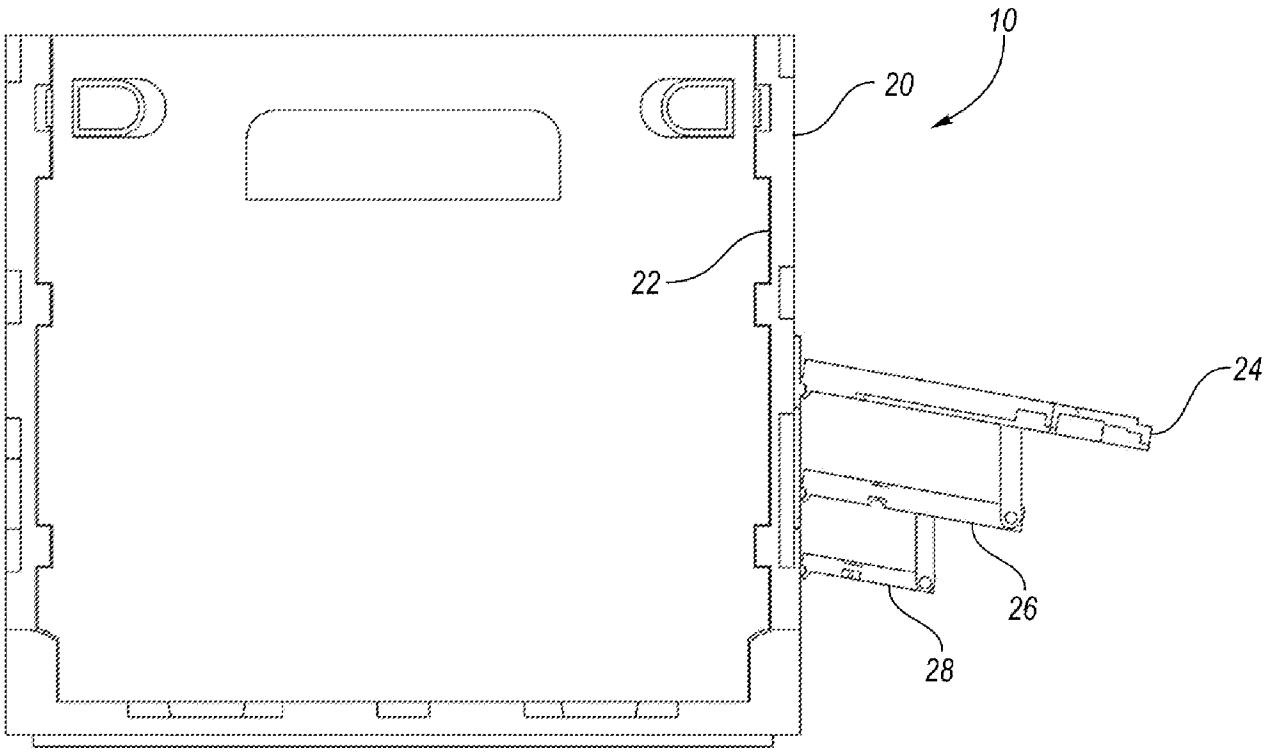
FIG. 16 is an end view of the container of FIG. 14.
Figure 17:
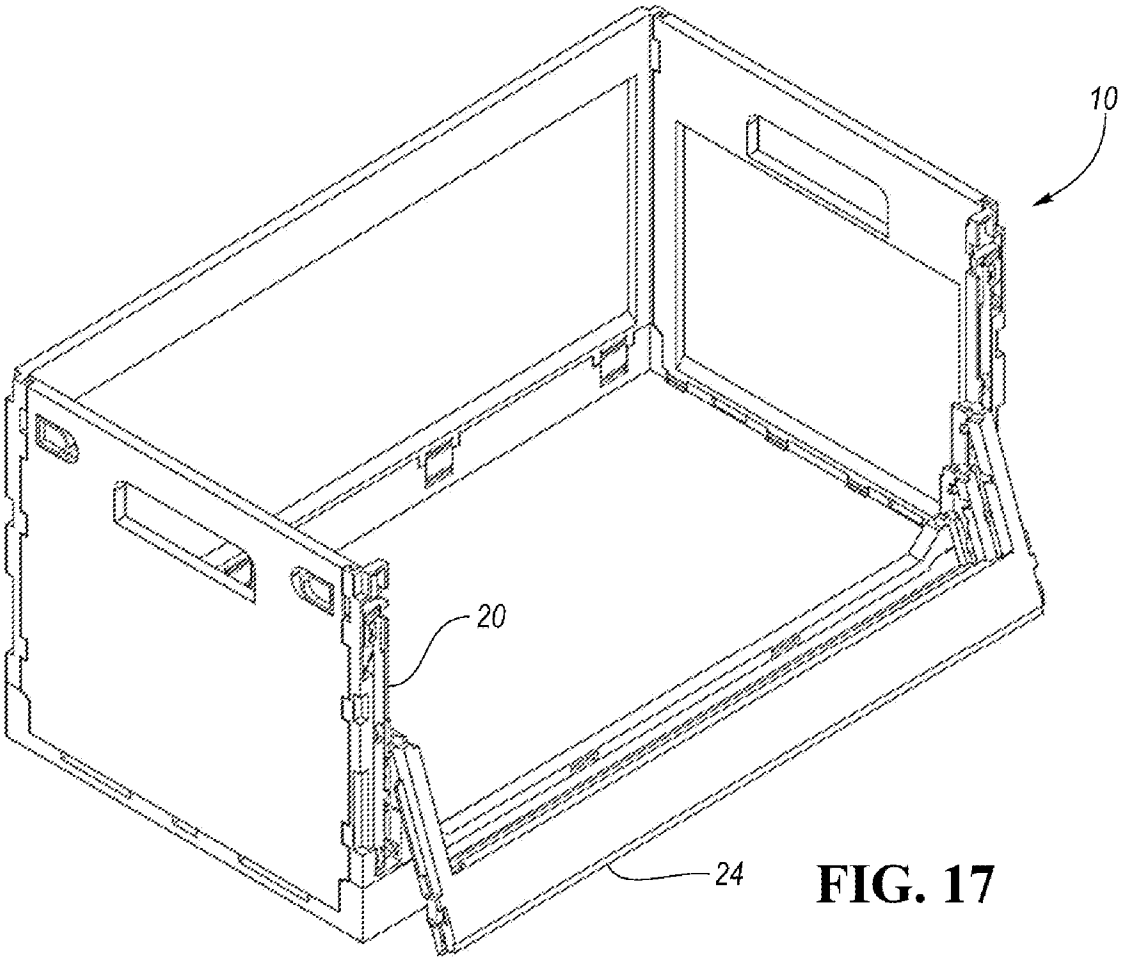
FIG. 17 is a perspective view of the container of FIG. 1 with the front wall pivoted further toward the retracted position.
Figure 18:
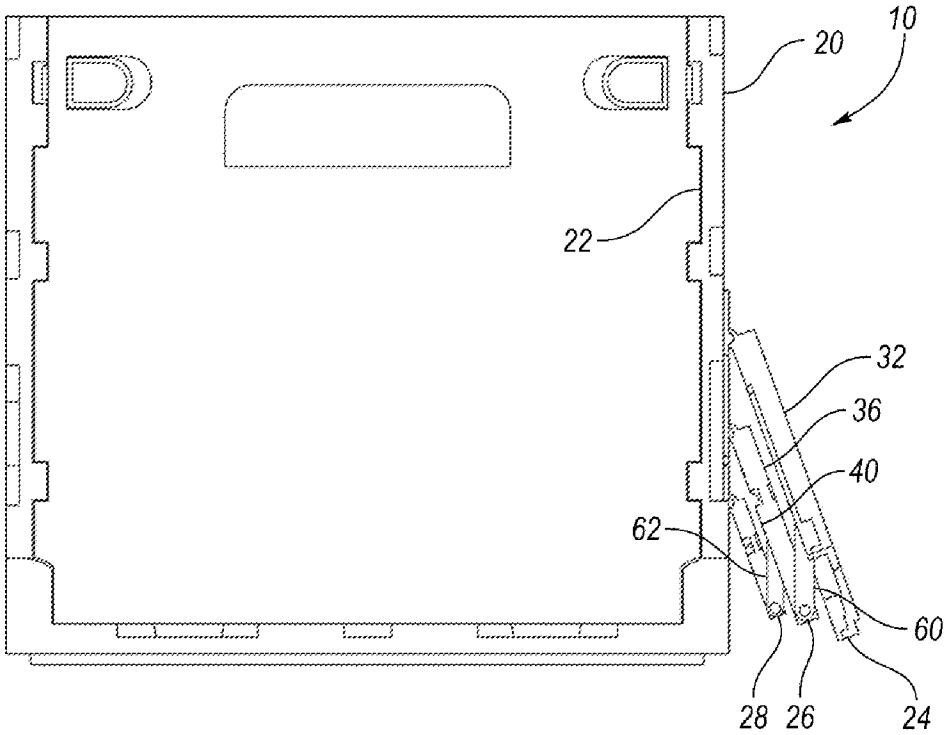
FIG. 18 is an end view of the container of FIG. 17.

FIGS. 14, 15 and 16 show a second stage of the front wall 18 being retracted. FIGS. 17 and 18 show the upper portion 24, mid portion 26, and lower portion 28 pivoted further toward the retracted position.

Figure 19:
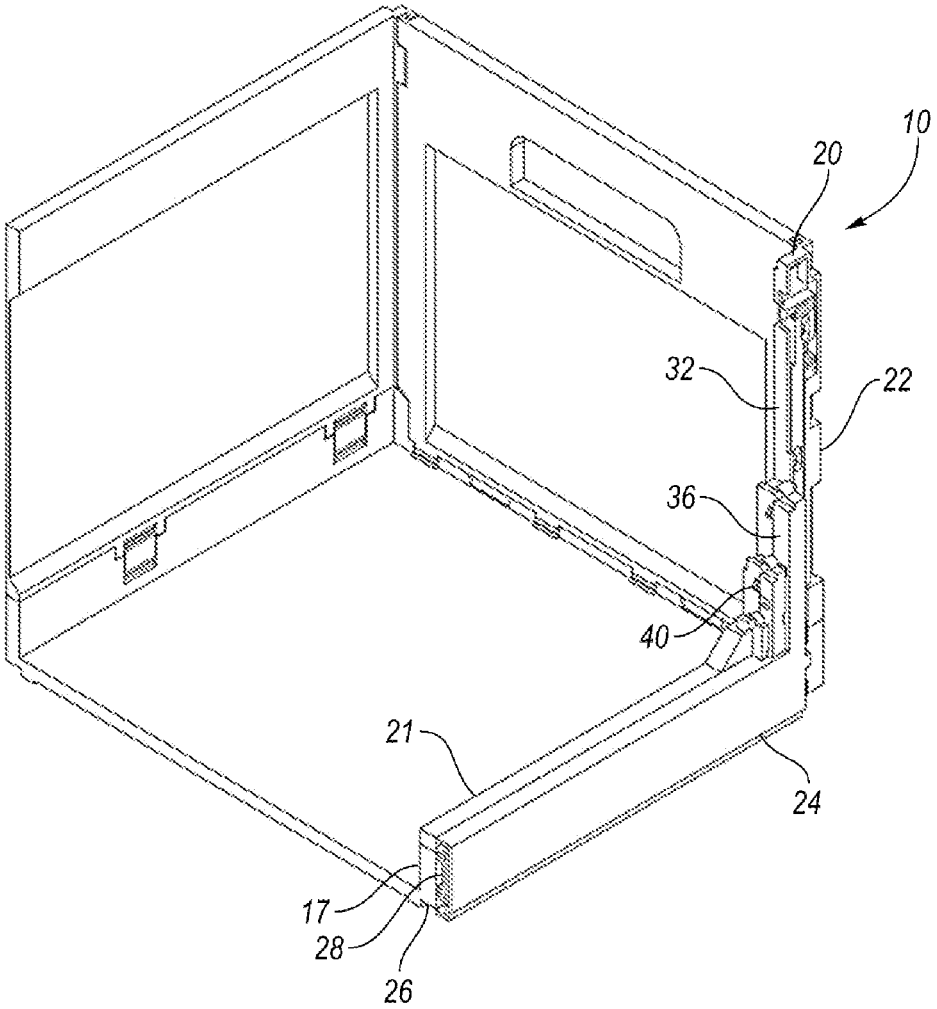
FIG. 19 is a perspective view of the container, partially broken away, with the front wall in the retracted position.
Figure 20:
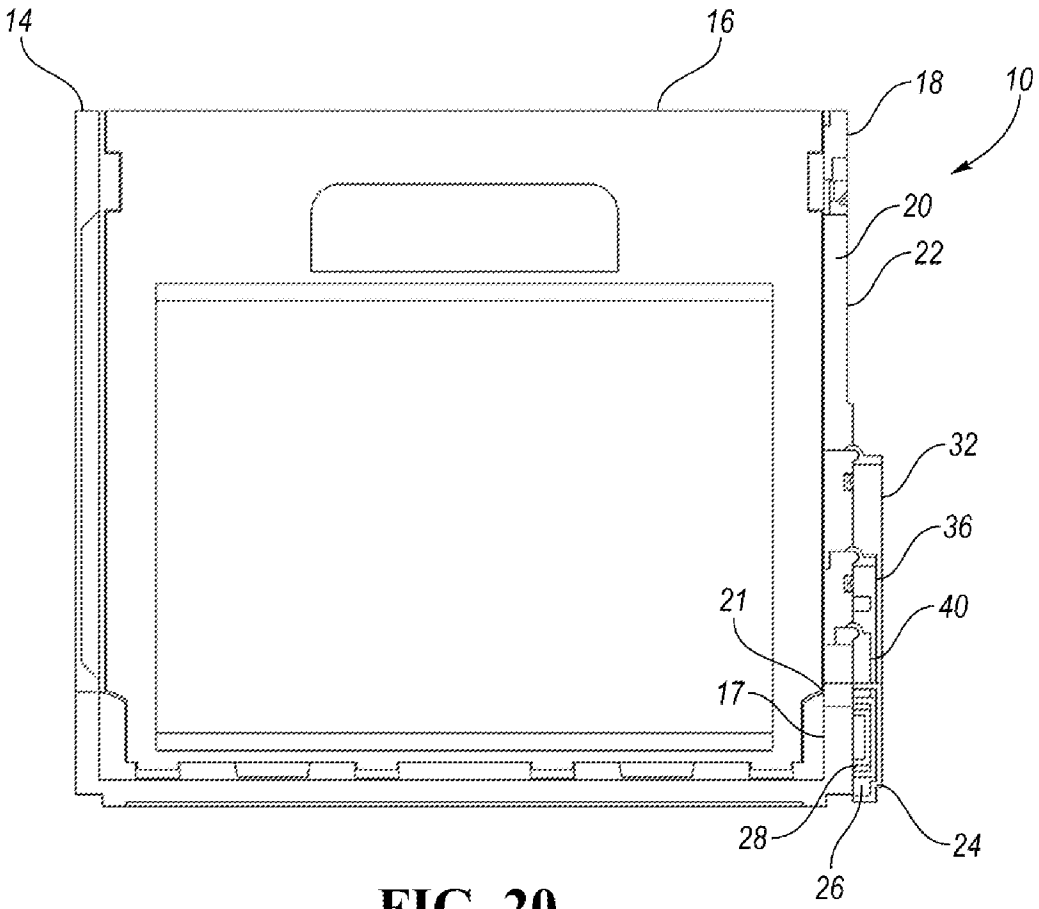
FIG. 20 is an end view of the container of FIG. 19, partially broken away.
Figure 21:
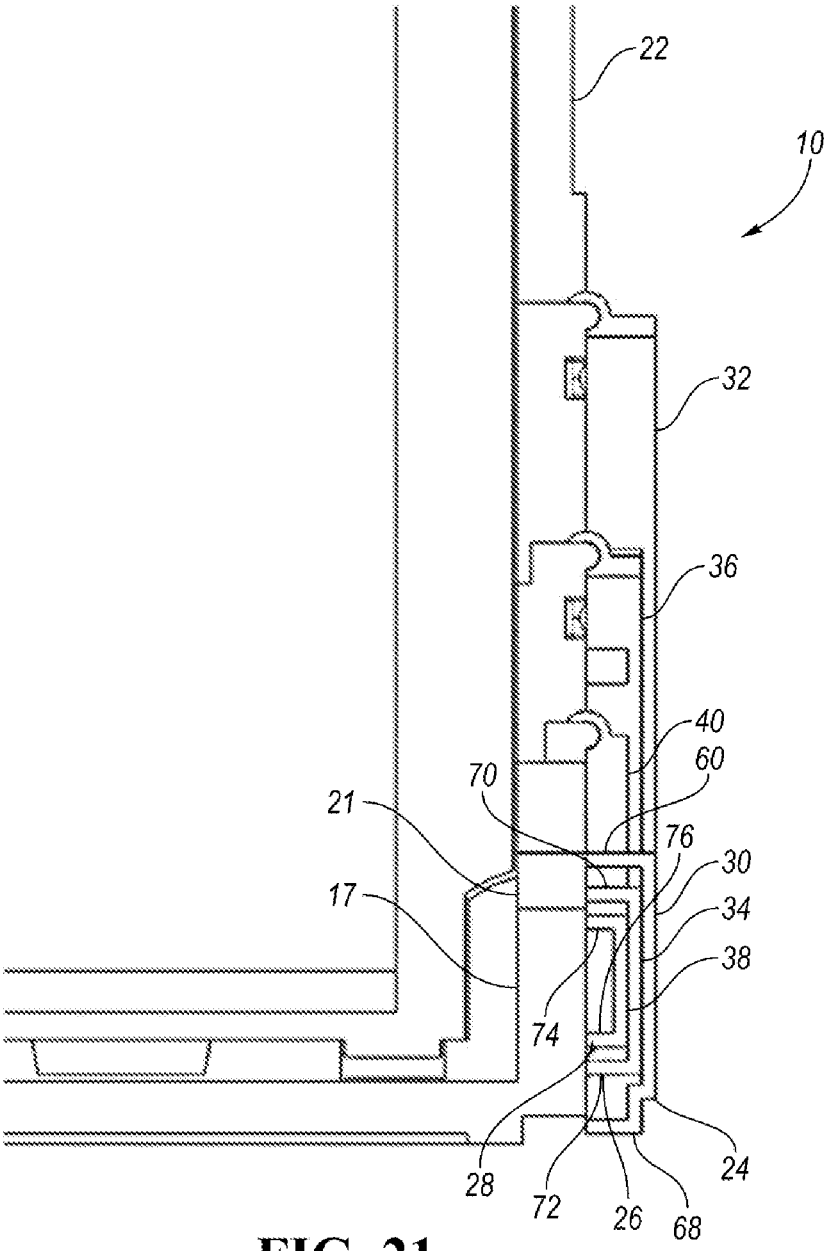
FIG. 21 is an enlarged view of the section view of FIG. 20.

FIG. 19 is a section view of the container 10 with the front wall 18 in the retracted position. The upper portion 24, mid portion 26 and lower portion 28 are nested adjacent the upstanding flange 17 and the horizontal portion 21 of the frame 20. The arms 36 of the mid portion 26 are inward of the arms 32 of the upper portion 24. The arms 40 of the lower portion 28 are inward of the mid portion 26. In the retracted position, all of the arms 32, 36, 40 extend upward from the respective wall portions 30, 34, 38. FIG. 21 is an enlarged view of the section view of FIG. 20.

As shown in FIG. 21, horizontal wall portion 34 of the mid portion 26 is nested within the horizontal wall portion 30 of the upper portion 24. The horizontal wall portion 38 of the lower portion 28 is nested within the horizontal wall portion 34 of the mid portion 26. In this manner, the upper portion 24, mid portion 26 and lower portion 28 can lie flat against the upstanding flange 17 and frame 20.

More particularly, the horizontal wall portion 34 of the mid portion 26 is nested between the upper horizontal rib 66 and lower horizontal rib 68 of the upper portion 24. The horizontal wall portion 30 is outward of the horizontal wall portion 34. The horizontal wall portion 38 of the lower portion 28 is nested between the upper horizontal rib 70 and the lower horizontal rib 72 of the mid portion 26. The horizontal wall portion 34 is outward of the horizontal wall portion 38.

Figure 22:
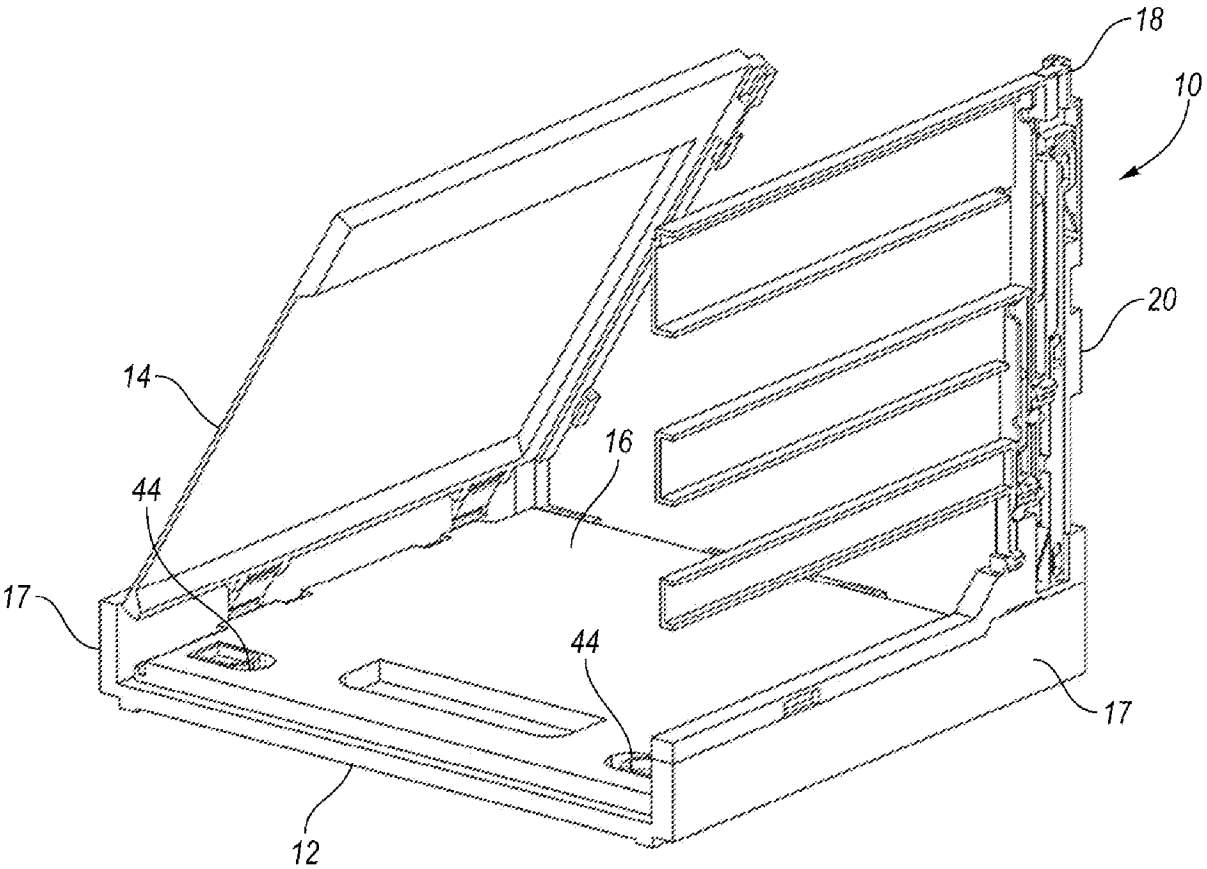
FIG. 22 shows a first step in collapsing the container, partially broken away.
Figure 23:
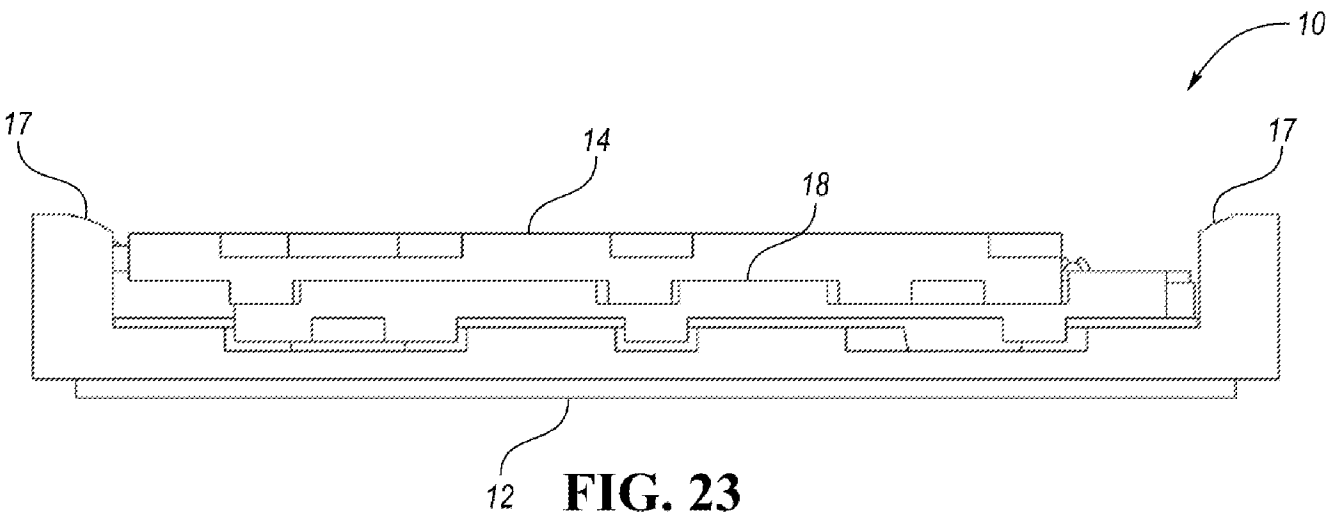
FIG. 23 is an end view of the fully collapsed container.
Figure 24:
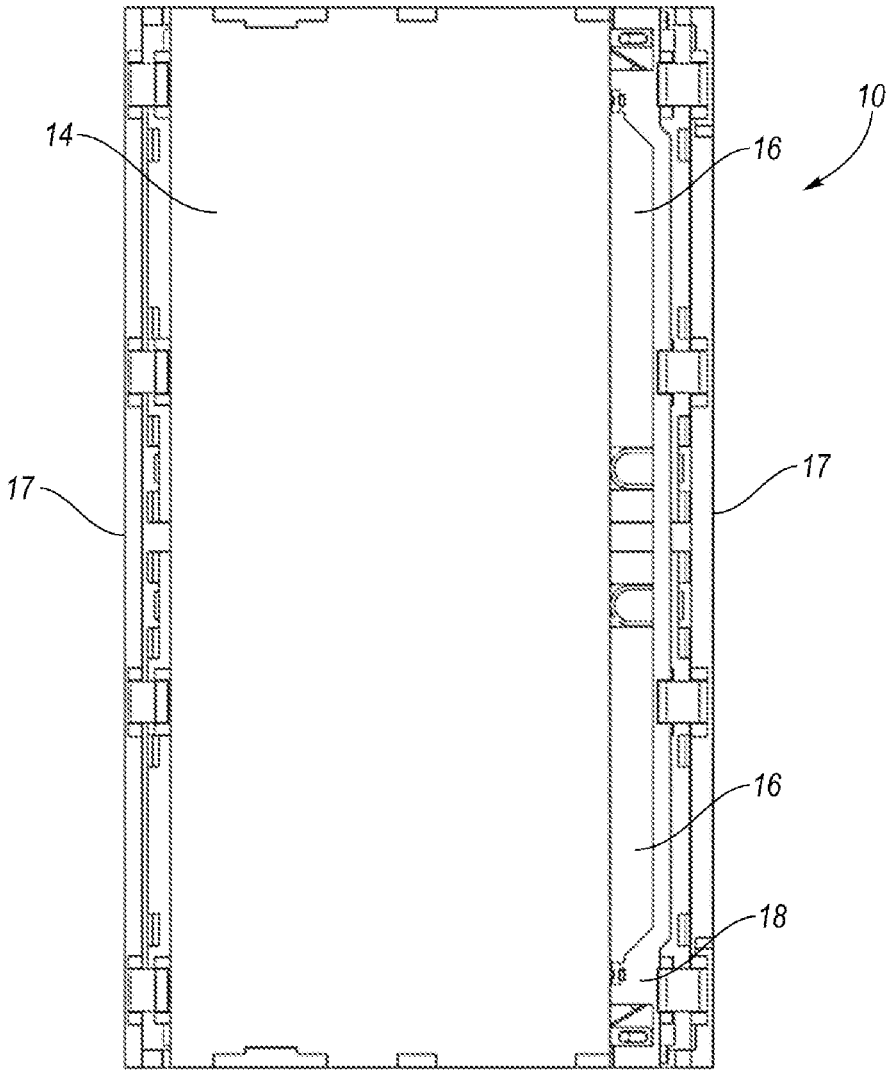
FIG. 24 is a top view of the collapsed container.
Figure 25:
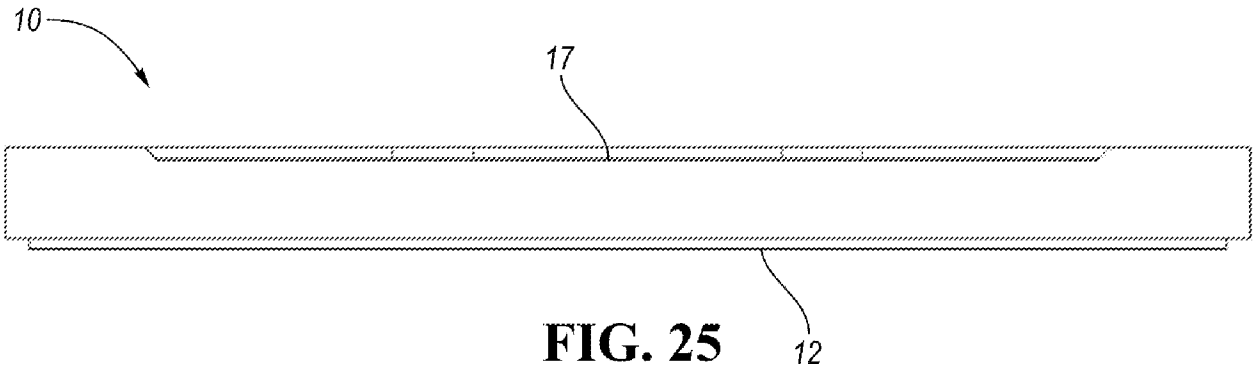
FIG. 25 is a front view of the collapsed container.

FIG. 22 shows a first step in collapsing the container 10. The end walls 16 (one shown) are collapsed onto the base 12 after releasing the latches 44. The rear wall 14 and front wall 18 can then be collapsed onto the end walls 16, as shown in FIG. 23. FIG. 24 is a top view of the collapsed container 10. FIG. 25 is a front view of the collapsed container 10.

Figure 26:
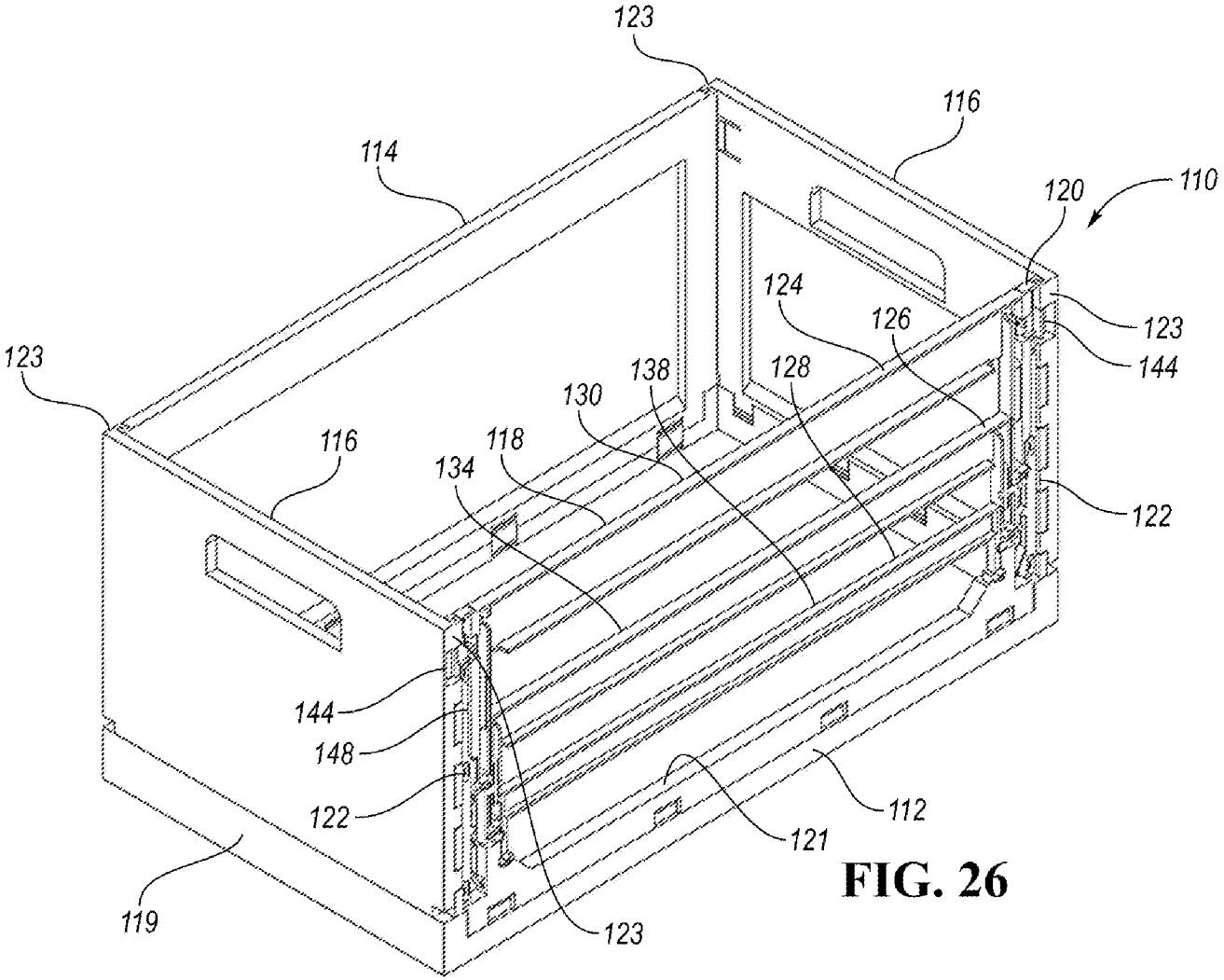
FIG. 26 is a perspective view of a third example collapsible container.

A collapsible container 110 according to a second embodiment is shown in FIG. 26. The container 110 functions similarly to the container 10 of FIGS. 1-25 except as otherwise shown or described. Primarily, the container 110 is collapsed by first folding the rear wall 114 and front wall 118 onto the base 112 (in either order), rather than the end walls 16 first as in the previous container 10. This permits the front wall 118 to have a taller vertical opening because the frame 120 is hinged closer to the base 112.

In FIG. 26, the container 110 is in an upright, assembled position. The container 110 includes a base 112. A rear wall 114, end walls 116 and a front wall 118 are pivotably connected at a periphery of the base 112. The base 112 includes upstanding flanges 119 projecting upward from end edges of the base 112 and formed integrally with the rest of the base 112. The front wall 118 and rear wall 114 are pivotably connected to the base 112 about axes lower than are the end walls 116.

The front wall 118 includes a frame 120 pivotably connected at the front of the base 112. The frame 120 includes a lower horizontal portion 121 and a pair of upright vertical portions 122, together forming a U shape. The front wall 118 further includes an upper (or "first") portion 124, a mid (or "second") portion 126 and a lower (or "third") portion 128 within the frame 120. In FIG. 26, the front wall 118 is in the closed position with the upper portion 124, mid portion 126 and lower portion 128 substantially closing the large opening in the frame 120.

The upper portion 124 includes a horizontal wall portion 130 and a pair of arms 132 extending from ends of the horizontal wall portion 130 in a direction generally in the plane of the horizontal wall portion 130 to form generally a U-shape (opening downward in FIG. 26). In FIG. 26, the upper portion 124 is selectively secured to the frame 120 in an upper, closed position by latches 148. The arms 132 of the upper portion 124 are pivotably connected to the vertical portions 122 of the frame 120.

The mid portion 126 includes a horizontal wall portion 134 and a pair of arms 136 extending from ends of the horizontal wall portion 134 in a direction generally in the plane of the horizontal wall portion 134 to form generally a U-shape (opening downward in FIG. 26). The mid portion 126 is partially received between the arms 132 of the upper portion 124. In this example, the horizontal wall portion 134 and upper portions of the arms 136 are received between lower portions of the arms 132 of the upper portion 124.

The lower portion 128 includes a horizontal wall portion 138 and a pair of arms 140 extending from ends of the horizontal wall portion 138 in a direction generally in the plane of the horizontal wall portion 138 to form generally a U-shape (opening downward in FIG. 26). The lower portion 128 is partially received between the arms 136 of the mid portion 126. In this example, the horizontal wall portion 138 and upper portions of the arms 140 are received between lower portions of the arms 136 of the mid portion 126.

In FIG. 26, the walls 114, 116, 118 are in their upright, use position. The front wall 118 is in its deployed, closed position, with the horizontal wall portions 130, 134, 138 of the upper, mid and lower portions 124, 126, 128 extending across an upper portion, a mid-portion, and a lower portion respectively, of a large opening defined by the frame 120. In the deployed, closed position, the front wall 118 keeps objects, such as egg cartons, in the container 110.

The end walls 116 are pivotably connected to end edges of the base 112. Each end wall includes a handle opening 142 near an upper edge thereof. Each end wall 116 includes a pair of opposed side flanges 123 projecting perpendicularly from the end wall 116. Each side flange 123 includes latch 144 mounted therein for selectively securing the end wall 116 to the rear wall 114 and to the front wall 118 (more specifically to the frame 120). Each side flange 123 also includes an interlocking portion that interlocks with a complementary interlocking portion on the rear wall 114 or the front wall 118.

Figure 27:
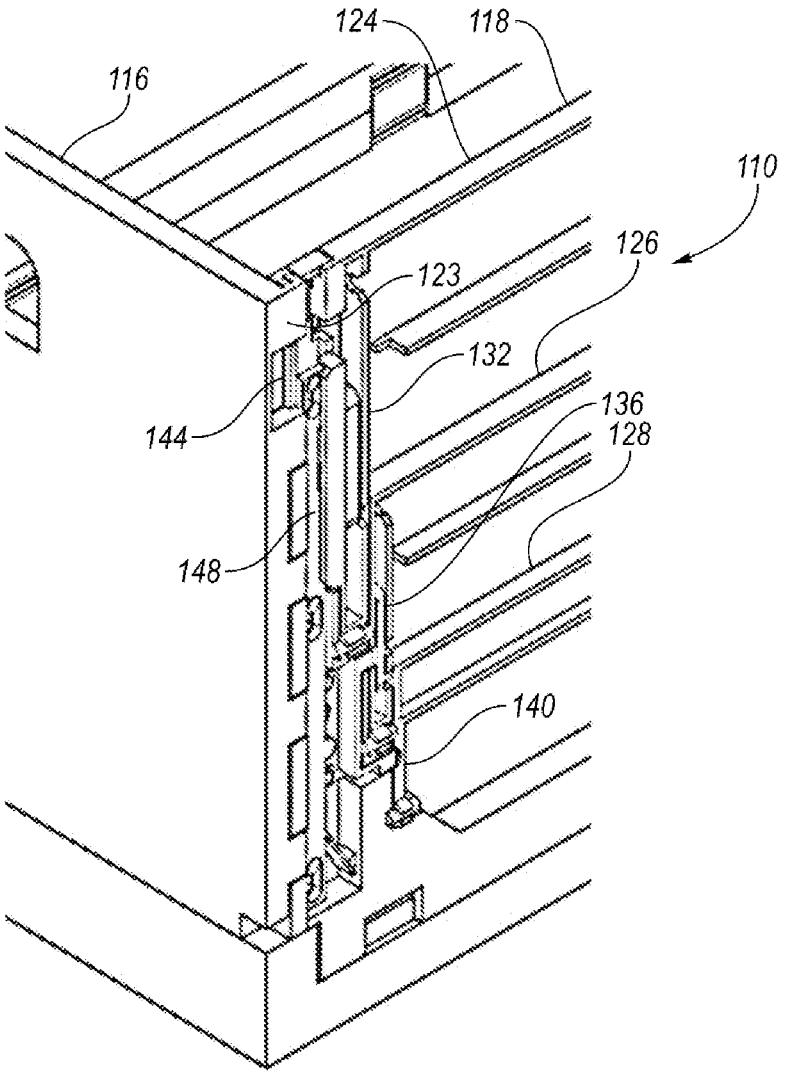
FIG. 27 is an enlarged perspective view of one front corner of the container of FIG. 26.
Figure 28:
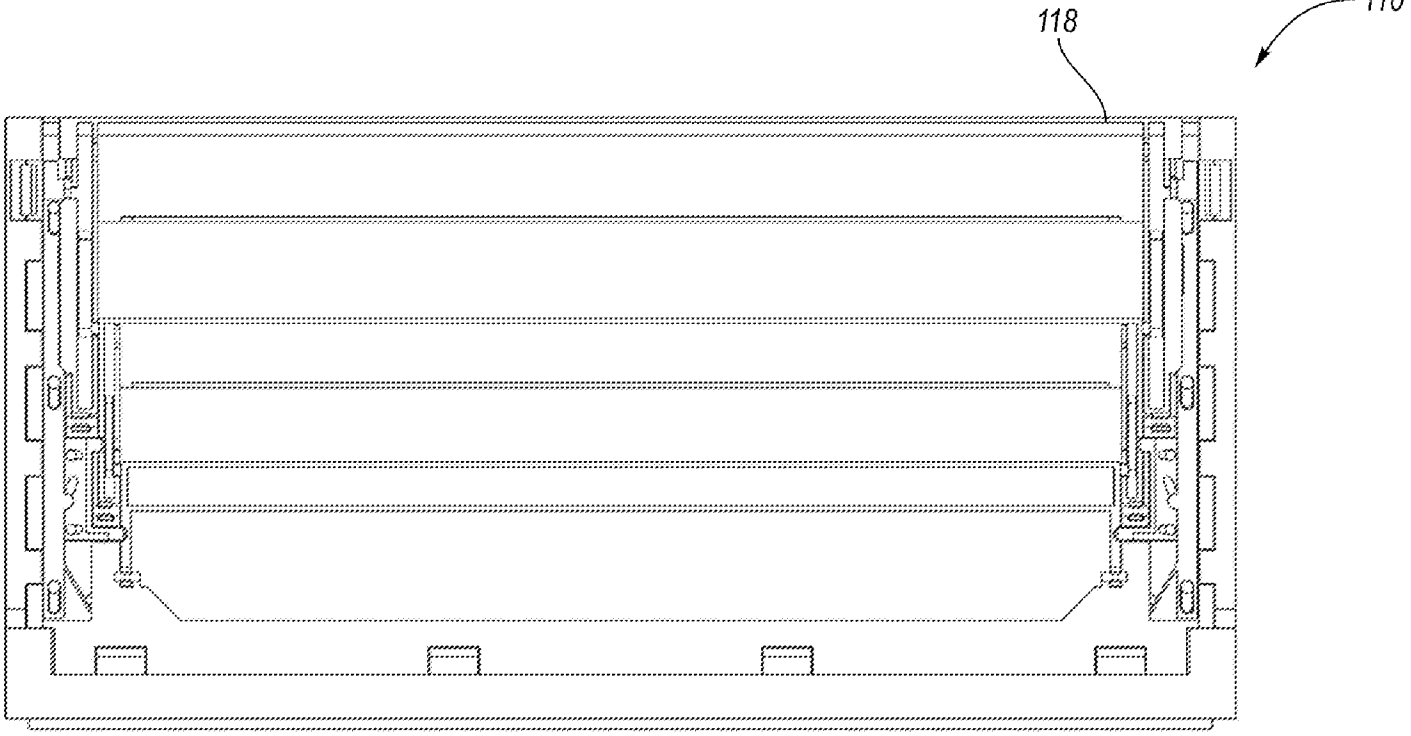
FIG. 28 is a front view of the container of FIG. 26.

FIG. 27 is an enlarged perspective view of one front corner of the container 110 of FIG. 26. FIG. 28 is a front view of the container 110.

Figure 29:
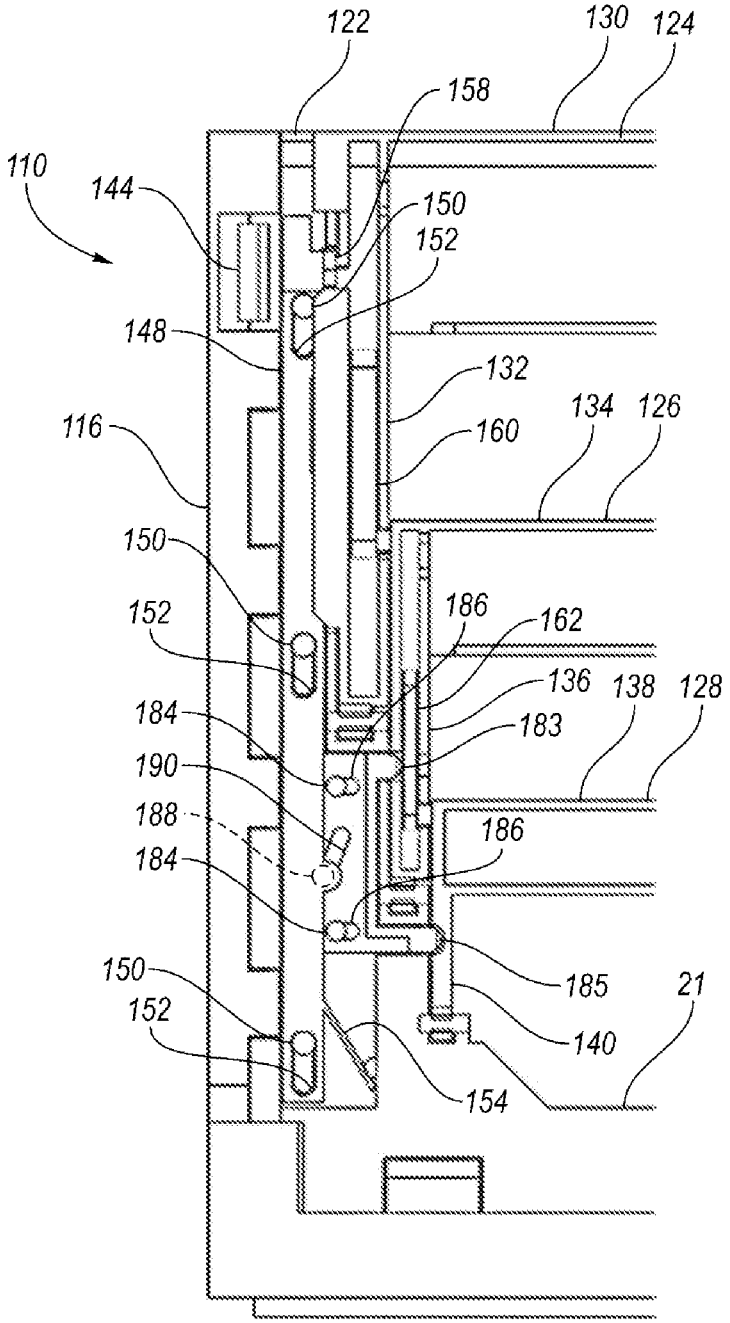
FIG. 29 is an enlarged view of one front corner of the container of FIG. 28.

FIG. 29 is an enlarged view of one front corner of the container 110 of FIG. 28. The other front corner would be mirror image. The latch 148 is shown in more detail. The latch 148 is an elongated vertical member slidably mounted for vertical translation within a vertical channel molded into the vertical portion 122 of the frame 120, and secured to a plurality (three, in this example) of pins 150 received in vertically elongated apertures 152 (or slots) in the latch 148. The pins 150 are integrally molded with the vertical portions 122 of the frame 120. A lower spring 154 is integrally molded with the latch 148 and biases the latch 148 downward relative to the frame 120. In FIG. 29, the latch 148 is shown in the downward, latched position. A locking projection 158 projects inward over a portion of the arm 132 of the upper portion 124 to retain the upper portion 124 in the closed position.

As can be seen in FIG. 29, the arms 132 of the upper portion 124 each have an elongated recess for receiving a link 160 pivotably securing the upper portion 124 to the mid portion 126. The arms 136 of the mid portion 126 each have an elongated recess for receiving a link 162 pivotably securing the mid portion 126 to the lower portion 128.

The vertical portions 122 of the frame 120 are moved inward slightly compared to the previous embodiment to accommodate the latches 144 in the end walls 116 and the fact that the front wall 118 is between the end walls 116 (in FIG. 1, the end walls 16 are between the rear wall 14 and front wall 18).

The upper portion 124 includes the horizontal wall portion 130 and an upper horizontal rib projecting outward from an upper edge thereof and a lower horizontal rib projecting outward from a lower edge thereof. The upper horizontal rib extends the full length of the upper portion 124. The lower horizontal rib does not extend all the way to the edges of the upper portion 124.

The mid portion 126 includes the horizontal wall portion 134 and an upper horizontal rib projecting outward from an upper edge thereof and a lower horizontal rib projecting outward from a lower edge thereof. The upper horizontal rib extends the full length of the mid portion 126. The lower horizontal rib does not extend all the way to the edges of the mid portion 126.

The lower portion 128 includes the horizontal wall portion 138 and an upper horizontal rib projecting outward from an upper edge thereof and a lower horizontal rib projecting outward from a lower edge thereof. The upper horizontal rib extends the full length of the lower portion 128. The lower horizontal rib extends all the way to the edges of the lower portion 128.

A secondary latch 182 is also slidably mounted to the frame 120. The secondary latch 182 is mounted to slide horizontally relative to the frame 120 (i.e. right and left in FIG. 29). In FIG. 29, the secondary latch 182 is shown in the latched position (to the right) where it retains the mid portion 126 and lower portion 128 in the closed position. The secondary latch 182 includes an upper locking member 183 positioned outward of the arm 136 of the mid portion 126. The secondary latch 182 also includes a lower locking member 185 positioned outward of the arm 140 of the lower portion 128.

The secondary latch 182 is slidably mounted to pins 184 that are integrally molded with the vertical portions 122 of the frame 120 and that are received in horizontally-elongated apertures 186 in the secondary latch 182. The secondary latch 182 is moved horizontally (left and right in FIG. 29) by a cam between the secondary latch 182 and the latch 148. The cam comprises a pin 188 integrally molded with the latch 148 and projecting rearward into an elongated aperture 190 in the secondary latch 182. The elongated aperture 190 extends at an angle upward and inward, such that when the user slides the latch 148 upward, the cam causes the secondary latch 182 to move outward (left in FIG. 29).

Figure 30:
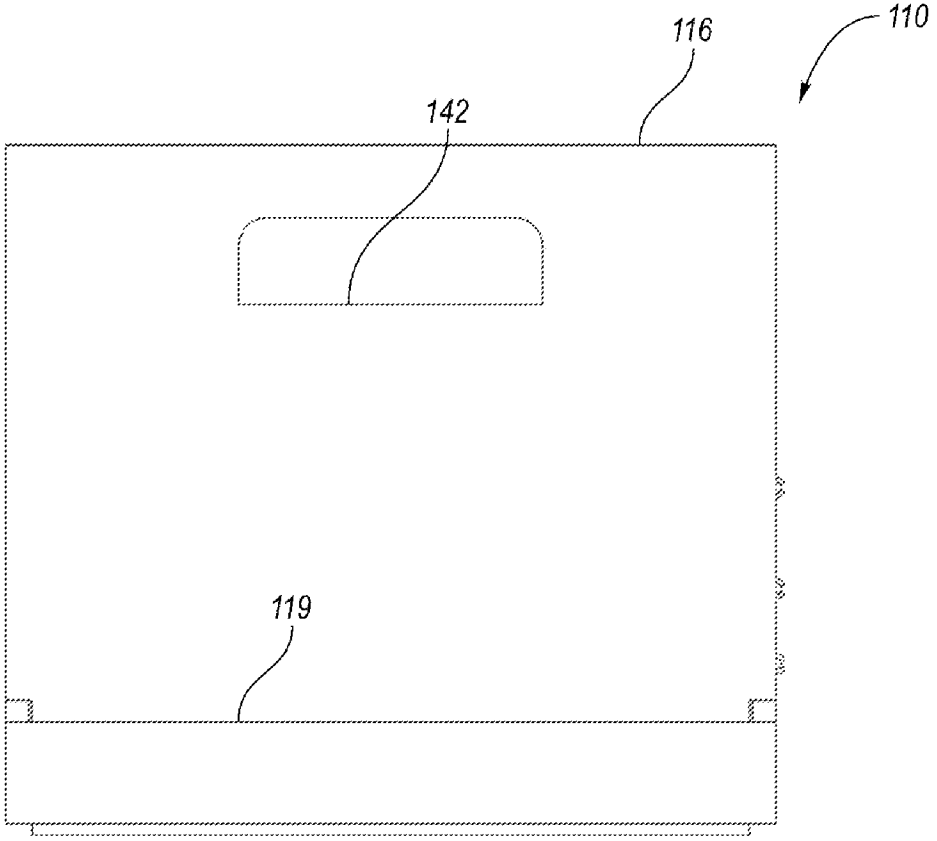
FIG. 30 is an end view of the container of FIG. 26.

FIG. 30 is an end view of the container 110. Each end wall 116 includes the handle opening 142 near an upper edge thereof. Each end wall 116 is pivotably connected to the upstanding flanges 119.

Figure 31:
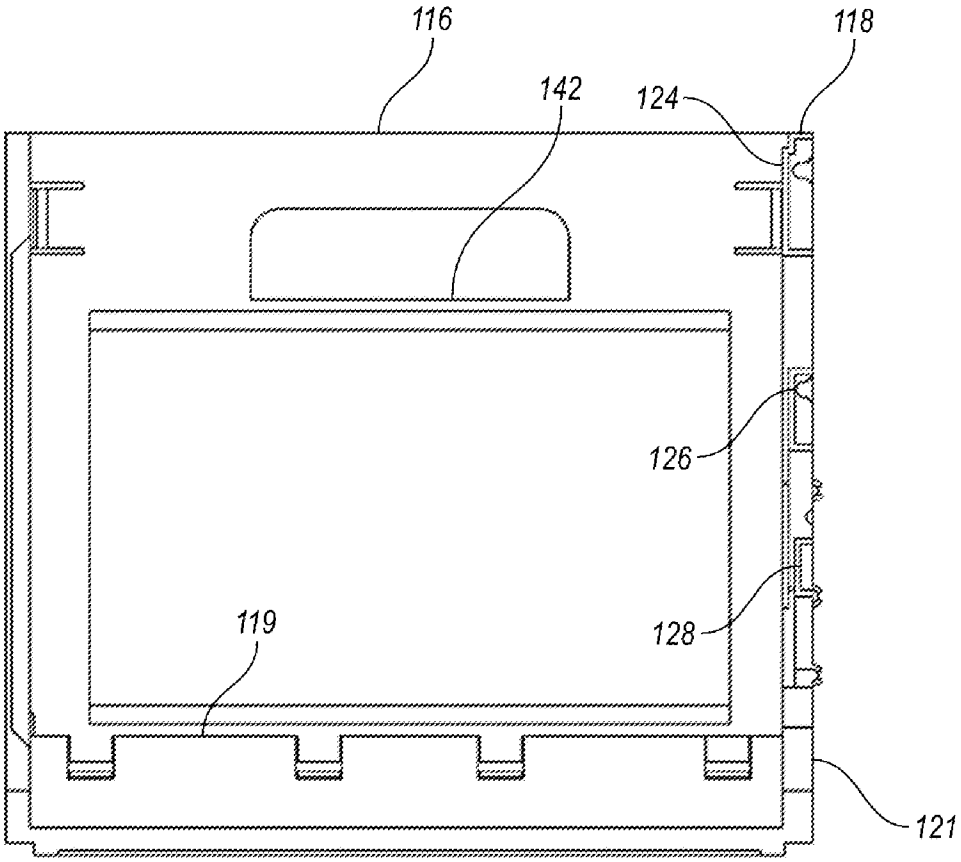
FIG. 31 is a section view of the container of FIG. 26.

FIG. 31 is a section view of the container 110. The upper portion 124 includes the horizontal wall portion 130 and the upper horizontal rib projecting outward from an upper edge thereof and the lower horizontal rib projecting outward from a lower edge thereof. The mid portion 126 includes the horizontal wall portion 134 and the upper horizontal rib projecting outward from the upper edge thereof and the lower horizontal rib projecting outward from the lower edge thereof. The lower portion 128 includes the horizontal wall portion 138 and the upper horizontal rib projecting outward from the upper edge thereof and the lower horizontal rib projecting outward from the lower edge thereof. As can be seen, the horizontal wall portion 130 of the upper portion 124 is taller than the horizontal wall portion 134 of the mid portion 126, which is taller than the horizontal wall portion 138 of the lower portion 128.

Figure 32:
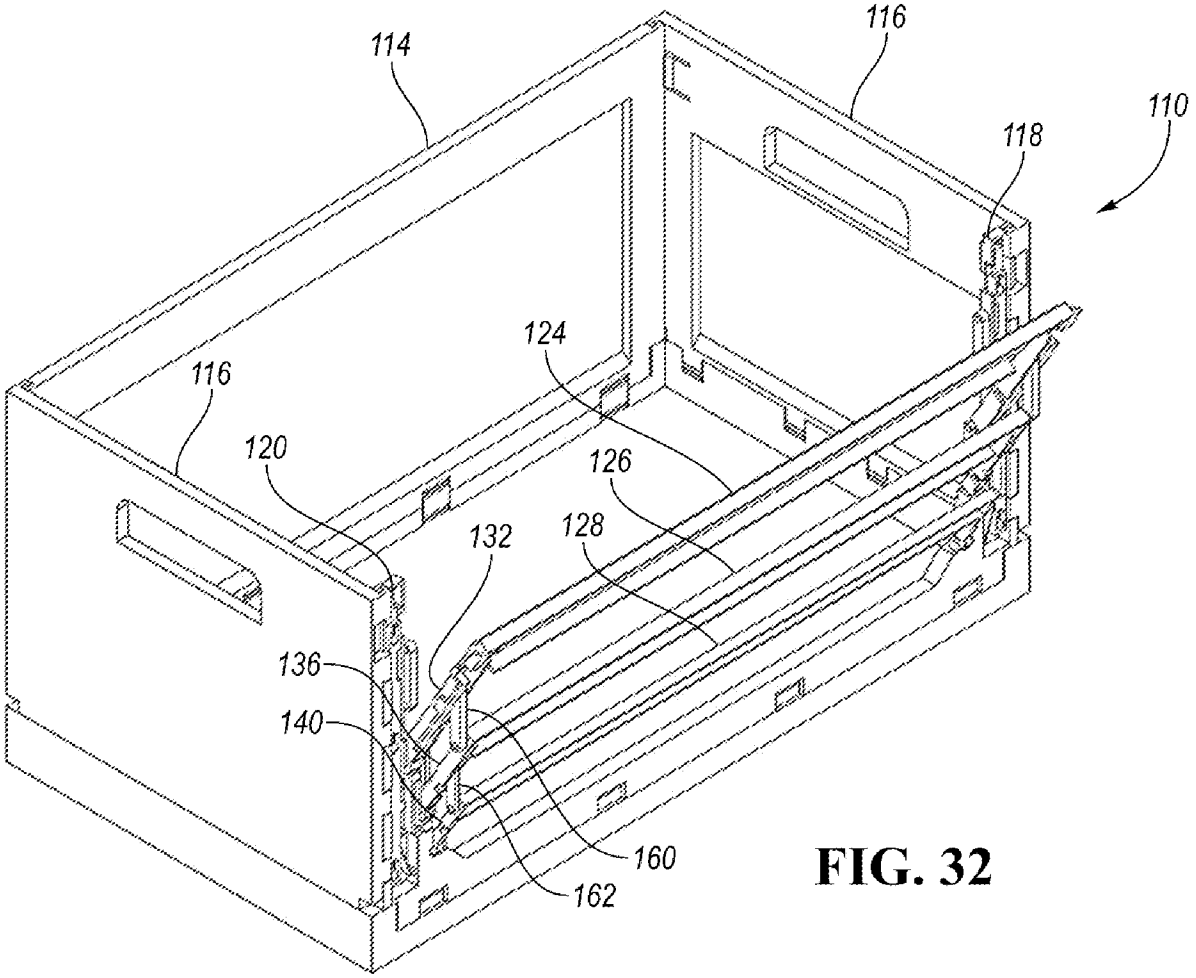
FIG. 32 is a perspective view of the container of FIG. 26 with the front wall beginning to be moved toward a retracted position.
Figure 33:
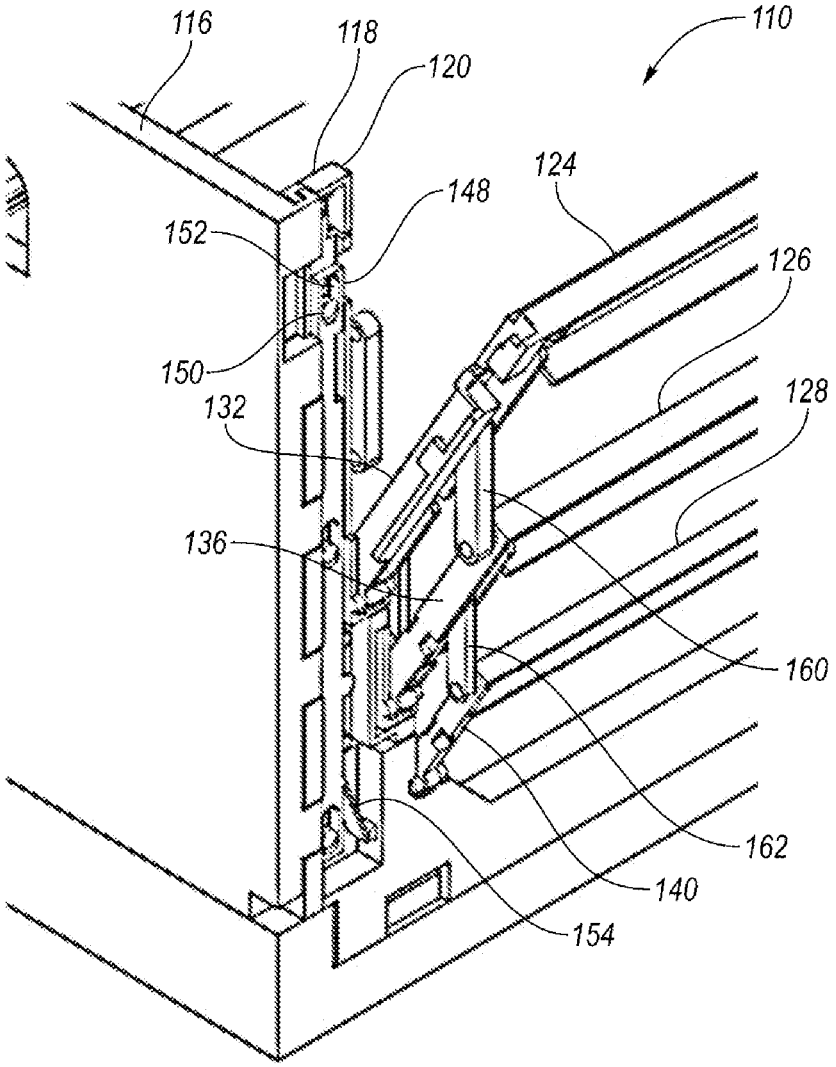
FIG. 33 is an enlarged view of one corner of FIG. 32.

In FIG. 32, the latches 148 have been slid upward relative to the frame 120, also causing the secondary latches 182 to slide outward (away from each other). This permits the upper portion 124, mid portion 126, and lower portion 128 to pivot outward of the frame 120. The links 160, 162 also pivot outward so that the upper portion 124, mid portion 126 and lower portion 128 all pivot and move together. The user can lift and lower all three portions 124, 126, 128 by moving any one of them. FIG. 33 is an enlarged view of one corner of FIG. 32. The links 160, 162 pivot outward of the recesses in the arms 132, 136.

Figure 34:
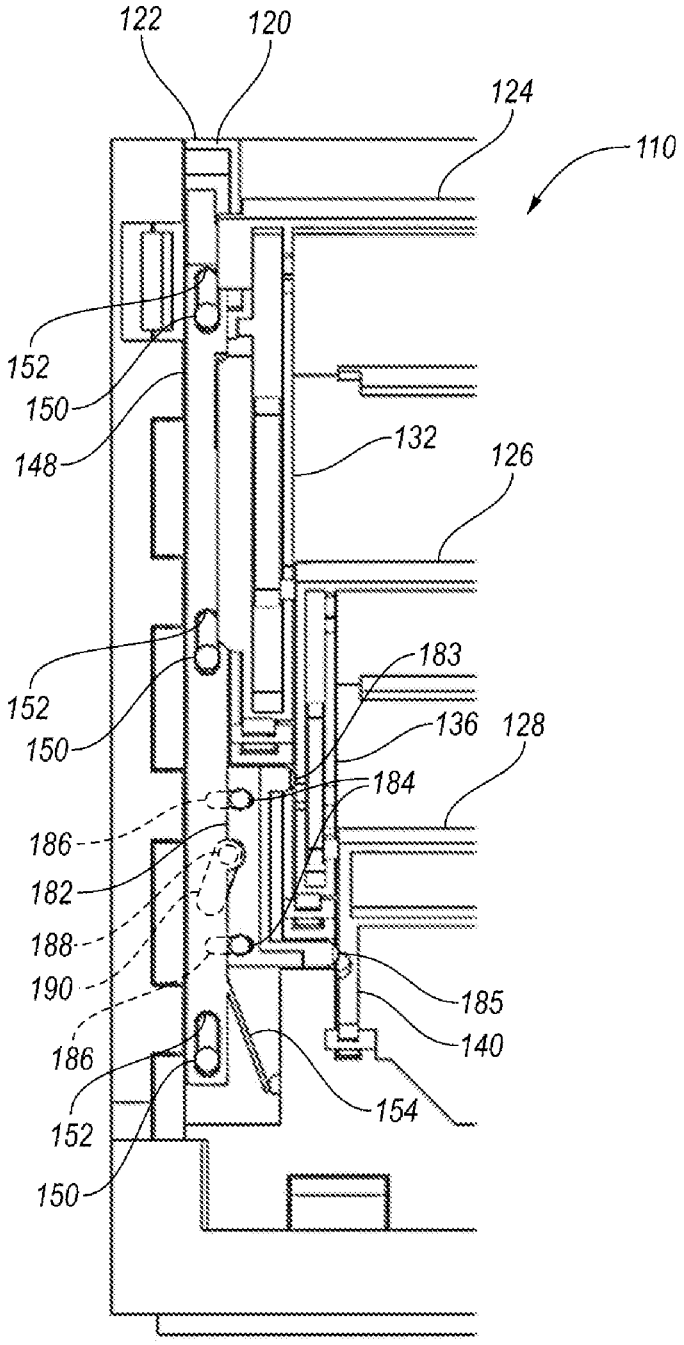
FIG. 34 is an enlarged view of one end of the front wall of the container of FIG. 32.
Figure 35:
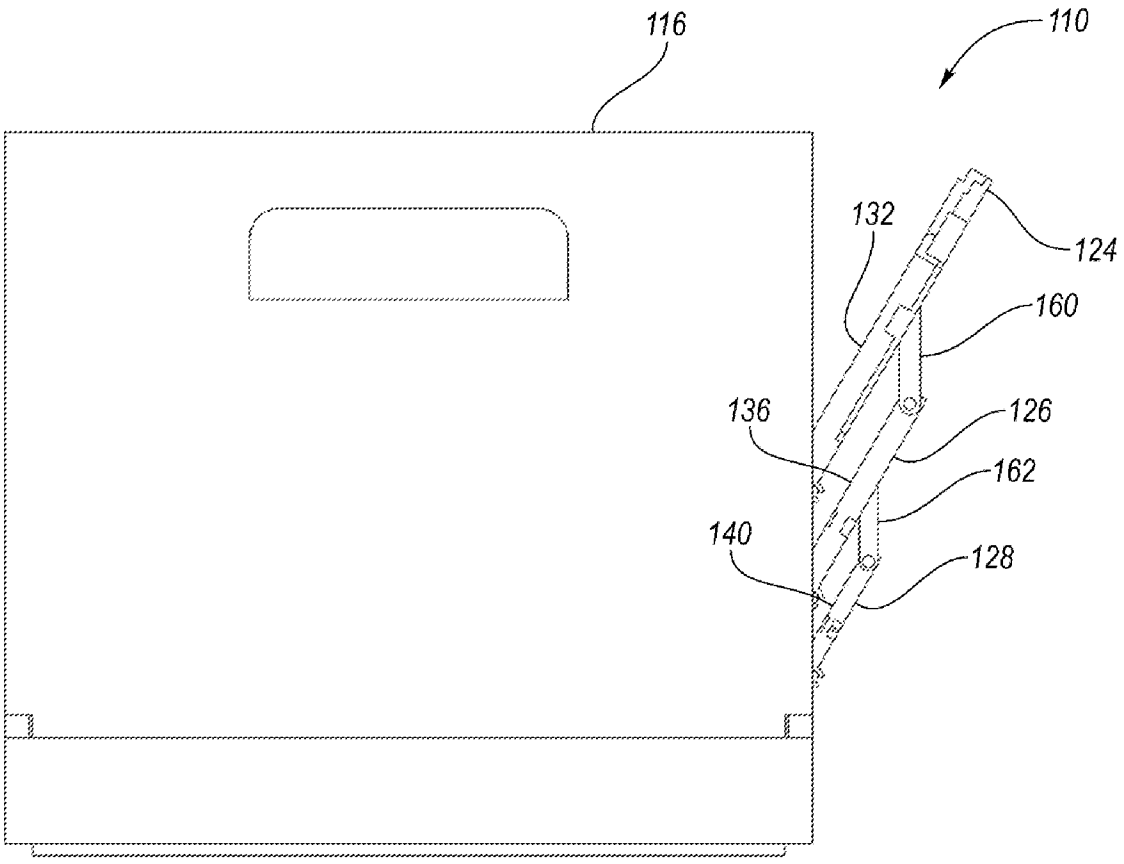
FIG. 35 is an end view of the container with the front wall beginning to be retracted.

FIG. 34 is an enlarged view of one end of the front wall 118 of the container 110 of FIG. 32. The other end would be mirror image. The latch 148 has been slid upward relative to the frame 120 to an unlatched position, also causing the secondary latch 182 to slide outward (to the left in FIG. 34) to an unlatched position. As shown, the locking projection 158 releases the arm 132 of the upper portion 124. The pin 188 slides to the top of the angled aperture 190 in the secondary latch 182, causing the secondary latch 182 to move outward (to the left in FIG. 34). This moves the upper locking member 183 out from in front of the arm 136 and moves the lower locking member 185 out from in front of the arm 140. As shown, the upper portion 124, mid portion 126, and lower portion 128 can start to pivot outward of the frame 120. The lower spring 154 is elastically deformed, and biases the latch 148 downward back toward the latched position. FIG. 35 is an end view of the container 110 with the front wall 118 beginning to be retracted.

Figure 36:
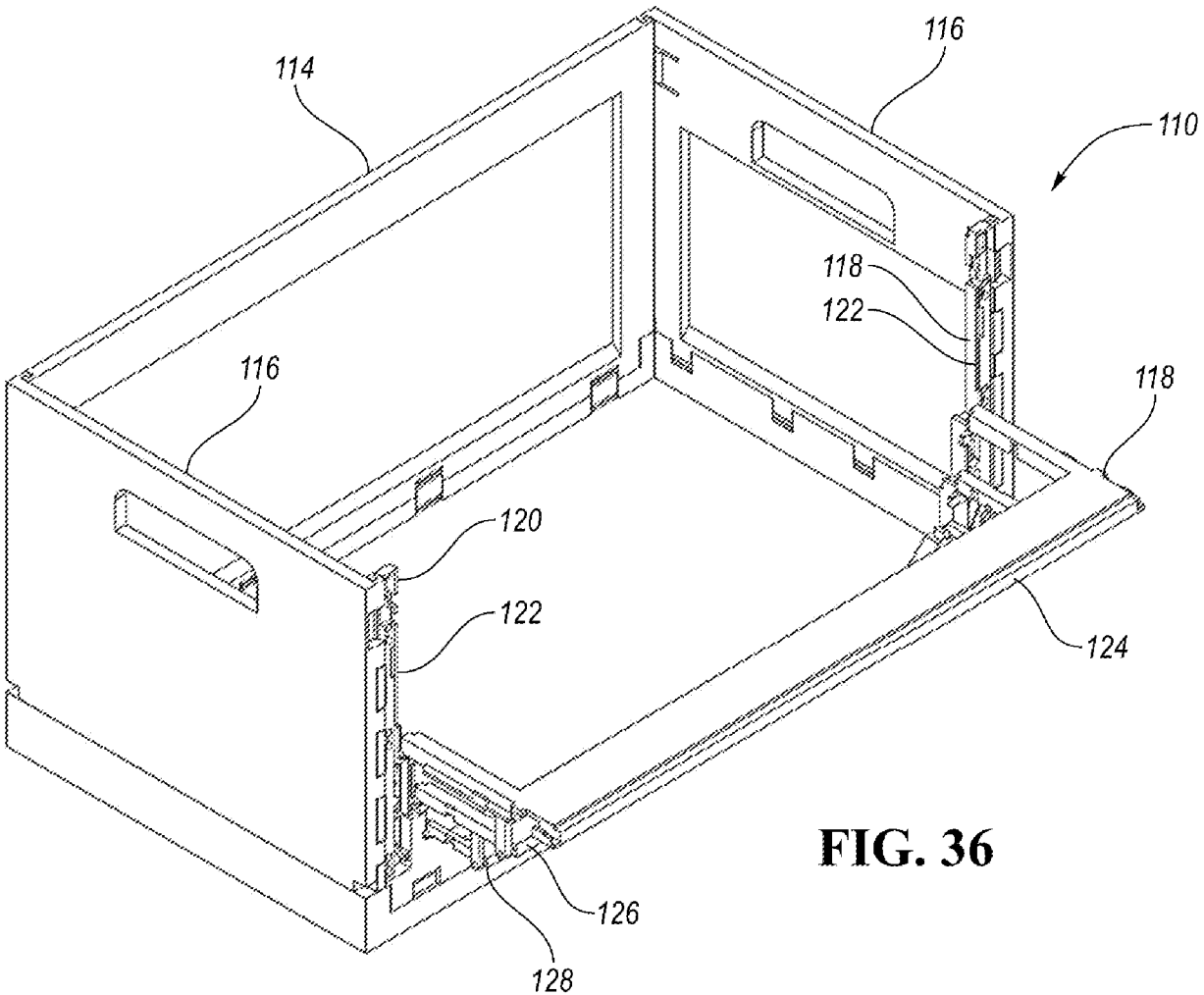
FIGS. 36, 37 and 38 show a second stage of the front wall being retracted.
Figure 37:
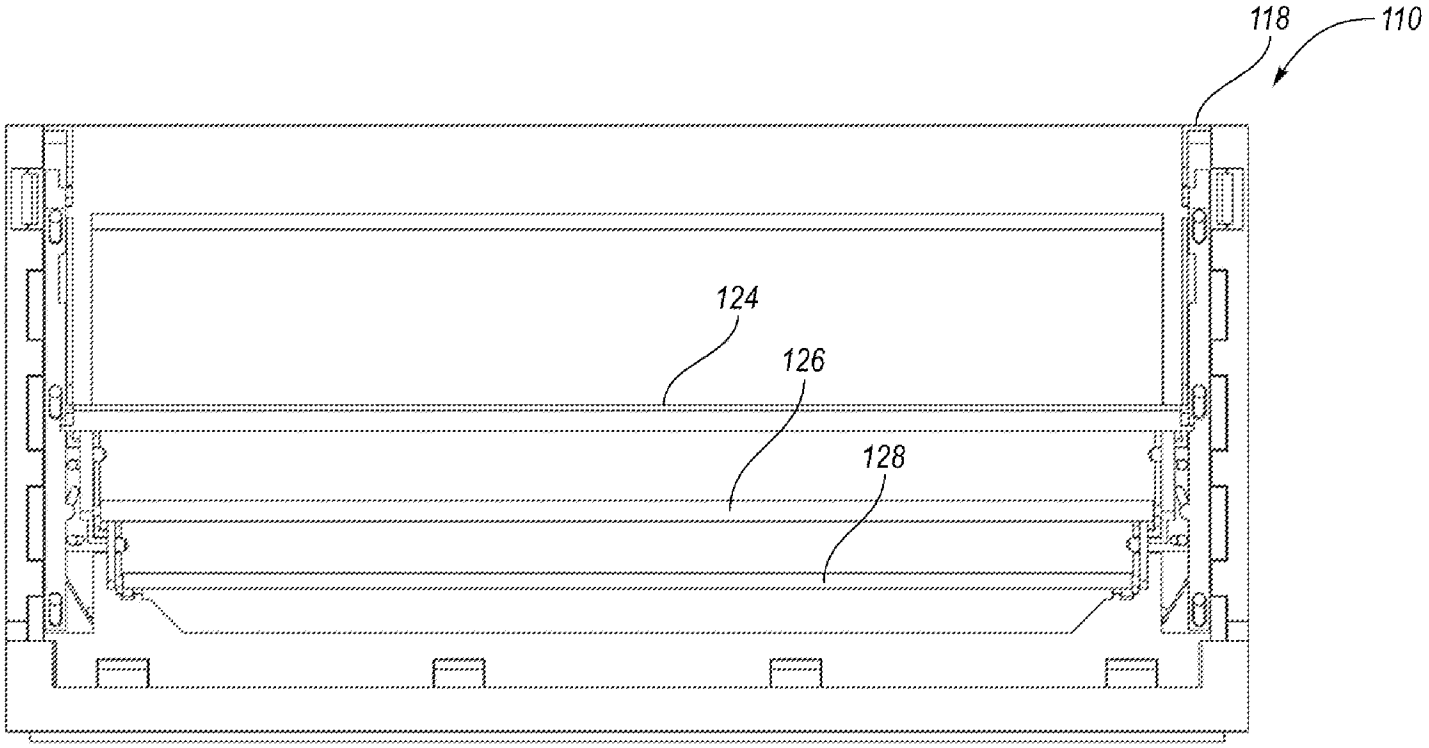
Figure 38:
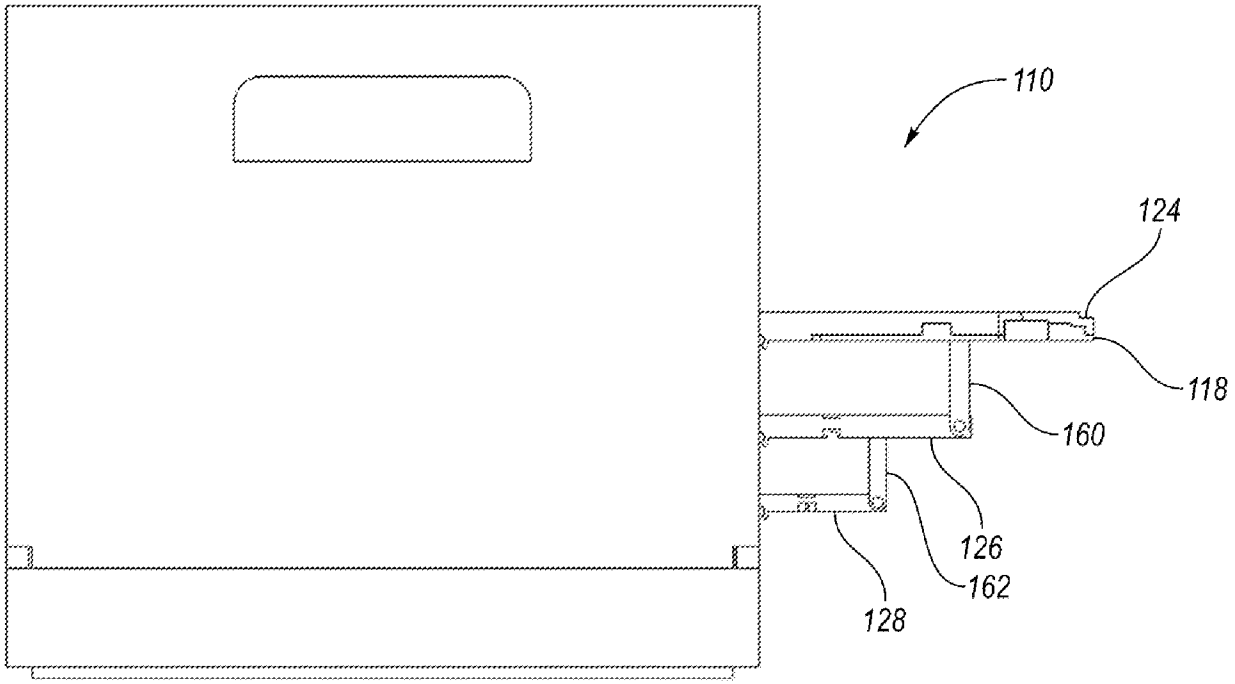
Figure 39:
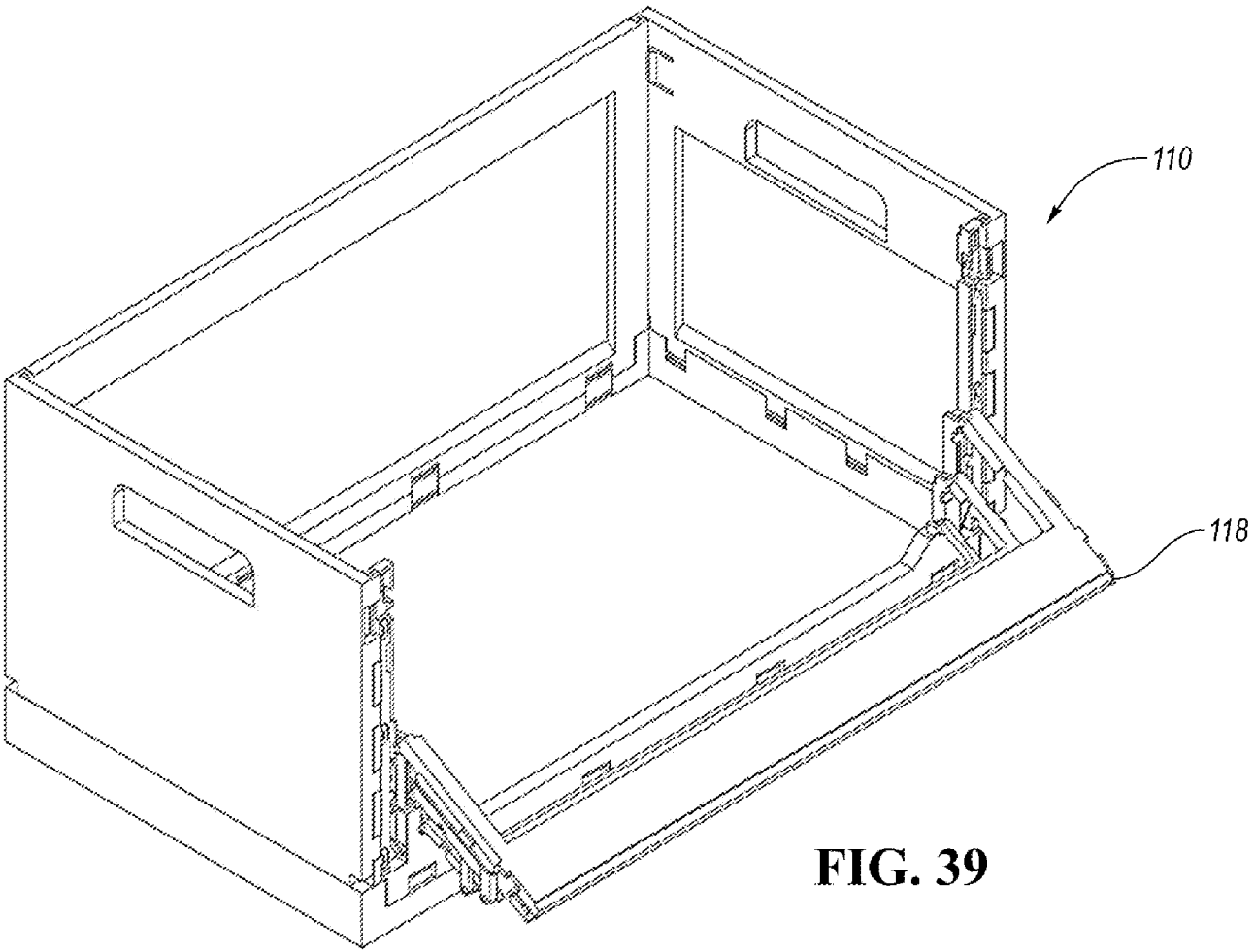
FIGS. 39 and 40 show the front wall of the container of FIG. 35 pivoted further toward the retracted position.
Figure 40:
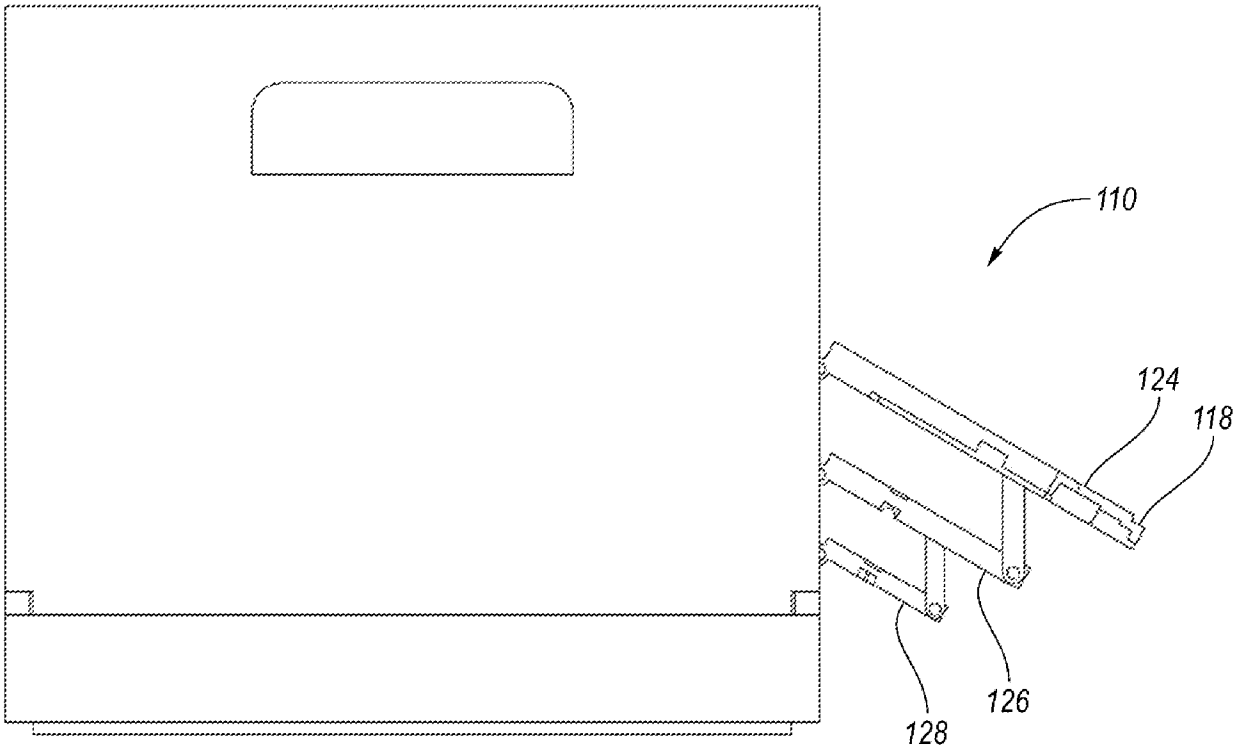

FIGS. 36, 37 and 38 show a second stage of the front wall 118 being retracted. FIGS. 39 and 40 show the upper portion 124, mid portion 126, and lower portion 128 pivoted further toward the retracted position.

Figure 41:
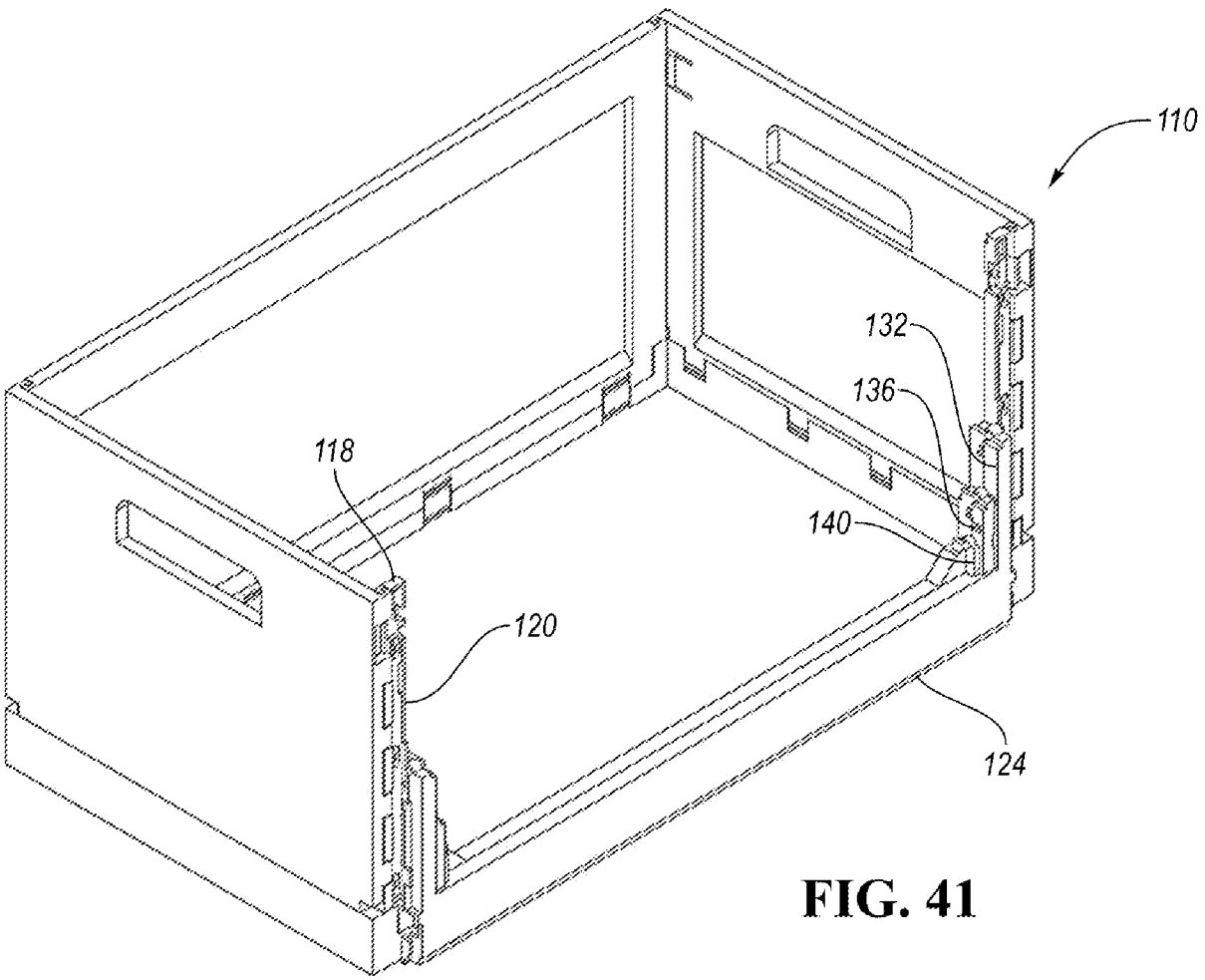
FIG. 41 shows the container of FIG. 26 with the front wall in the retracted position.

FIG. 41 shows the container 110 with the front wall 118 in the retracted position. The upper portion 124, mid portion 126 and lower portion 128 are nested (as before) adjacent the horizontal portion 121 of the frame 120. The arms 136 of the mid portion 126 are inward of the arms 132 of the upper portion 124. The arms 140 of the lower portion 128 are inward of the mid portion 126.

Figure 42:
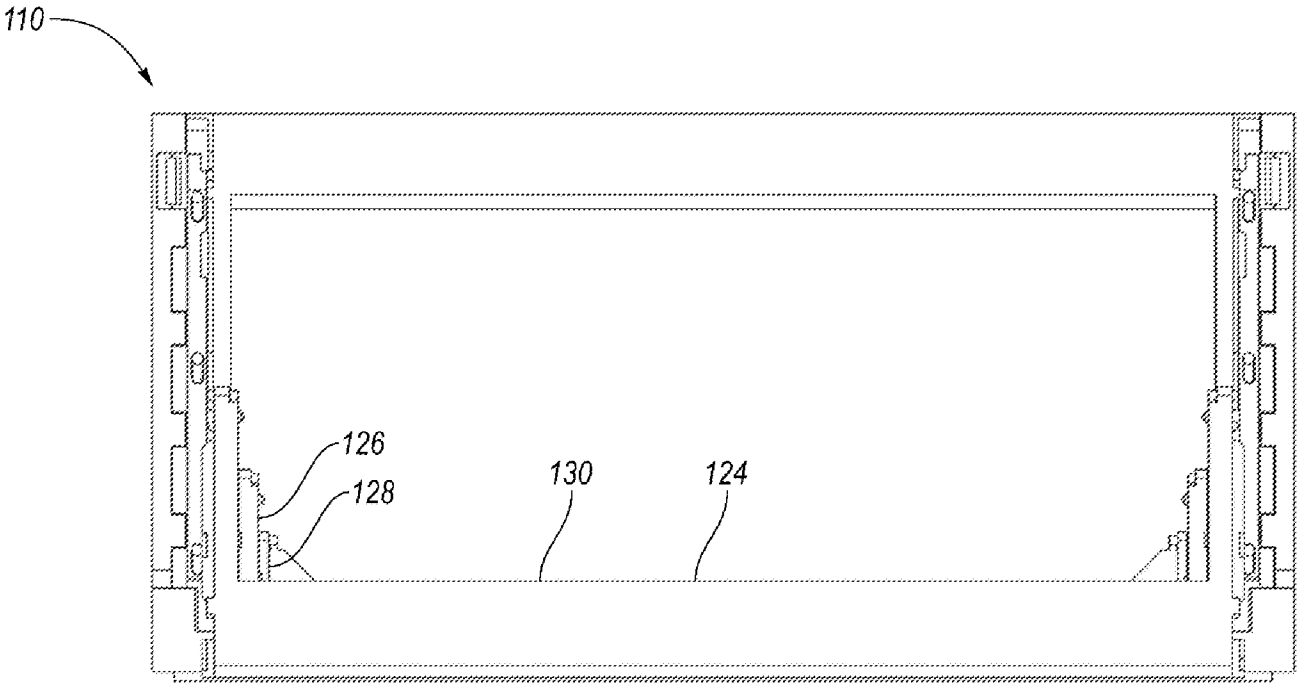
FIG. 42 is a front view of the container of FIG. 41.
Figure 43:
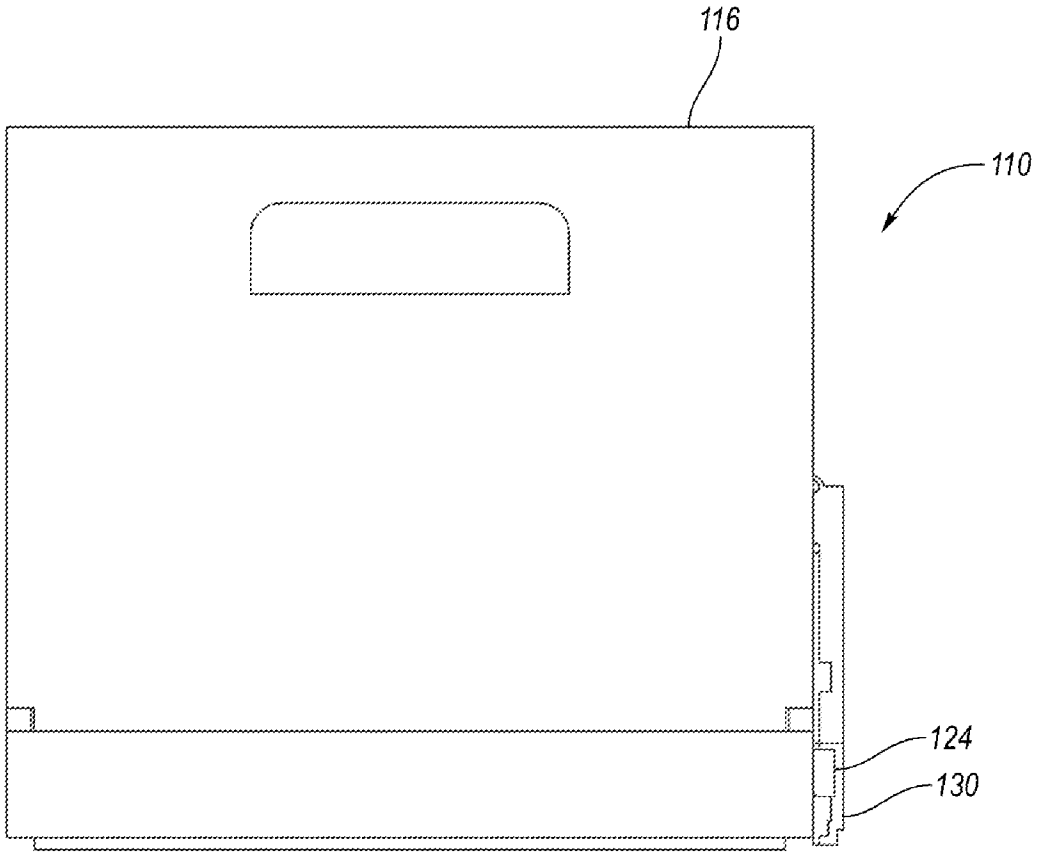
FIG. 43 is an end view of the container of FIG. 41.

As shown in FIGS. 42 and 43, horizontal wall portion 134 of the mid portion 126 is nested within the horizontal wall portion 130 of the upper portion 124. The horizontal wall portion 138 of the lower portion 128 is nested within the horizontal wall portion 134 of the mid portion 126. In this manner, the upper portion 124, mid portion 126 and lower portion 128 can lie flat against the frame 120.

Figure 44:
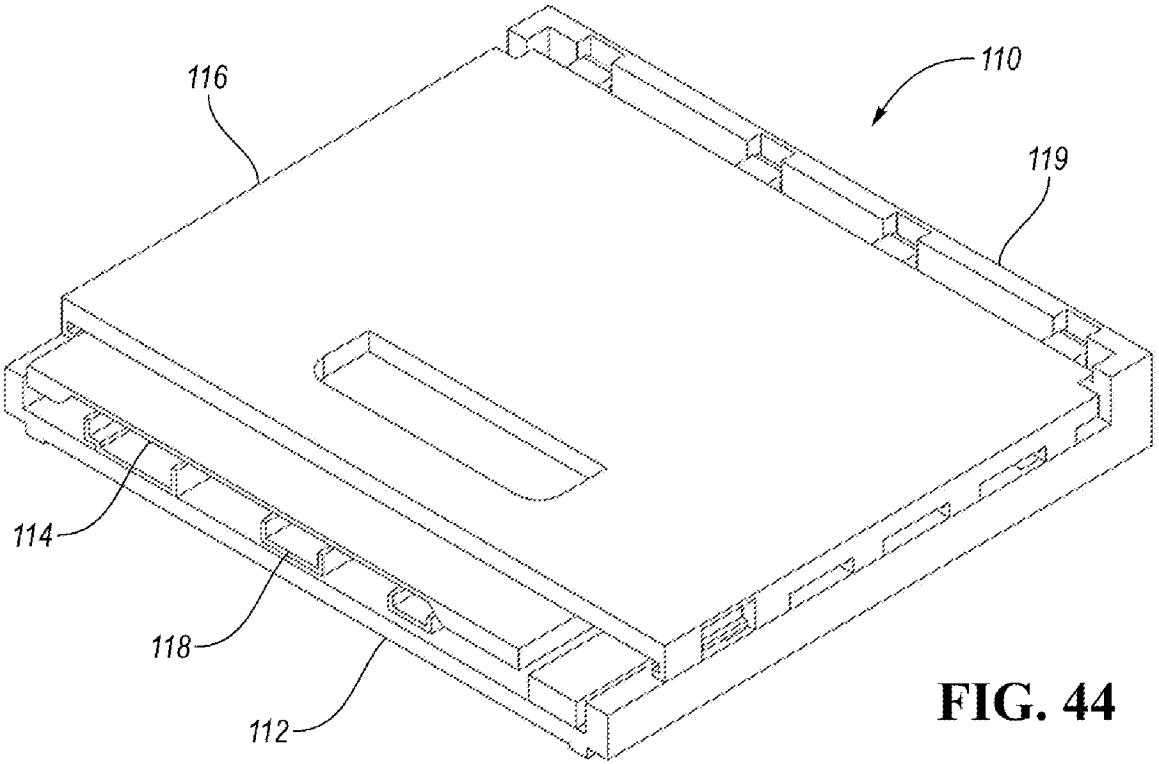
FIG. 44 shows half of the container of FIG. 26 (the other half is broken away for visibility) in the collapsed position.
Figure 45:
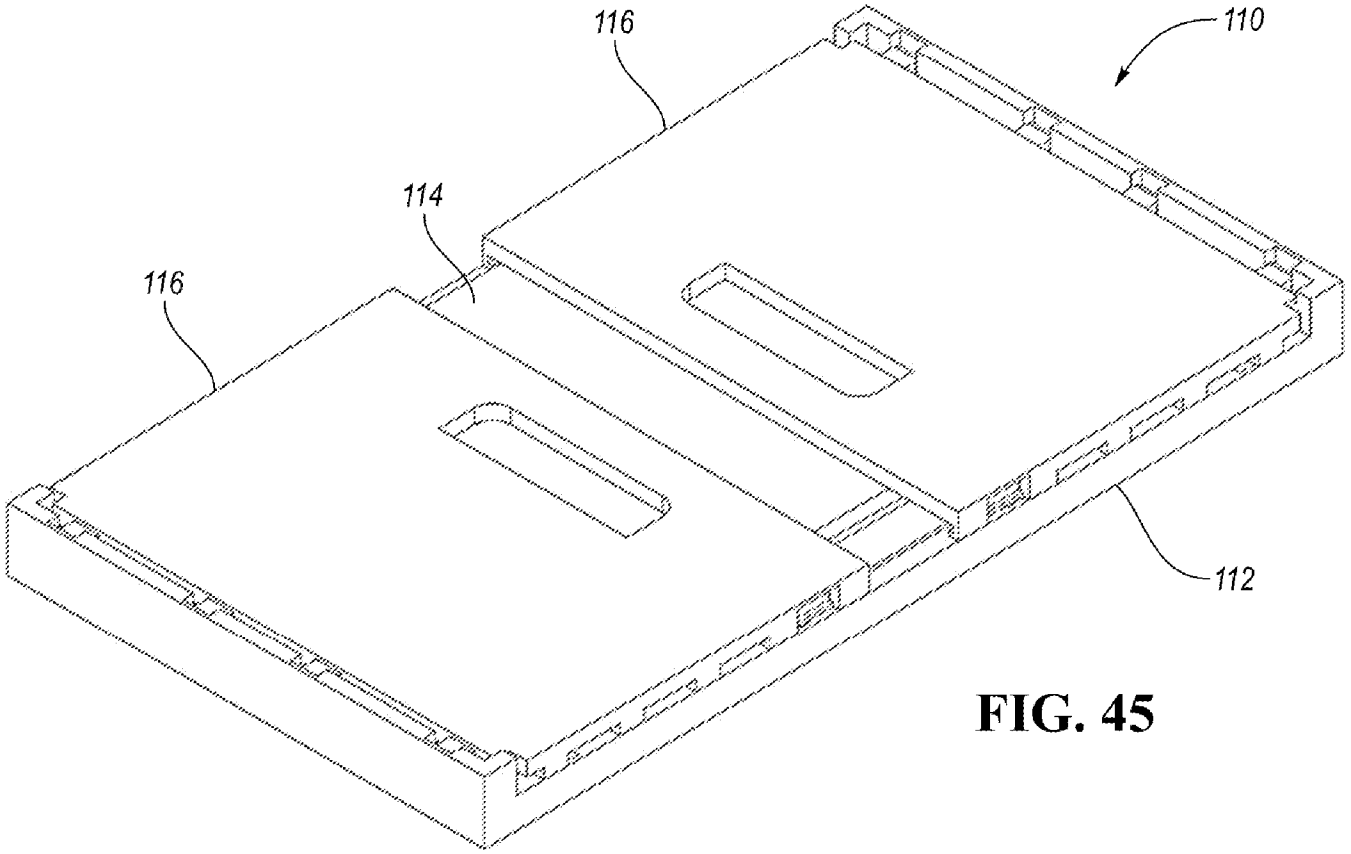
FIG. 45 shows the entire container of FIG. 26 in the collapsed position.
Figure 46:
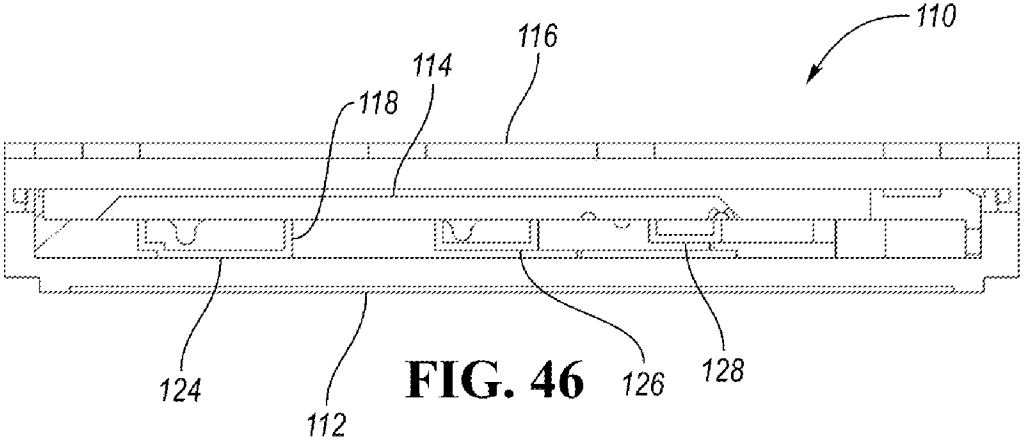
FIG. 46 is a section view through the collapsed container of FIG. 45.
Figure 47:
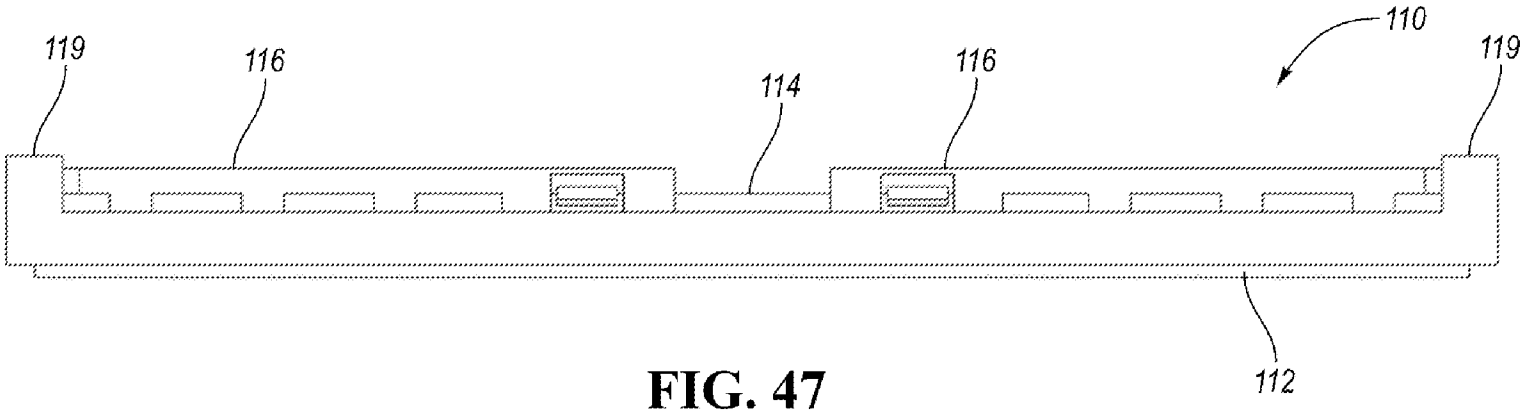
FIG. 47 is a front view of the collapsed container of FIG. 45.

FIG. 44 shows half of the container 110 (the other half is broken away for visibility) in the collapsed position. The rear wall 114 and front wall 118 are collapsed onto the base 112 (in either order) after releasing the latches 144. The end walls 116 are collapsed onto the rear wall 114 and front wall 118. FIG. 45 shows the entire container 110 in the collapsed position. FIG. 46 is a section view through the collapsed container 110. FIG. 47 is a front view of the collapsed container 110. Note that the end walls 116 collapse to a height lower than the upstanding flanges 119, so the collapsed container 110 has a significantly reduced volume for very efficient storage and transport when empty.

Figure 48:
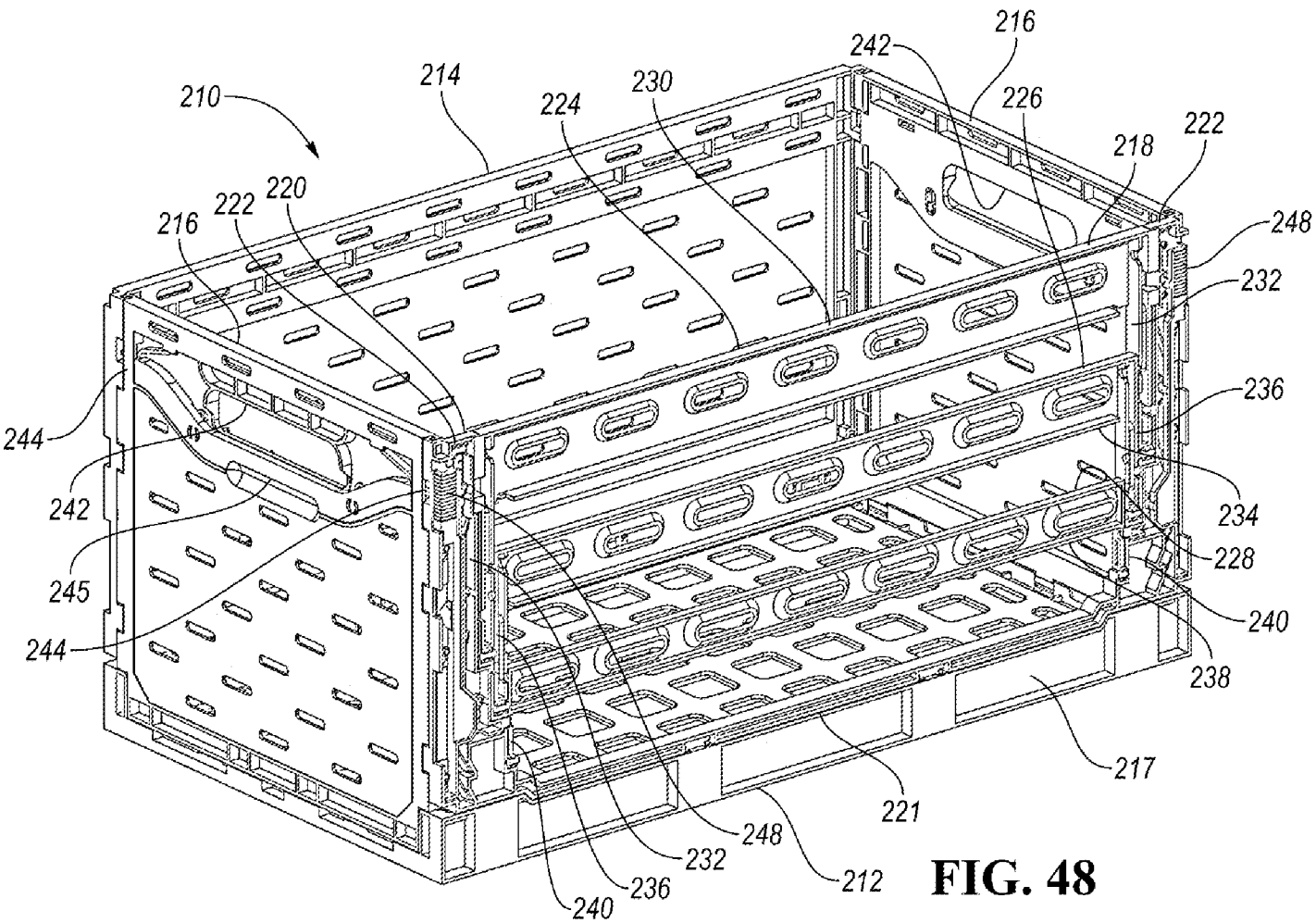
FIG. 48 is a perspective view of a third example collapsible container.

A collapsible container 210 according to a third embodiment is shown in FIG. 48. In FIG. 48, the container 210 is in an upright, assembled position. The container 210 includes a base 212. A rear wall 214, end walls 216 and a front wall 218 are pivotably connected at a periphery of the base 212. The base 212 includes upstanding flanges 217 projecting upward from rear and front edges of the base 212 and formed integrally with the rest of the base 212. In this embodiment, once again the end walls 216 are configured to fold onto the base 212 prior to the rear wall 214 and front wall 218. Thus the end walls 216 are pivotably connected to the base 212 lower than are the rear wall 214 and front wall 218, and the end walls 216 are between the rear wall 214 and front wall 218.

The front wall 218 includes a frame 220 pivotably connected to the flange 217 at the front of the base 212. The frame 220 includes a lower horizontal portion 221 and a pair of upright vertical portions 222, together forming a U shape. The front wall 218 further includes an upper (or "first") portion 224, a mid (or "second") portion 226 and a lower (or "third") portion 228 within the frame 220. In FIG. 48, the front wall 218 is in the closed position with the upper portion 224, mid portion 226 and lower portion 228 substantially closing the large opening in the frame 220.

The upper portion 224 includes a horizontal wall portion 230 and a pair of arms 232 extending from ends of the horizontal wall portion 230 in a direction generally in the plane of the horizontal wall portion 230 to form generally a U-shape (opening downward in FIG. 48). In FIG. 48, the upper portion 224 is selectively secured to the frame 220 in an upper, closed position by latches 248. The arms 232 of the upper portion 224 are pivotably connected to the vertical portions 222 of the frame 220.

The mid portion 226 includes a horizontal wall portion 234 and a pair of arms 236 extending from ends of the horizontal wall portion 234 in a direction generally in the plane of the horizontal wall portion 234 to form generally a U-shape (opening downward in FIG. 48). The mid portion 226 is partially received between the arms 232 of the upper portion 224. In this example, the horizontal wall portion 234 and upper portions of the arms 236 are received between lower portions of the arms 232 of the upper portion 224.

The lower portion 228 includes a horizontal wall portion 238 and a pair of arms 240 extending from ends of the horizontal wall portion 238 in a direction generally in the plane of the horizontal wall portion 238 to form generally a U-shape (opening downward in FIG. 48). The lower portion 228 is partially received between the arms 236 of the mid portion 226. In this example, the horizontal wall portion 238 and upper portions of the arms 240 are received between lower portions of the arms 236 of the mid portion 226.

In FIG. 48, the walls 214, 216, 218 are in their upright, use position. The front wall 218 is in its deployed, closed position, with the horizontal wall portions 230, 234, 238 of the upper, mid and lower portions 224, 226, 228 extending across an upper portion, a mid-portion, and a lower portion respectively, of a large opening defined by the frame 220. In the deployed, closed position, the front wall 218 keeps objects, such as egg cartons, in the container 210.

The end walls 216 are pivotably connected to end edges of the base 212. Each end wall includes a handle opening 242 near an upper edge thereof. Each end wall 216 includes a pair of latches 244 mounted therein for selectively securing the end wall 216 to the rear wall 214 and to the front wall 218 (more specifically to the frame 220). The latches 244 can be released by lifting a bar 245 below the handle opening 242 that is spring-biased downward.

Figure 49:
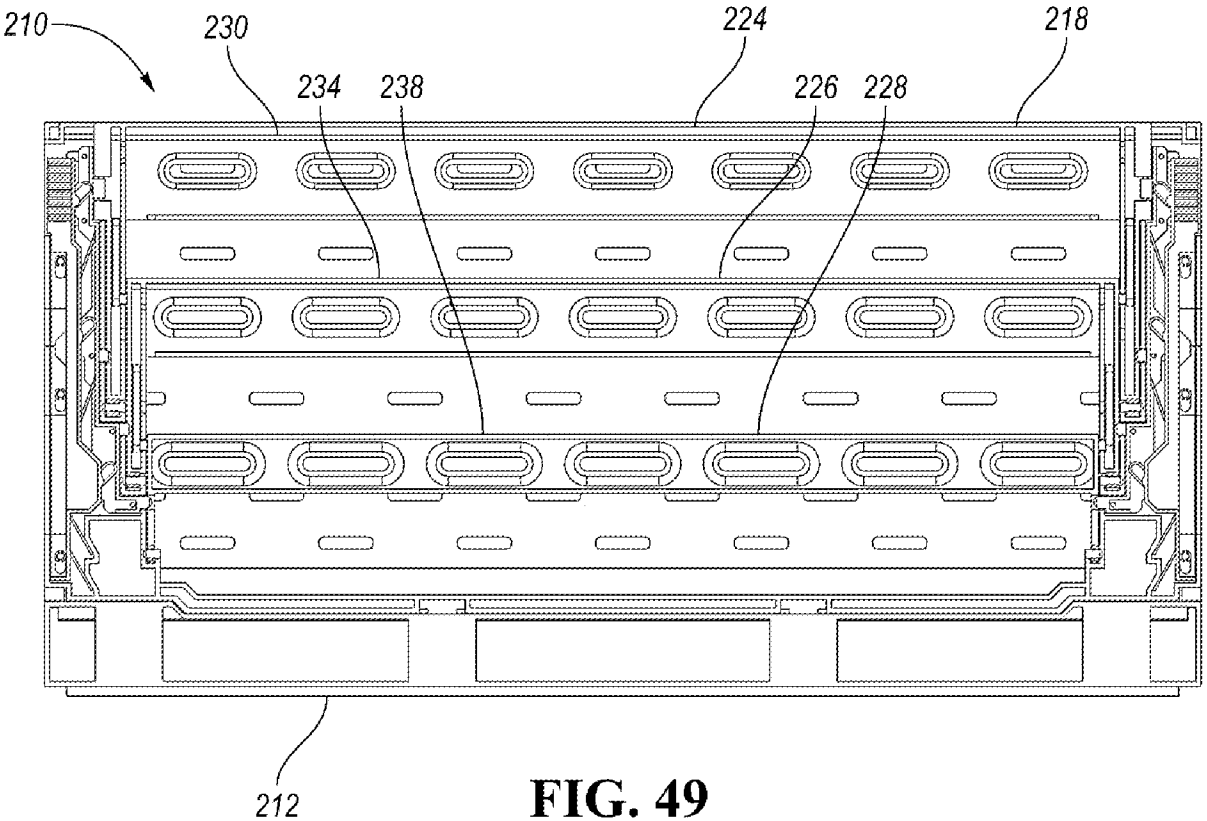
FIG. 49 is a front view of the container of FIG. 48.

FIG. 49 is a front view of the container 210 of FIG. 48. The front wall 218 is in its deployed, closed position, with the horizontal wall portions 230, 234, 238 of the upper, mid and lower portions 224, 226, 228 extending across an upper portion, a mid-portion, and a lower portion respectively, of a large opening defined by the frame 220. In the deployed, closed position, the front wall 218 keeps objects, such as egg cartons, in the container 210.

Figure 50:
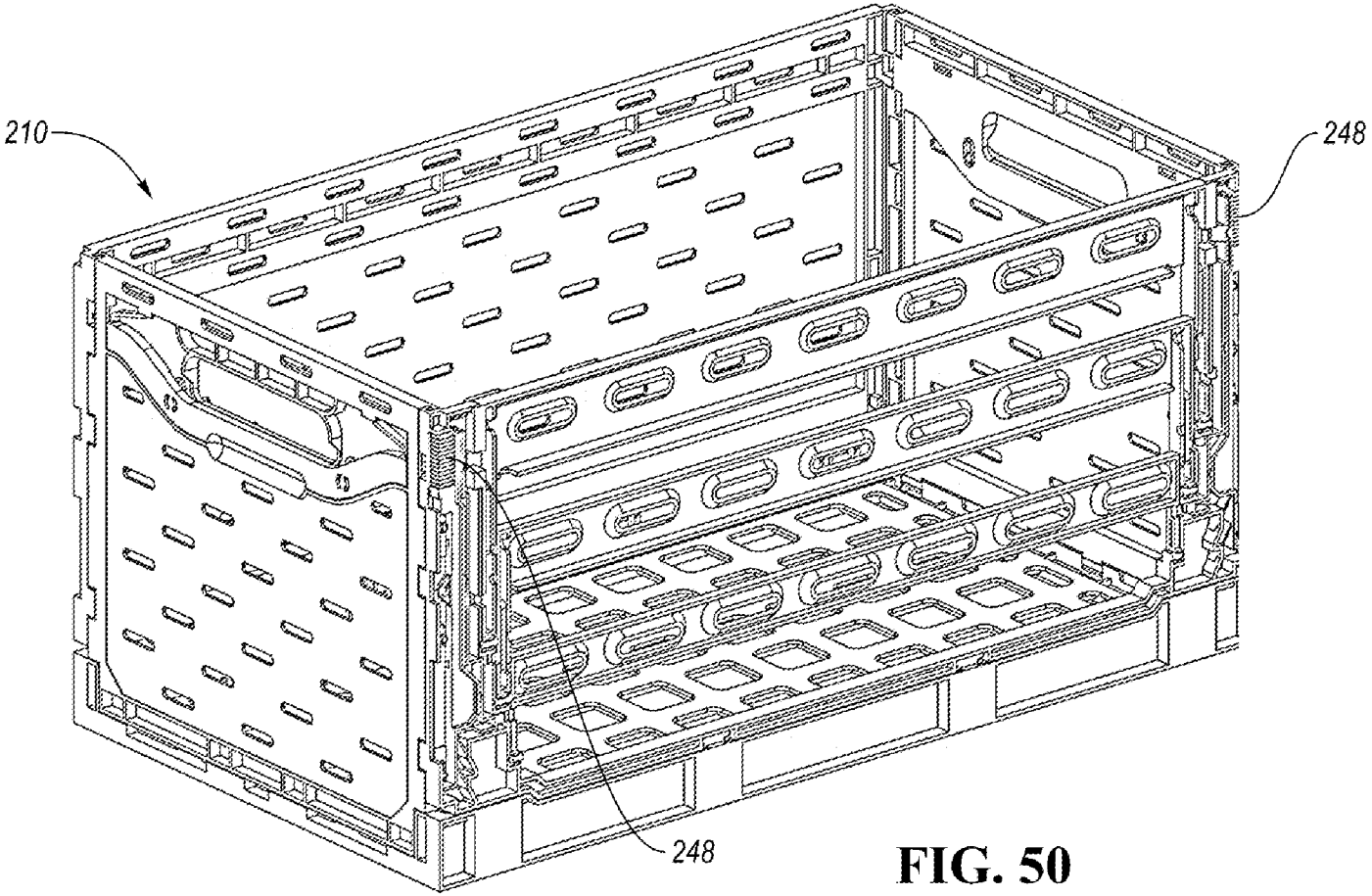
FIG. 50 shows the container of FIG. 48 with the latch lifted vertically to the release position.
Figure 51:
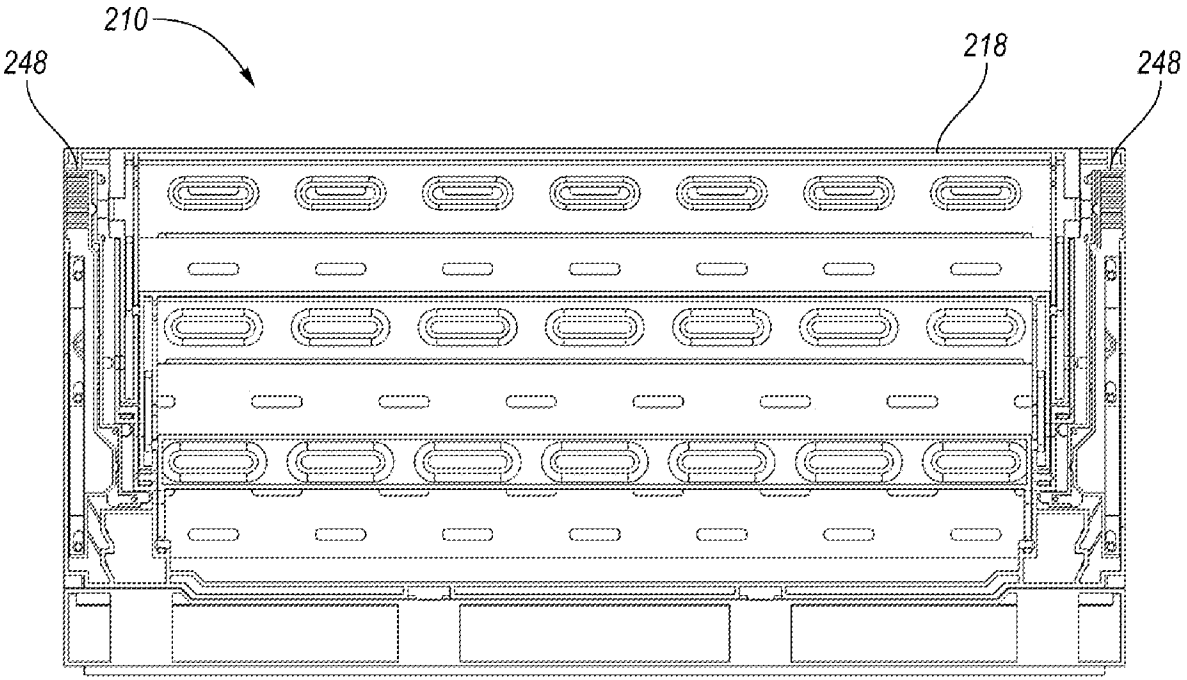
FIG. 51 is a front view of the container of FIG. 50.

FIG. 50 shows the container 210 of FIG. 48 with the latch 248 lifted vertically to the release position. FIG. 51 is a front view of the container 210 of FIG. 50.

Figure 52:
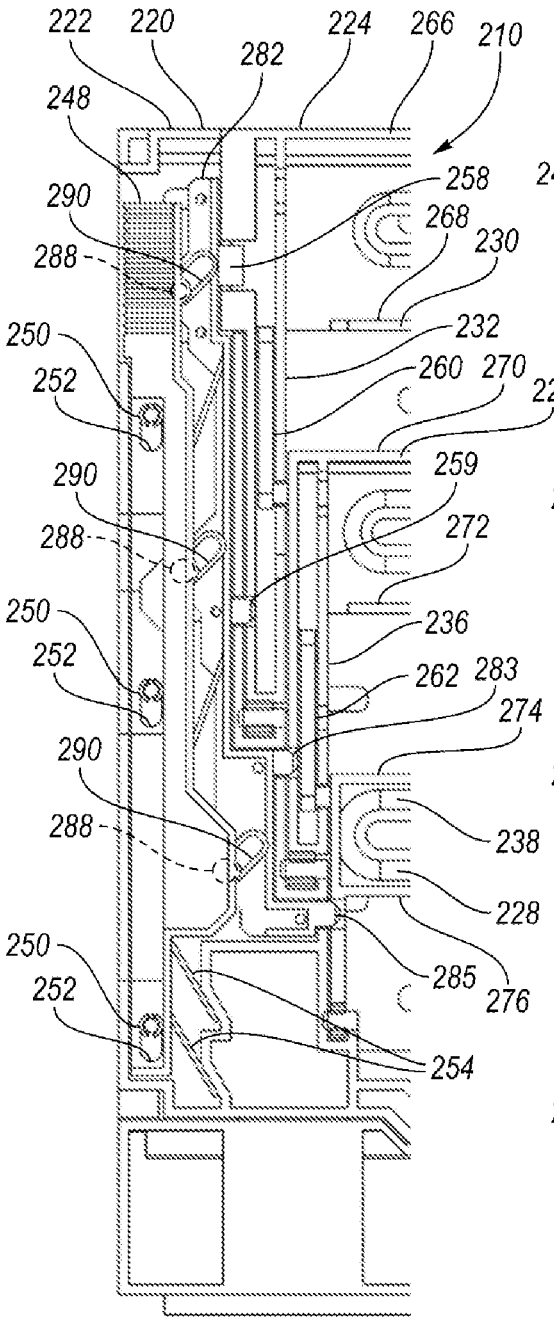
FIG. 52 is an enlarged view of one front corner of the container of FIG. 48, with the latch in the down, latched position.
Figure 53:
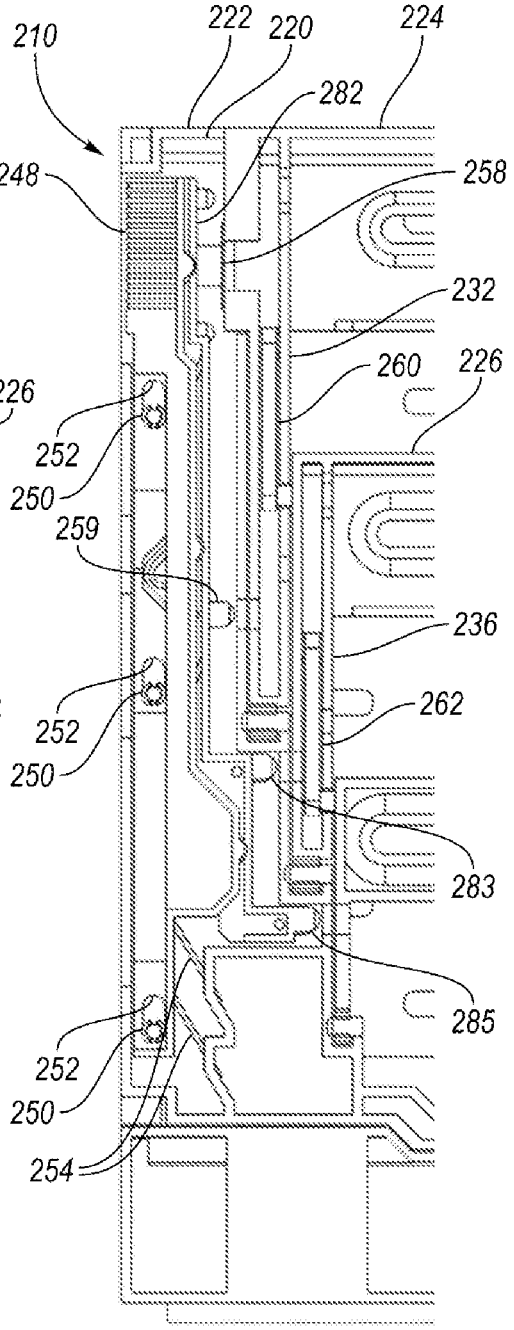
FIG. 53 shows the corner of FIG. 52 with the latch in the up, released position.

FIG. 52 is an enlarged view of one front corner of the container 210 of FIG. 48, with the latch in the down, latched position. FIG. 53 is an enlarged view of the corner of FIG. 48 with the latch in the up, released position. The other front corner would be mirror image. The latch 248 is shown in more detail. The latch 248 is an elongated vertical member slidably mounted for vertical translation within a vertical channel molded into the vertical portion 222 of the frame 220, and secured to a plurality (three, in this example) of pins 250 received in vertically elongated apertures 252 (or slots) in the latch 248. The pins 250 are integrally molded with the vertical portions 222 of the frame 220. A pair of lower springs 254 are integrally molded with the latch 248 and bias the latch 248 downward relative to the frame 220. In FIG. 52, the latch 248 is shown in the downward, latched position.

As can be seen in FIG. 52, the arms 232 of the upper portion 224 each have an elongated recess for receiving a link 260 pivotably securing the upper portion 224 to the mid portion 226. The arms 236 of the mid portion 226 each have an elongated recess for receiving a link 262 pivotably securing the mid portion 226 to the lower portion 228.

The upper portion 224 includes the horizontal wall portion 230 and an upper horizontal rib 266 projecting outward from an upper edge thereof and a lower horizontal rib 268 projecting outward from a lower edge thereof. The upper horizontal rib 266 extends the full length of the upper portion 224. The lower horizontal rib 268 does not extend all the way to the edges of the upper portion 224.

The mid portion 226 includes the horizontal wall portion 234 and an upper horizontal rib 270 projecting outward from an upper edge thereof and a lower horizontal rib 272 projecting outward from a lower edge thereof. The upper horizontal rib 270 extends the full length of the mid portion 226. The lower horizontal rib 272 does not extend all the way to the edges of the mid portion 226.

The lower portion 228 includes the horizontal wall portion 238 and an upper horizontal rib 274 projecting outward from an upper edge thereof and a lower horizontal rib 276 projecting outward from a lower edge thereof. The upper horizontal rib 274 extends the full length of the lower portion 228. The lower horizontal rib 276 extends all the way to the edges of the lower portion 228.

The latch 248 is mounted to slide vertically relative to the frame 220. A secondary latch 282 is also slidably mounted to the frame 220. The secondary latch 282 is mounted to slide horizontally relative to the frame 220 (i.e. right and left in FIGS. 52 and 53). In FIG. 52, the secondary latch 282 is shown in the latched position (to the right) where it retains the upper portion 224, the mid portion 226 and the lower portion 228 in the closed position. The secondary latch 282 includes an integral upper latch member 258 positioned outward of (i.e. on an exterior side of) the upper horizontal wall portion 230, an integral upper locking member 259 positioned outward of (again on an exterior side of) the arm 232 of the upper portion 224, an integral mid locking member 283 positioned outward of (on an exterior side of) the arm 236 of the mid portion 226. The secondary latch 282 also includes an integral lower locking member 285 positioned outward of (on an exterior side of) the arm 240 of the lower portion 228.

The secondary latch 282 is biased horizontally to the latched position (to the right in FIGS. 52 and 53) by a cam between the secondary latch 282 and the latch 248, and via the springs 254 which bias the latch 248 downward. The cam comprises a plurality of pins 288 (three in this example) integrally molded with the latch 248 and projecting rearward into elongated apertures 290 in the secondary latch 282. The elongated apertures 290 extend at an angle upward and inward, such that when the user slides the latch 248 upward, the cam causes the secondary latch 282 to move outward (left in FIGS. 52 and 53) to the unlatched position.

In FIG. 53, the latch 248 has been moved upward, biasing the springs 254 and causing the secondary latch 282 to move to the unlatched position (left in FIG. 53). The upper latch member 258, upper locking member 259, mid locking member 283, and lower locking member 285 are all moved outward (to the left) to the unlatched position so they are not in front of the upper horizontal wall portion 230, the arm 232 of the upper portion 224, the arm 236 of the mid portion 226, the arm 240 of the lower portion 228. Again, the right side of the front wall 218 would be mirror image. After the latches 248 have been released as in FIG. 53, the front wall 218 can be moved toward its retracted position as shown in FIG. 54.

Figure 54:
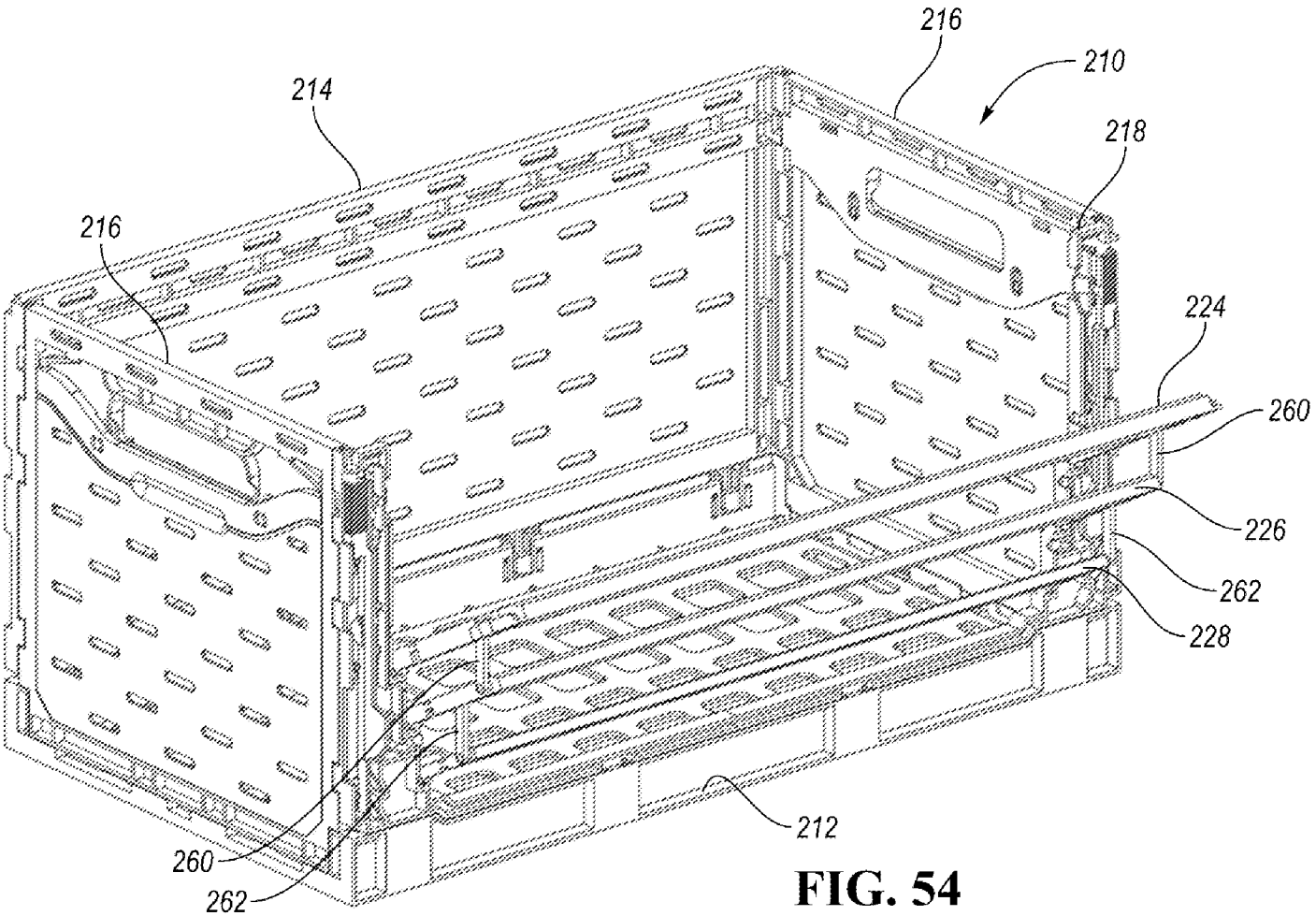
FIG. 54 shows the collapsible container of FIG. 48 with the front wall beginning to pivoted outward of the frame toward a retracted position.

FIG. 54 shows the collapsible container 210 after the latches 248 and the secondary latches 282 have been released but then returned to their latched positions after the upper portion 224, mid portion 226, and lower portion 228 have been pivoted outward of the frame 220. The links 260, 262 also pivot outward so that the upper portion 224, mid portion 226 and lower portion 228 all pivot and move together. The user can lift and lower all three portions 224, 226, 228 by moving any one of them.

Figure 55:
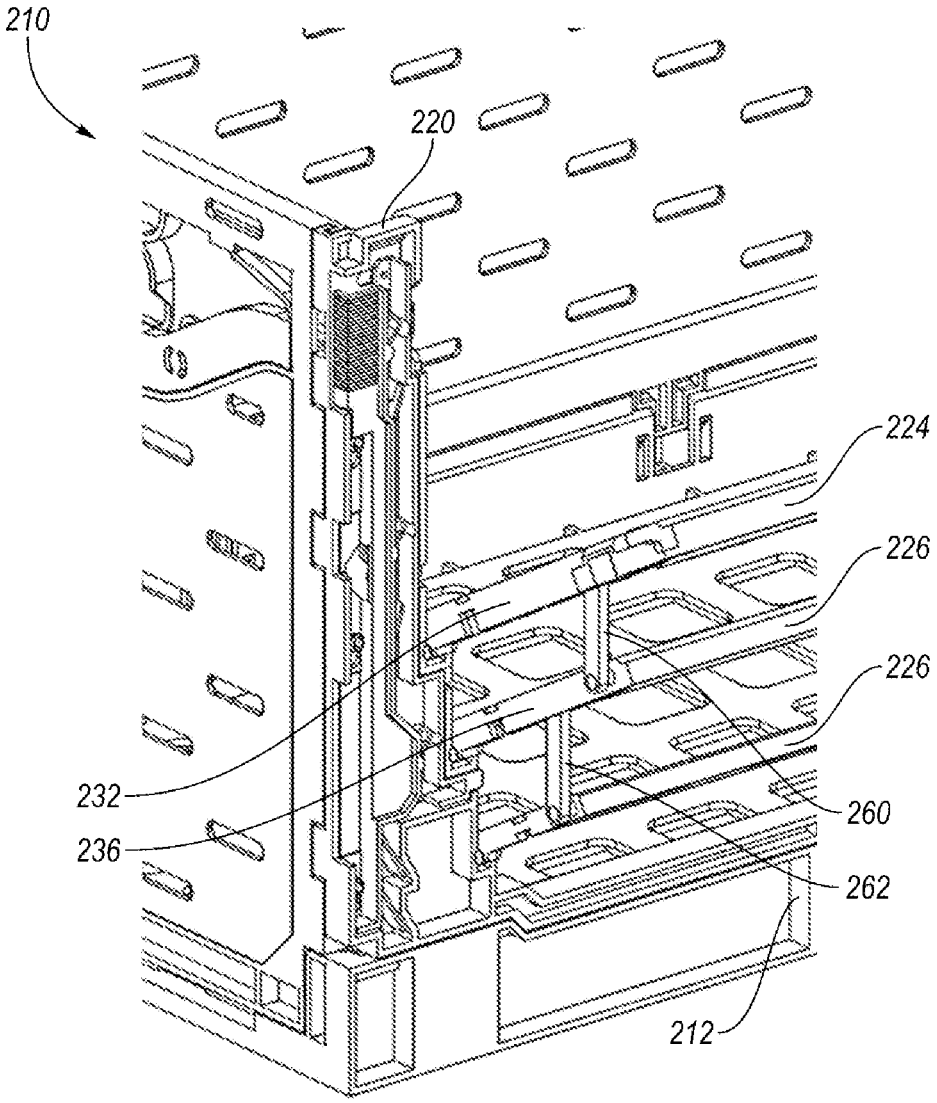
FIG. 55 is an enlarged view of one corner of FIG. 54.
Figure 56:
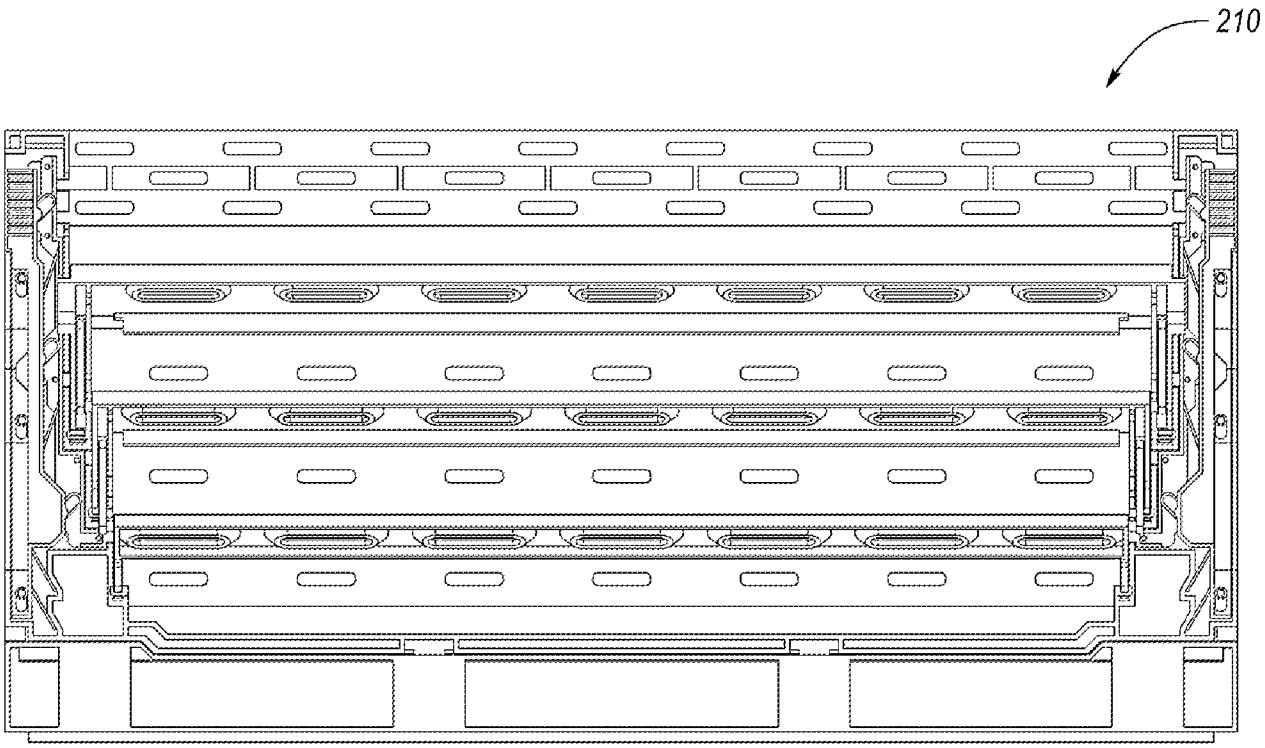
FIG. 56 is a front view of the container of FIG. 54.
Figure 57:
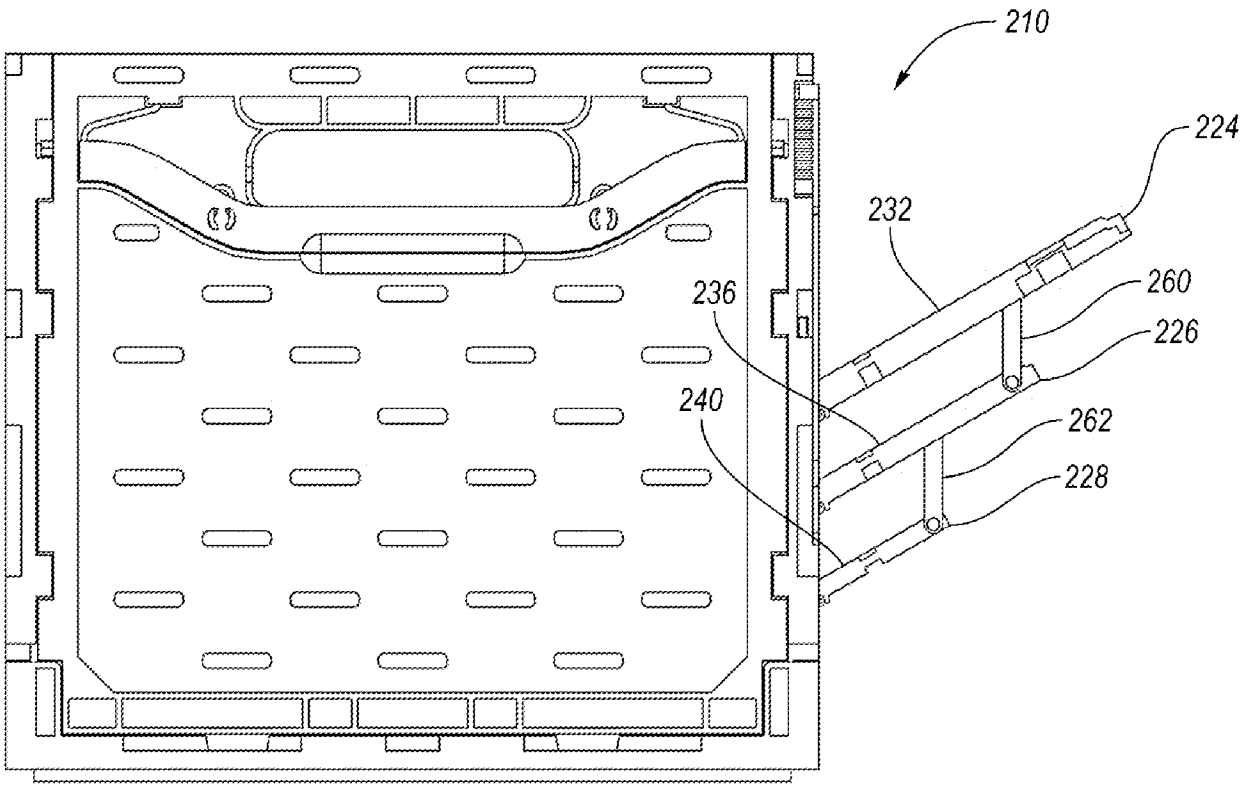
FIG. 57 is an end view of the container of FIG. 54.

FIG. 55 is an enlarged view of one corner of FIG. 54. The links 260, 262 pivot outward of the recesses in the arms 232, 236. FIG. 56 is a front view of the container 210 of FIG. 54. FIG. 57 is an end view of the container 210 of FIG. 54.

Figure 58:
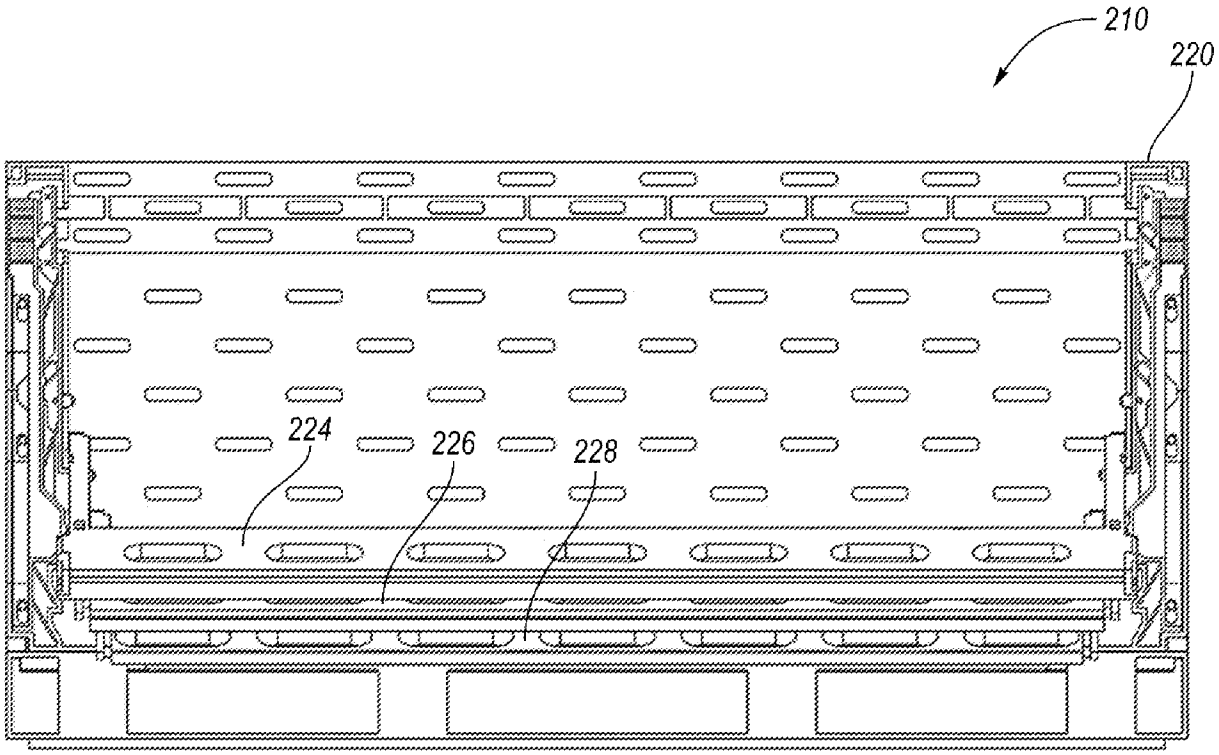
FIG. 58 is a front view of the container of FIG. 54 with the front wall pivoted further toward a retracted position.
Figure 59:
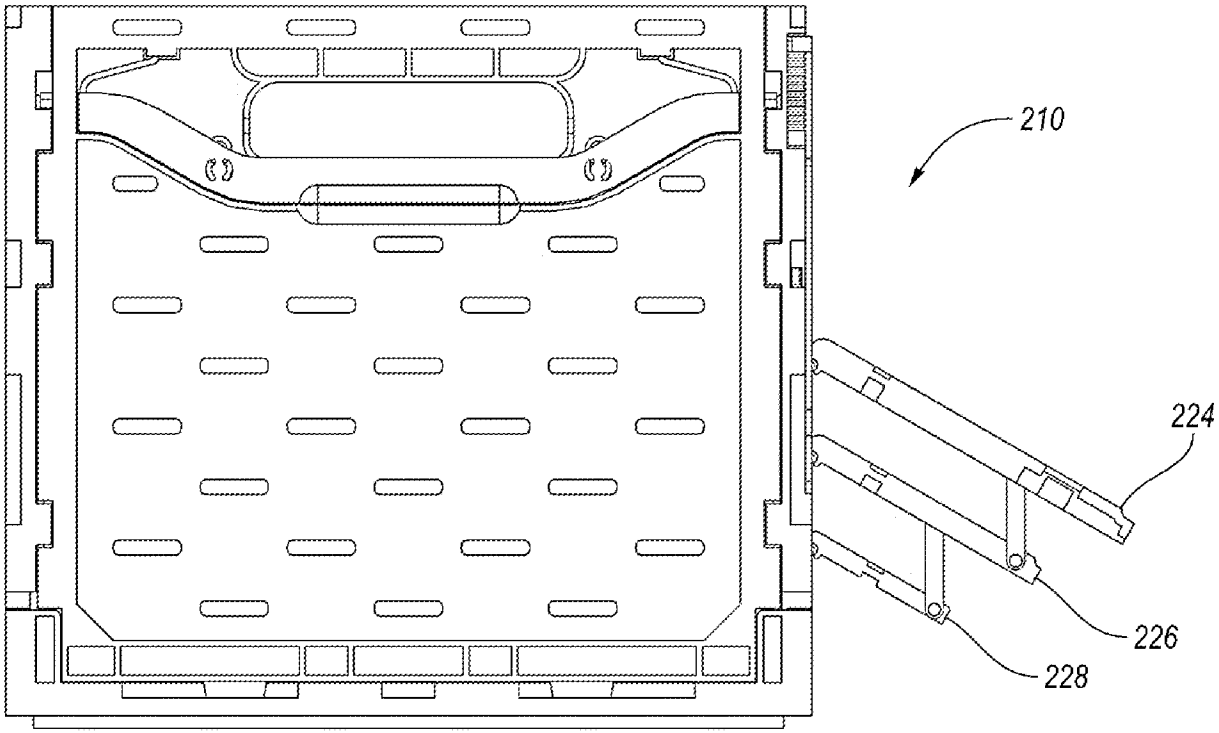
FIG. 59 is an end view of the container of FIG. 58.

FIG. 58 is a front view of the container 210 with the upper portion 224, mid portion 226, and lower portion 228 pivoted further toward a retracted position. FIG. 59 is an end view of the container 210 of FIG. 58.

Figure 60:
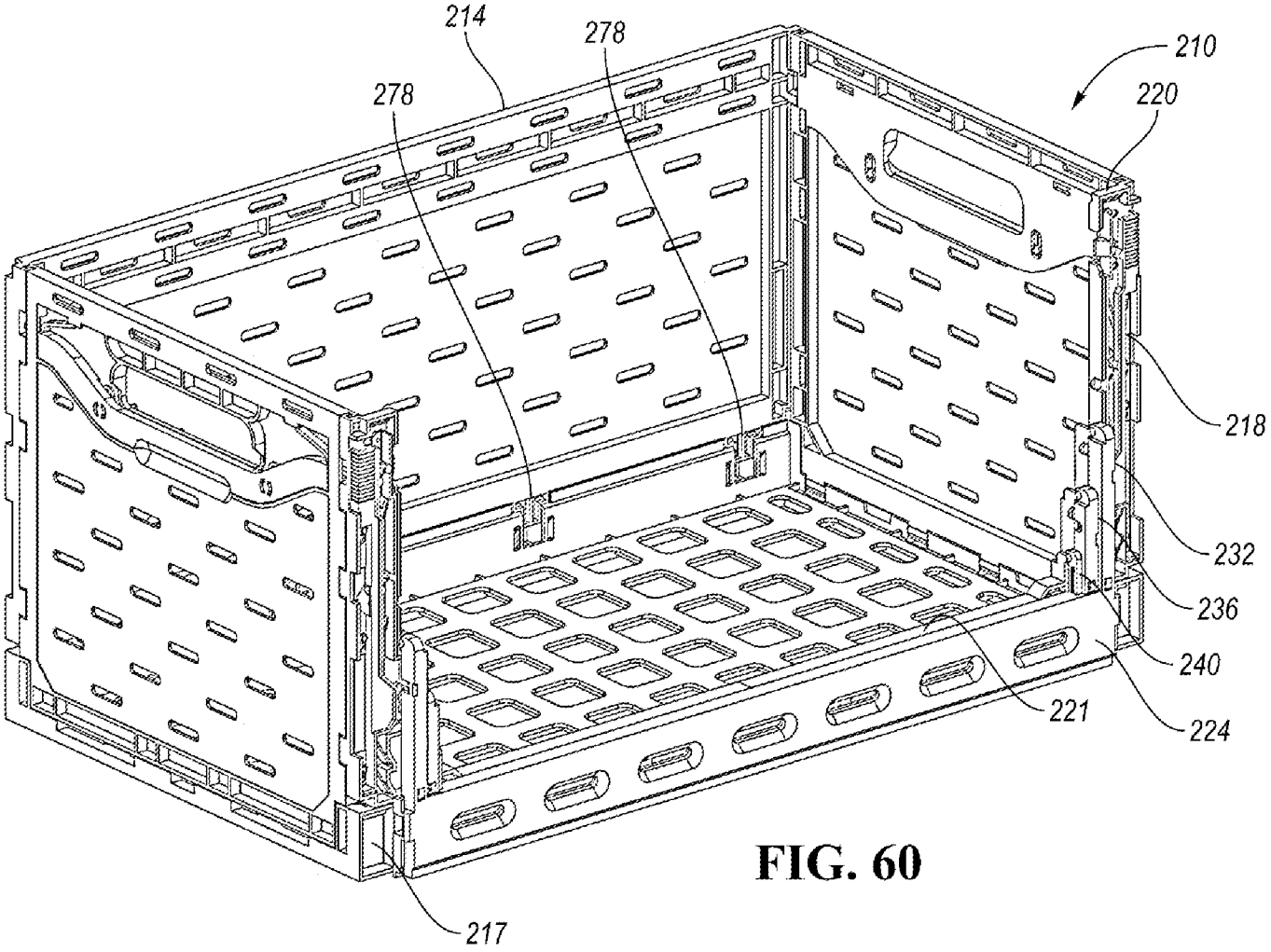
FIG. 60 shows the container of FIG. 48 with the front wall in the retracted position.

FIG. 60 shows the container 210 with the front wall 218 in the retracted position. The upper portion 224, mid portion 226 and lower portion 228 are nested adjacent the upstanding flange 217 and the horizontal portion 221 of the frame 220. The arms 236 of the mid portion 226 are inward of the arms 232 of the upper portion 224. The arms 240 of the lower portion 228 are inward of the mid portion 226. In the retracted position, all of the arms 232, 236, 240 extend upward from the respective wall portions 230, 234, 238.

As shown in FIG. 60, horizontal wall portion 234 of the mid portion 226 is nested within the horizontal wall portion 230 of the upper portion 224. The horizontal wall portion 238 of the lower portion 228 is nested within the horizontal wall portion 234 of the mid portion 226. In this manner, the upper portion 224, mid portion 226 and lower portion 228 can lie flat against the upstanding flange 217 and frame 220.

Slidable hinges 278 connect the rear wall 214 and the front wall 218 (i.e. the frame 220) to the upstanding flange 217 of the base 212. These hinges reduce the collapsed height of the container 210.

Figure 61:
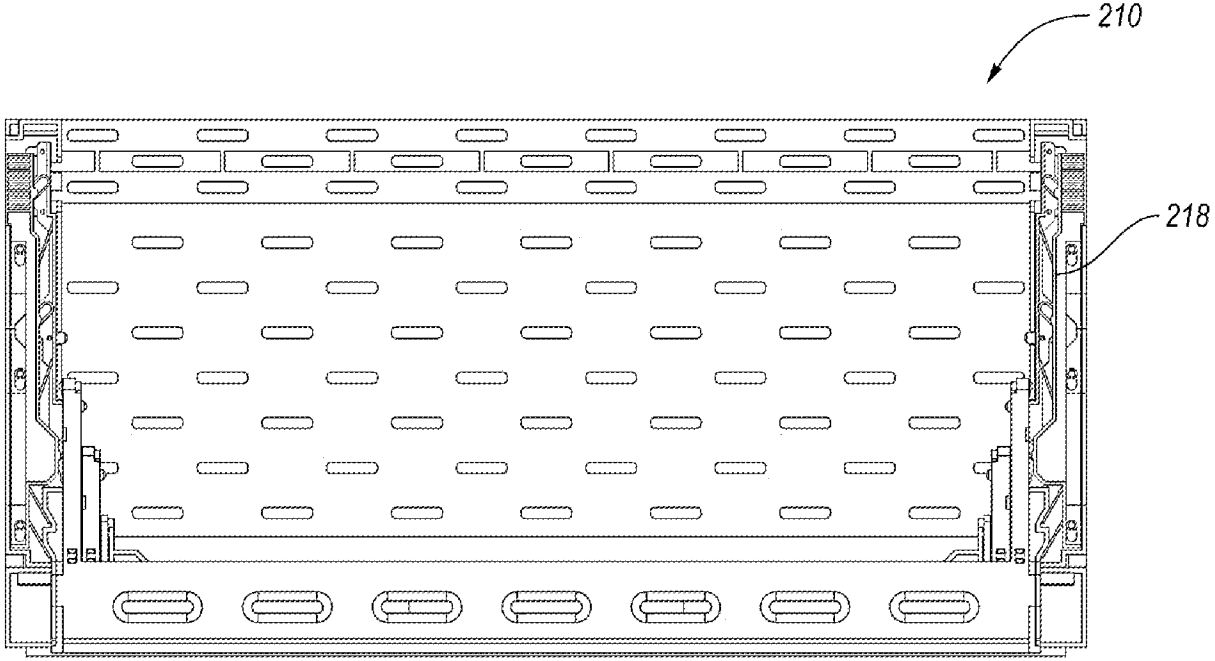
FIG. 61 is a front view of the container with the front wall in the retracted position.
Figure 62:
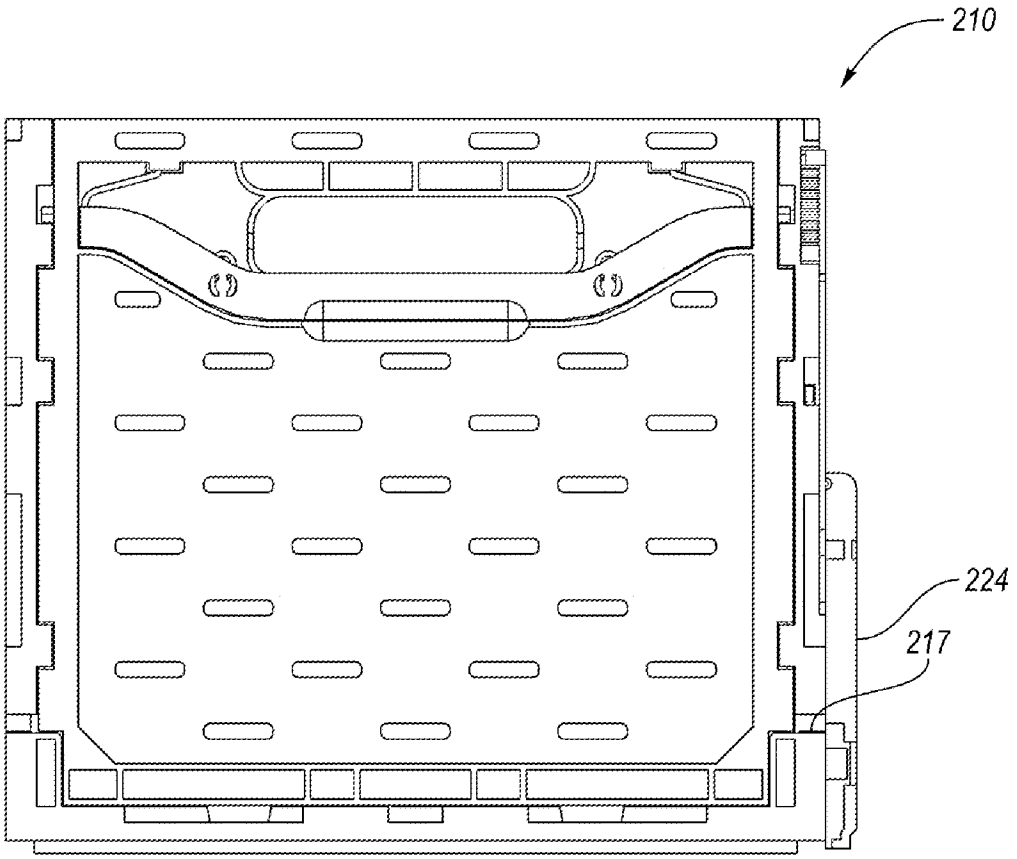
FIG. 62 is an end view of the container of FIG. 60.

FIG. 61 is a front view of the container 210 with the front wall 218 in the retracted position. FIG. 62 is an end view of the container 210 of FIG. 60.

Figure 63:
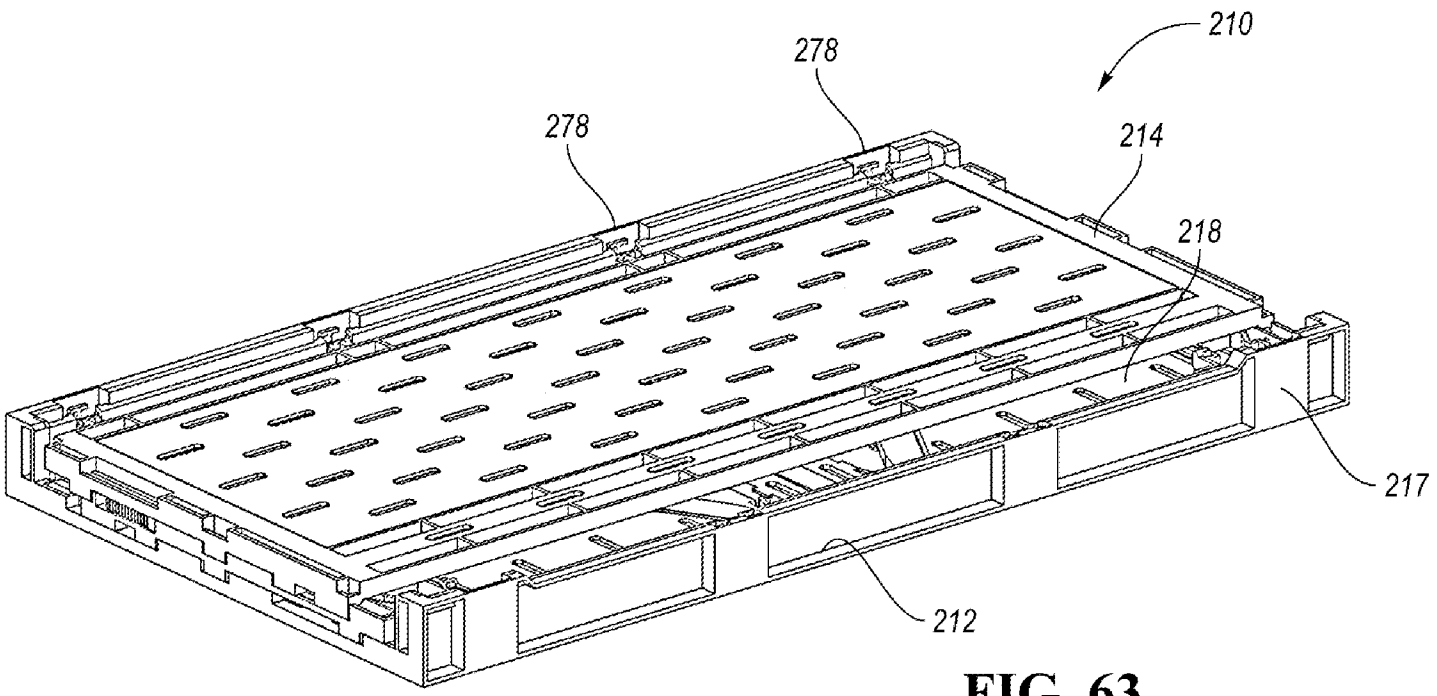
FIG. 63 shows the container of FIG. 48 in a collapsed configuration.
Figure 64:
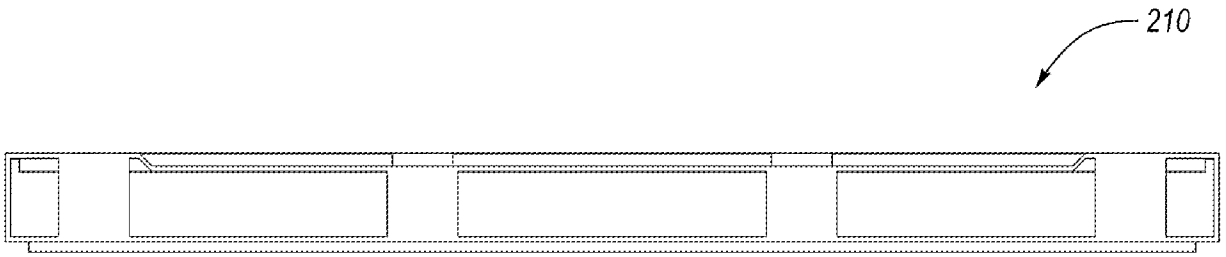
FIG. 64 is a front view of the collapsed container of FIG. 63.
Figure 65:
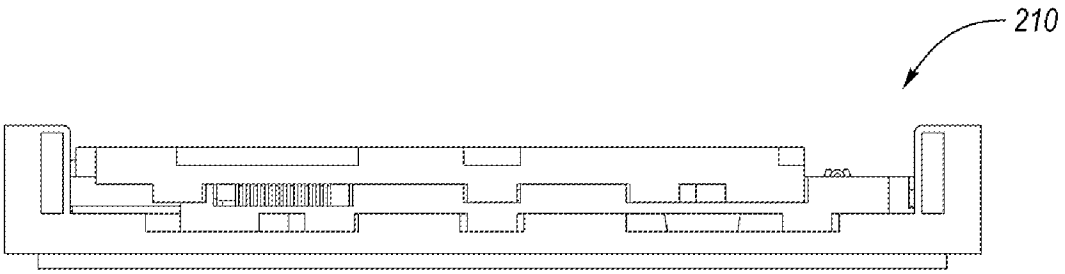
FIG. 65 is an end view of the collapsed container of FIG. 63.

FIG. 63 shows the container 210 in a collapsed configuration. The end walls 216 are collapsed onto the base 212 after releasing the latches 244. The rear wall 214 and front wall 218 can then be collapsed onto the end walls 216 (in either order), as shown in FIG. 63. The walls 216, 214, 218 are all at or below the height of the flanges 217. FIG. 64 is a front view of the collapsed container 210. FIG. 65 is an end view of the collapsed container 210.

Figure 66:
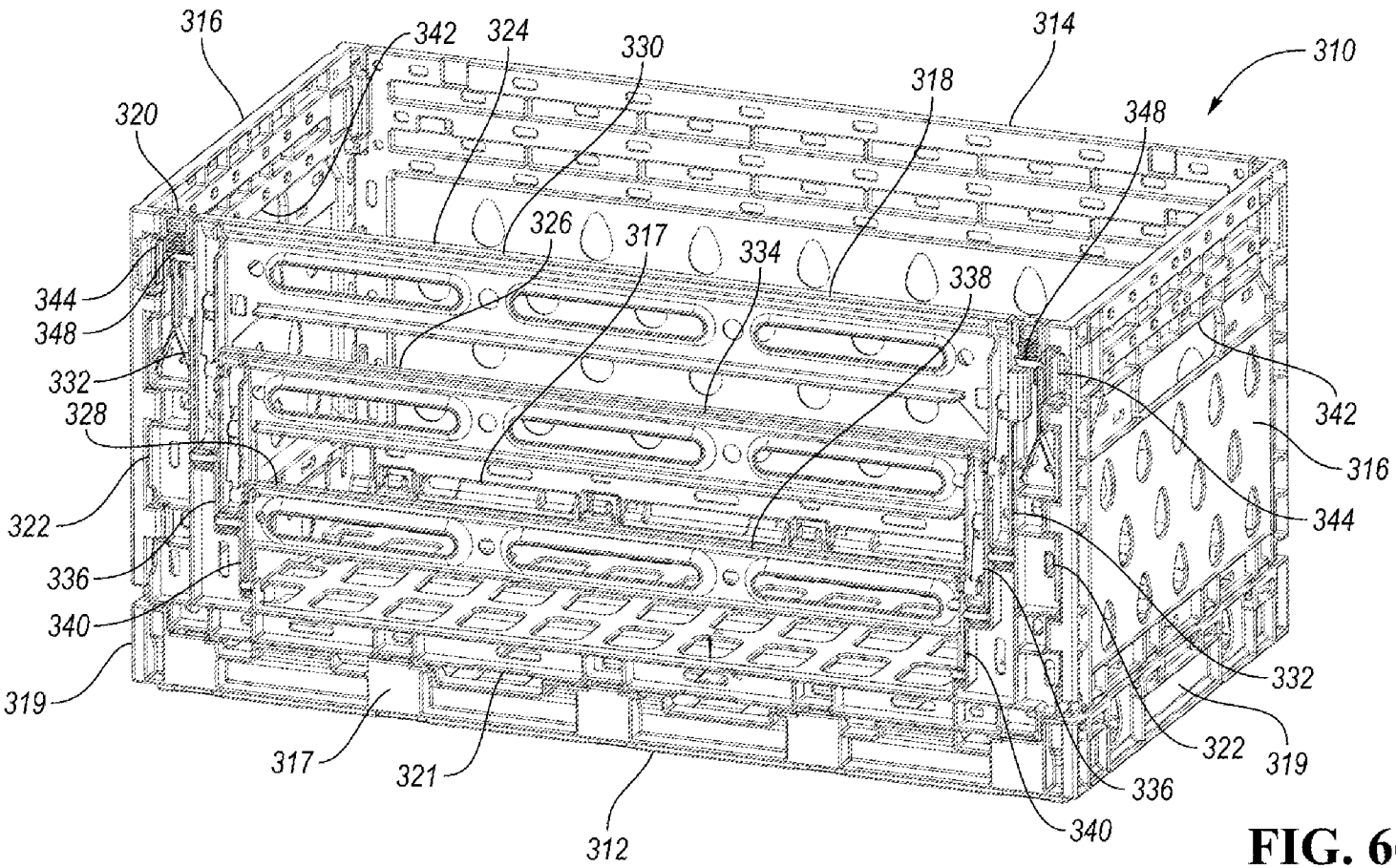
FIG. 66 is a perspective view of a fourth example collapsible container.

A collapsible container 310 according to a fourth embodiment is shown in FIG. 66. In FIG. 66, the container 310 is in an upright, assembled position. The container 310 includes a base 312. A rear wall 314, end walls 316 and a front wall 318 are pivotably connected at a periphery of the base 312. The base 312 includes upstanding flanges 317 projecting upward from rear and front edges of the base 312 and formed integrally with the rest of the base 312. In this embodiment, the rear wall 314 and front wall 318 are configured to fold onto the base 312 (in either order) first and then the end walls 316 are configured to collapse onto the rear wall 314 and front wall 318. The rear wall 314 and front wall 318 are between the end walls 316 and are pivotably connected to the base 312 at axes below those of the end walls 316.

The front wall 318 includes a frame 320 pivotably connected to the flange 317 at the front of the base 312. The frame 320 includes a lower horizontal portion 321 and a pair of upright vertical portions 322, together forming a U shape. The front wall 318 further includes an upper (or "first") portion 324, a mid (or "second") portion 326 and a lower (or "third") portion 328 within the frame 320. In FIG. 66, the front wall 318 is in the closed position with the upper portion 324, mid portion 326 and lower portion 328 substantially closing the large opening in the frame 320.

The upper portion 324 includes a horizontal wall portion 330 and a pair of arms 332 extending from ends of the horizontal wall portion 330 in a direction generally in the plane of the horizontal wall portion 330 to form generally a U-shape (opening downward in FIG. 66). In FIG. 66, the upper portion 324 is selectively secured to the frame 320 in an upper, closed position by latches 348. The arms 332 of the upper portion 324 are pivotably connected to the vertical portions 322 of the frame 320.

The mid portion 326 includes a horizontal wall portion 334 and a pair of arms 336 extending from ends of the horizontal wall portion 334 in a direction generally in the plane of the horizontal wall portion 334 to form generally a U-shape (opening downward in FIG. 66). The mid portion 326 is partially received between the arms 332 of the upper portion 324. In this example, the horizontal wall portion 334 and upper portions of the arms 336 are received between lower portions of the arms 332 of the upper portion 324.

The lower portion 328 includes a horizontal wall portion 338 and a pair of arms 340 extending from ends of the horizontal wall portion 338 in a direction generally in the plane of the horizontal wall portion 338 to form generally a U-shape (opening downward in FIG. 66). The lower portion 328 is partially received between the arms 336 of the mid portion 326. In this example, the horizontal wall portion 338 and upper portions of the arms 340 are received between lower portions of the arms 336 of the mid portion 326.

In FIG. 66, the walls 314, 316, 318 are in their upright, use position. The front wall 318 is in its deployed, closed position, with the horizontal wall portions 330, 334, 338 of the upper, mid and lower portions 324, 326, 328 extending across an upper portion, a mid-portion, and a lower portion respectively, of a large opening defined by the frame 320. In the deployed, closed position, the front wall 318 keeps objects, such as egg cartons, in the container 310.

The end walls 316 are pivotably connected to upstanding end flanges 319 at end edges of the base 312. Each end wall includes a handle opening 342 near an upper edge thereof. Each end wall 316 includes a pair of side flanges 323 projecting perpendicularly from ends thereof. Each side flange 323 includes latch 344 molded therein for selectively securing the end wall 316 to the rear wall 314 and to the front wall 318 (more specifically to the frame 320).

Figure 67:
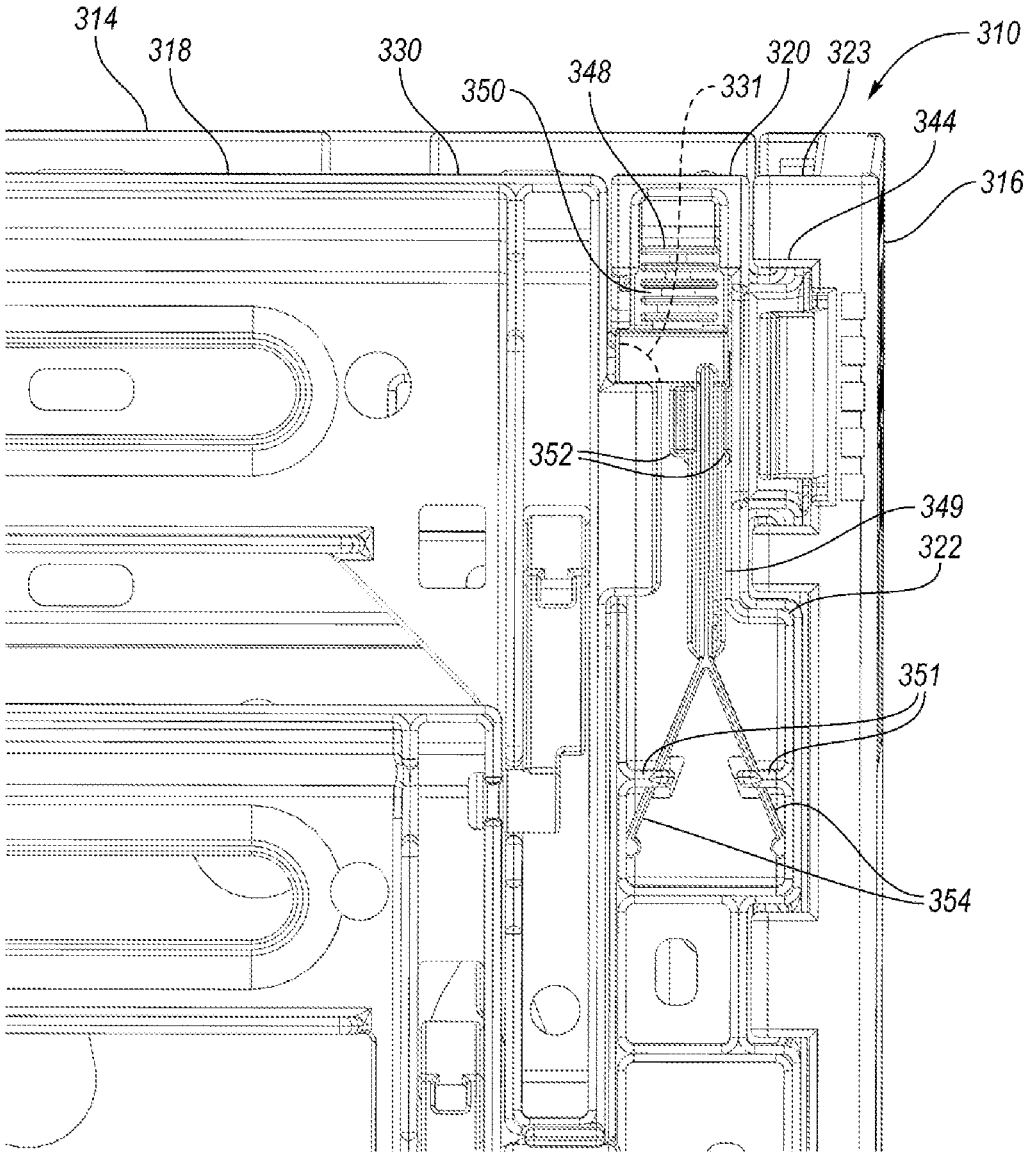
FIG. 67 is an enlarged front view of one front corner of the container of FIG. 66, with the latch in the down, latched position.
Figure 68:
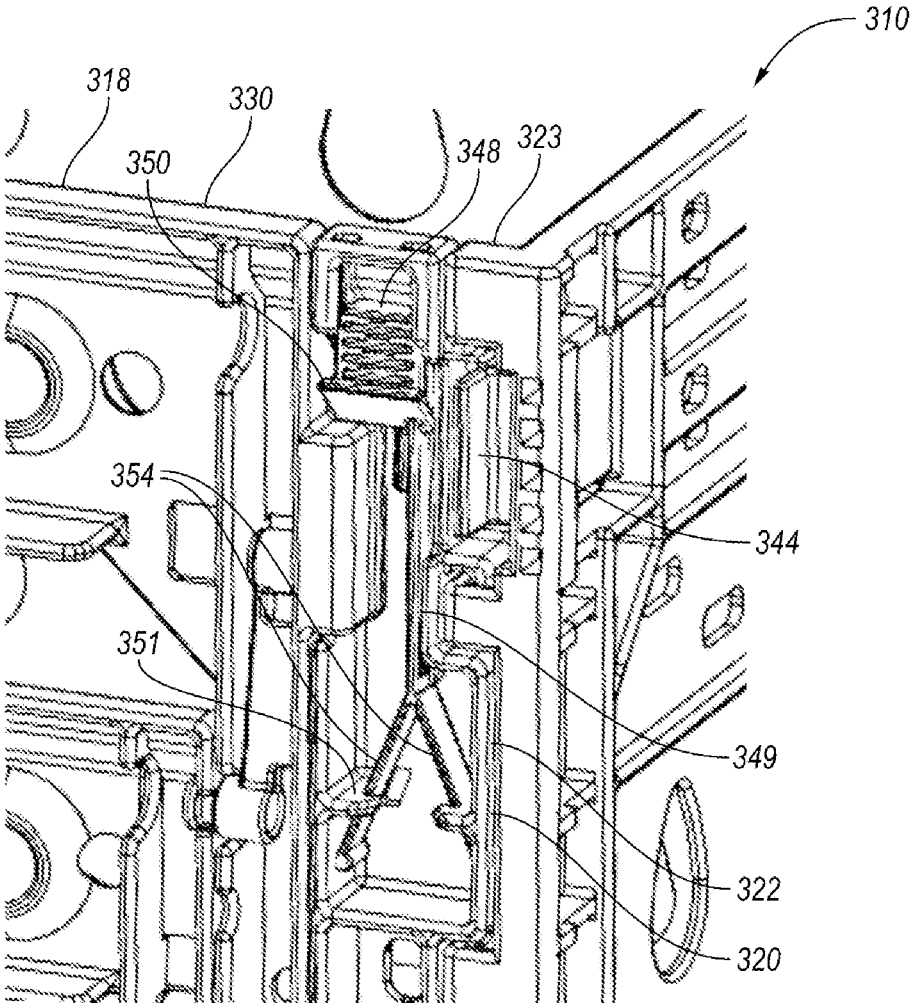
FIG. 68 is a perspective view of the corner of the container of FIG. 67.

FIG. 67 is an enlarged front view of one front corner of the container 310 of FIG. 66, with the latch in the down, latched position. FIG. 68 is a perspective view of the corner of the container 310 of FIG. 67. The other front corner would be mirror image. Referring to FIGS. 67 and 68, the latch 348 is shown in more detail. The latch 348 is an elongated vertical member slidably mounted for vertical translation within a vertical channel molded into the vertical portion 322 of the frame 320. The latch 348 includes an elongated portion 349 having a pair of integrally molded lower springs 354 extending downward and outward therefrom and biasing the latch 348 downward relative to the frame 320. The latch 348 further includes an interference portion 350 at an upper end thereof. The interference portion 350 may include ribs to facilitate activation by a user's finger or thumb. The elongated portion 349 is slidably captured by tabs 352 integrally molded with the frame 320. The lower springs 354 are also captured by tabs 351 (shown more clearly in FIG. 68), which also provide a biasing surface against which the lower springs 354 will bias the latch 348 downward when the latch 348 is moved upward relative to the frame 320.

Referring to FIG. 67, the horizontal wall portion 330 of the upper portion 324 of the front wall 318 includes a projection 331 (shown in broken lines) which projects behind the interference portion 350 of the latch 348. In this manner, the interference portion 350 of the latch 348 keeps the front wall 318 in the closed position until the latch 348 is released by being moved upward.

Figure 69:
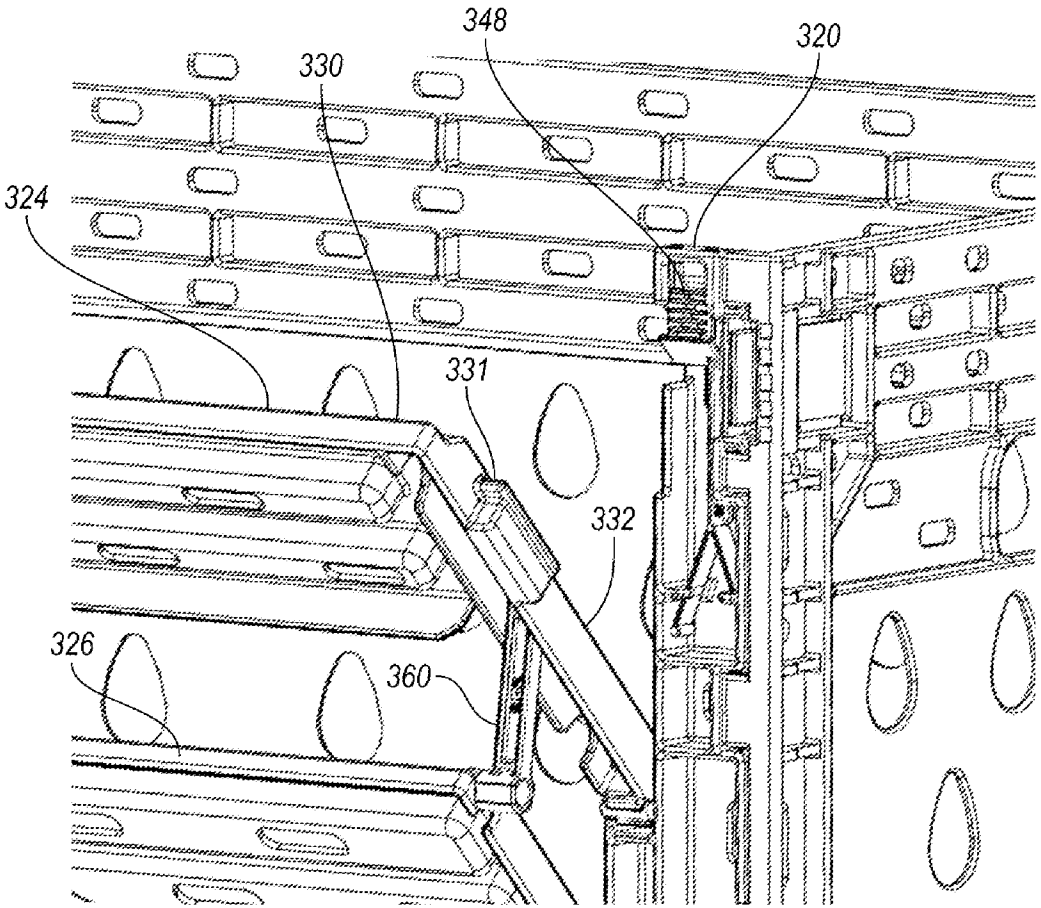
FIG. 69 shows the container of FIG. 68 with the front wall pivoted outward.

The upper portion 324 can be pivoted outward and the front wall 318 moved to the retracted, open position by first releasing the latches 348 by moving the latches 348 upward relative to the frame 320, biasing the lower springs 354. The upper portion 324 is then pivoted outward as shown in FIG. 69 (the latch 348 is shown returned to the lower position). The projection 331 of the horizontal wall portion 330 of the upper portion 324 of the front wall 318 is shown in FIG. 69.

As can also be seen in FIG. 69, the arms 332 of the upper portion 324 each have an elongated recess for receiving a link 360 pivotably securing the upper portion 324 to the mid portion 326. Similarly, the arms 336 of the mid portion 326 each have an elongated recess for receiving a link 362 pivotably securing the mid portion 326 to the lower portion 328 (not shown in FIG. 69).

Figure 70:
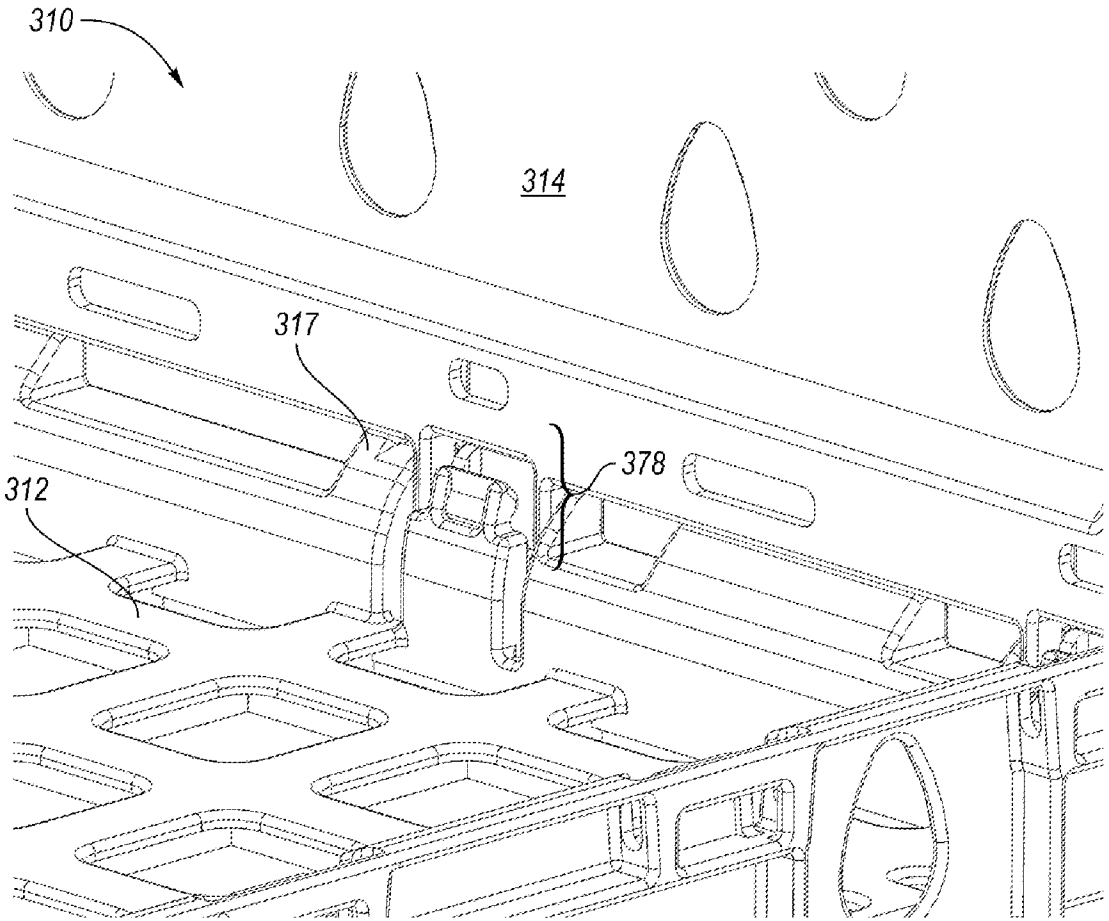
FIG. 70 is an interior perspective view of the container of FIG. 66.

Referring to FIG. 70, slidable hinges 378 connect the rear wall 314 and the front wall 318 (i.e. the frame 320) to the upstanding flange 317 of the base 312. These hinges reduce the collapsed height of the container 310.

Figure 71:
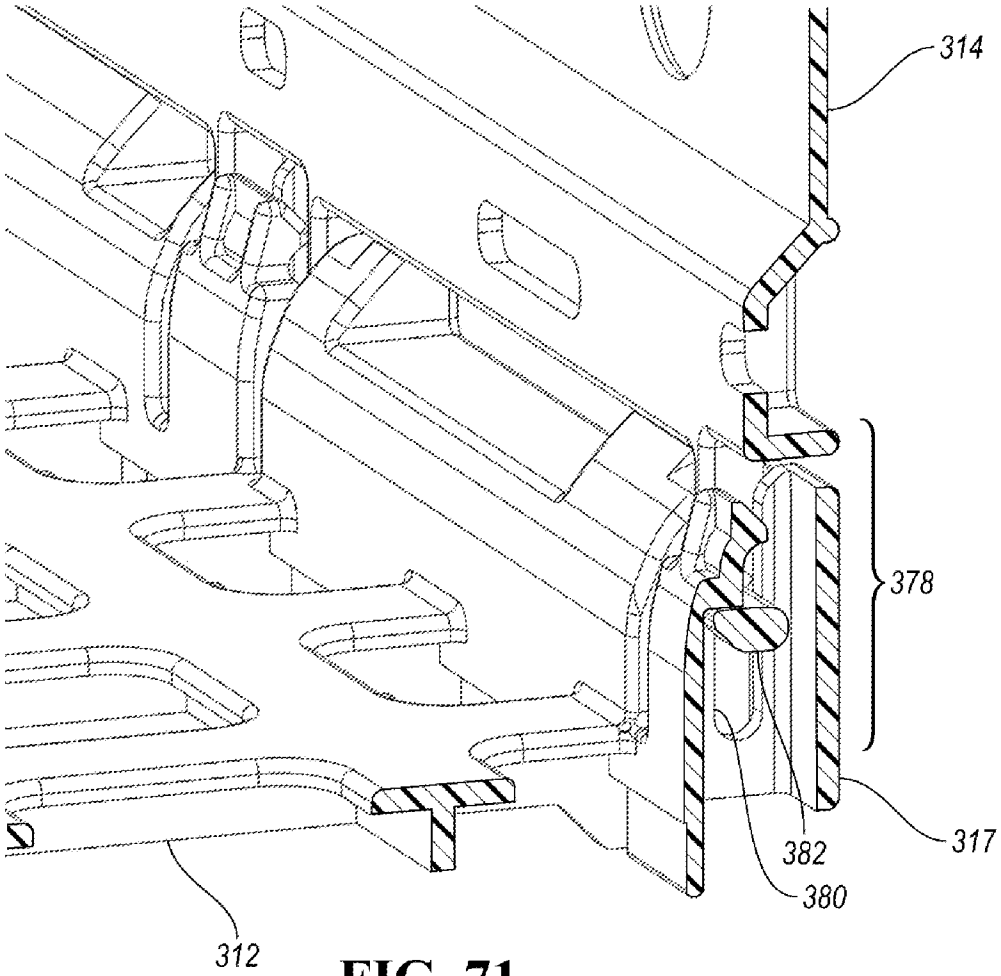
FIG. 71 is an enlarged view, partially broken away, of hinges of the container of FIG. 70.

Referring to FIG. 71, the slidable hinge 378 includes a vertical elongated slot 380 formed in the upstanding flange 317 of the base 312. A hinge pin 382 integrally molded with the rear wall 314 is received in the slot 380. The hinge 378 would be the same for the front wall 318.

Figure 72:
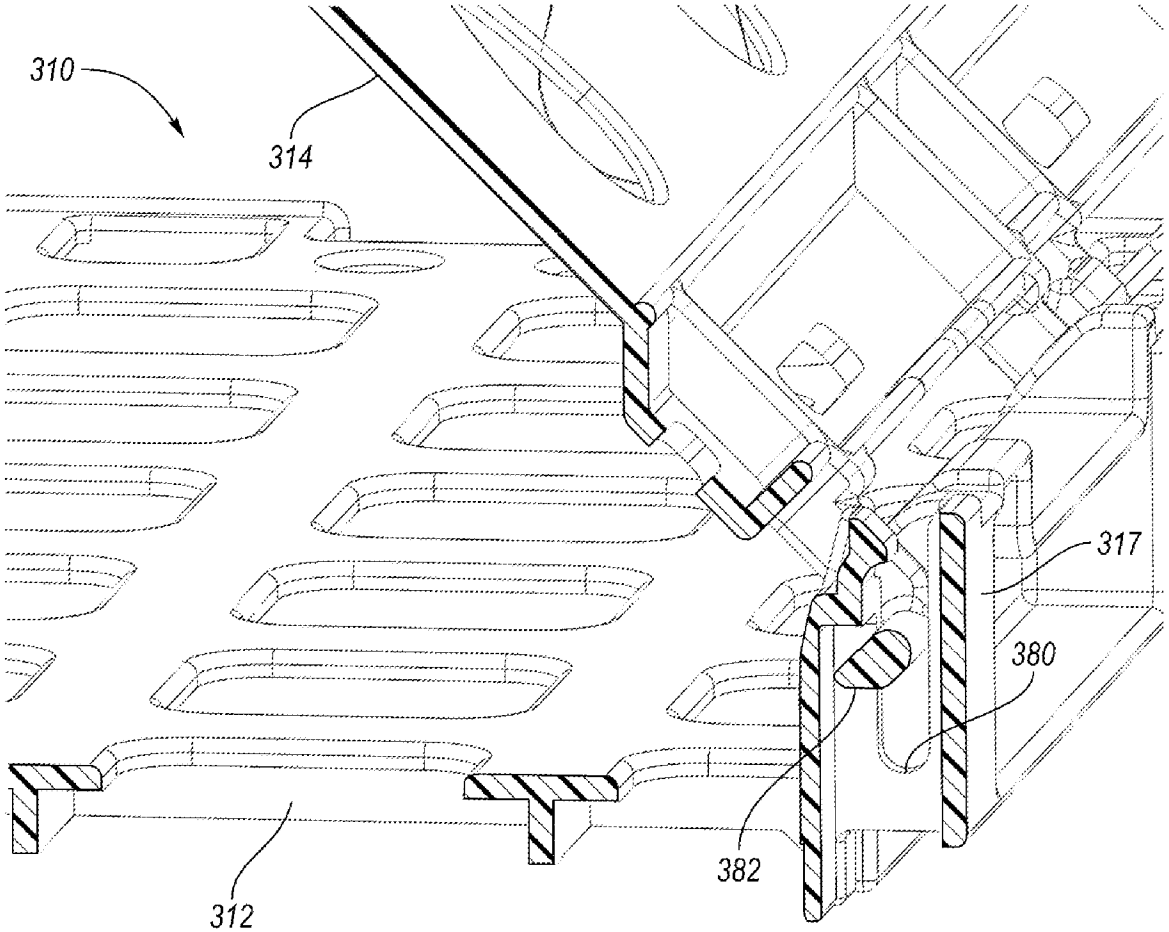
FIG. 72 shows the container of FIG. 71 with the rear wall being pivoted downward toward the base.
Figure 73:
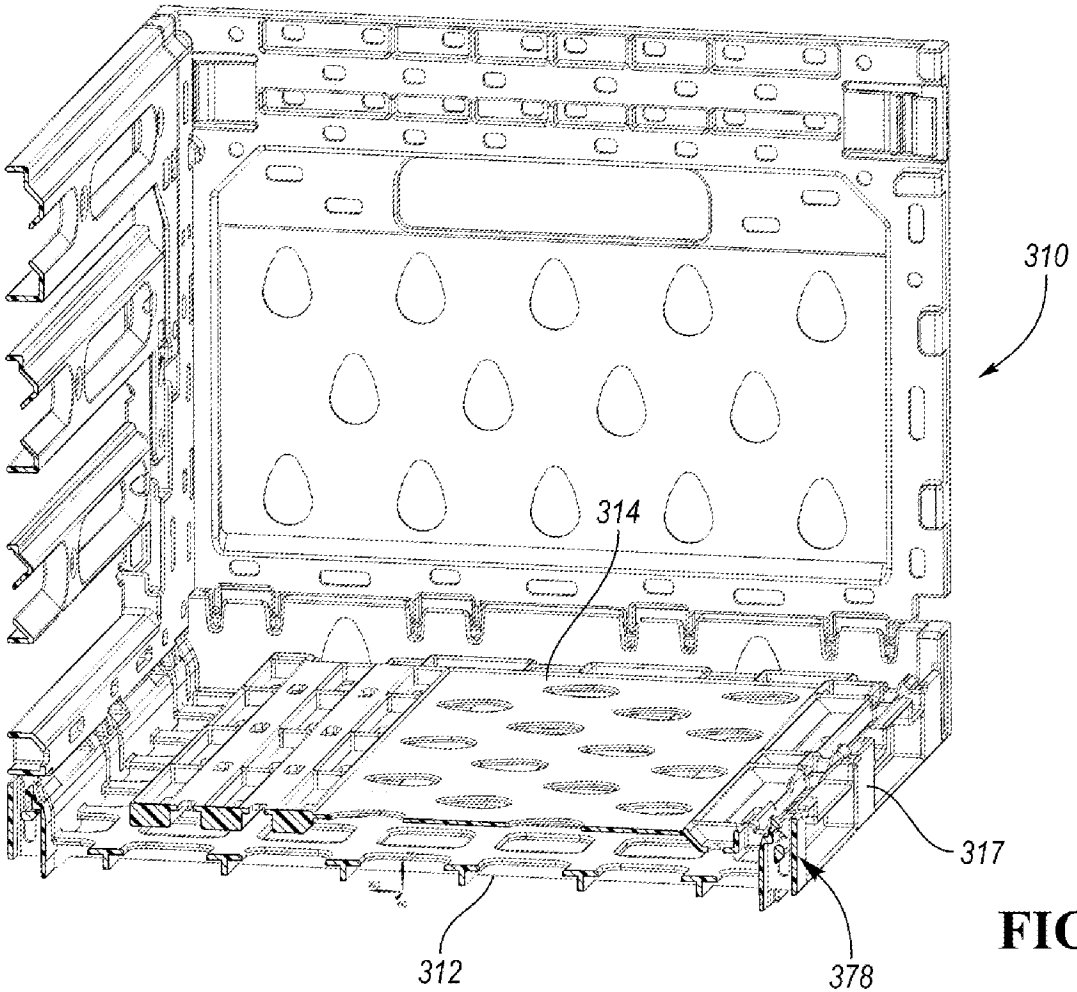
In FIGS. 73 and 74, the rear wall of FIG. 72 has been pivoted approximately ninety degrees about the hinge.
Figure 74:
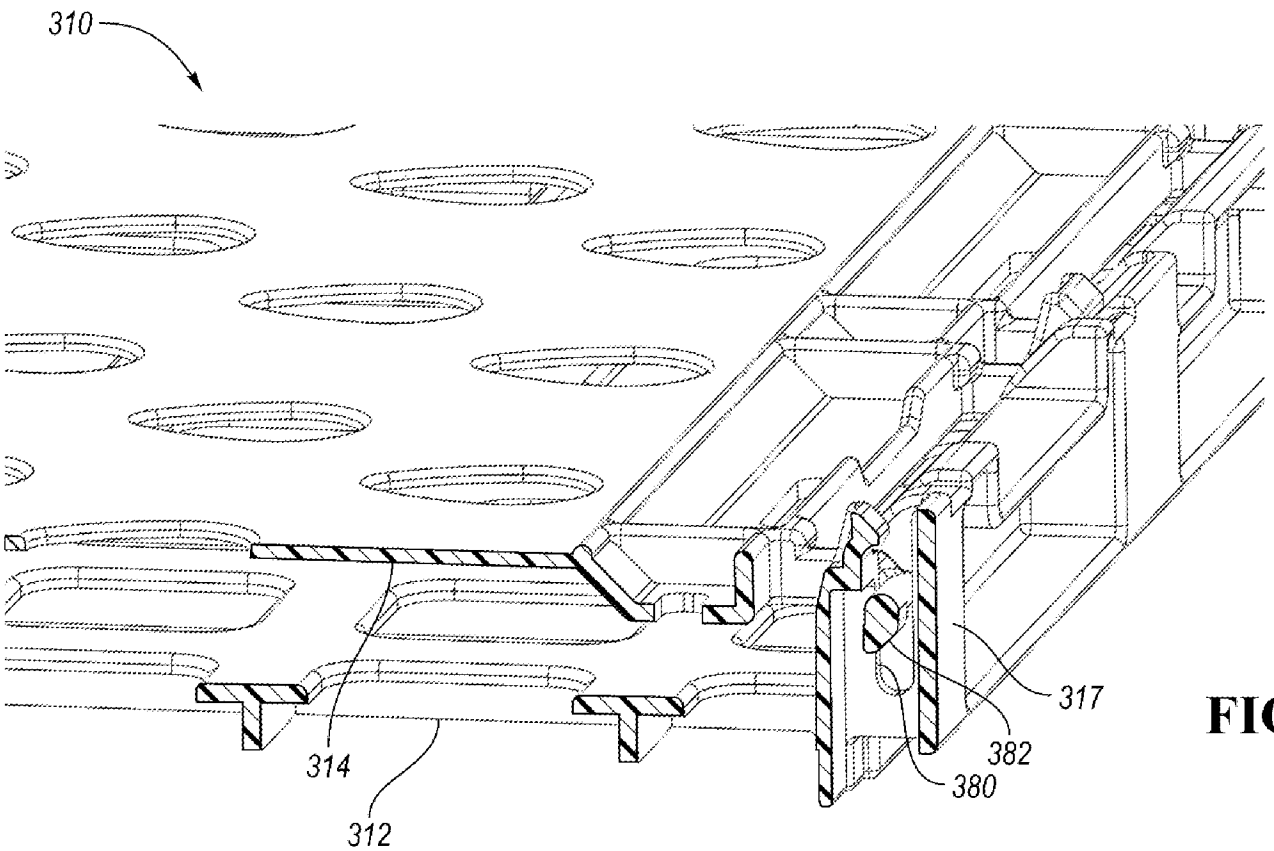
Figure 75:
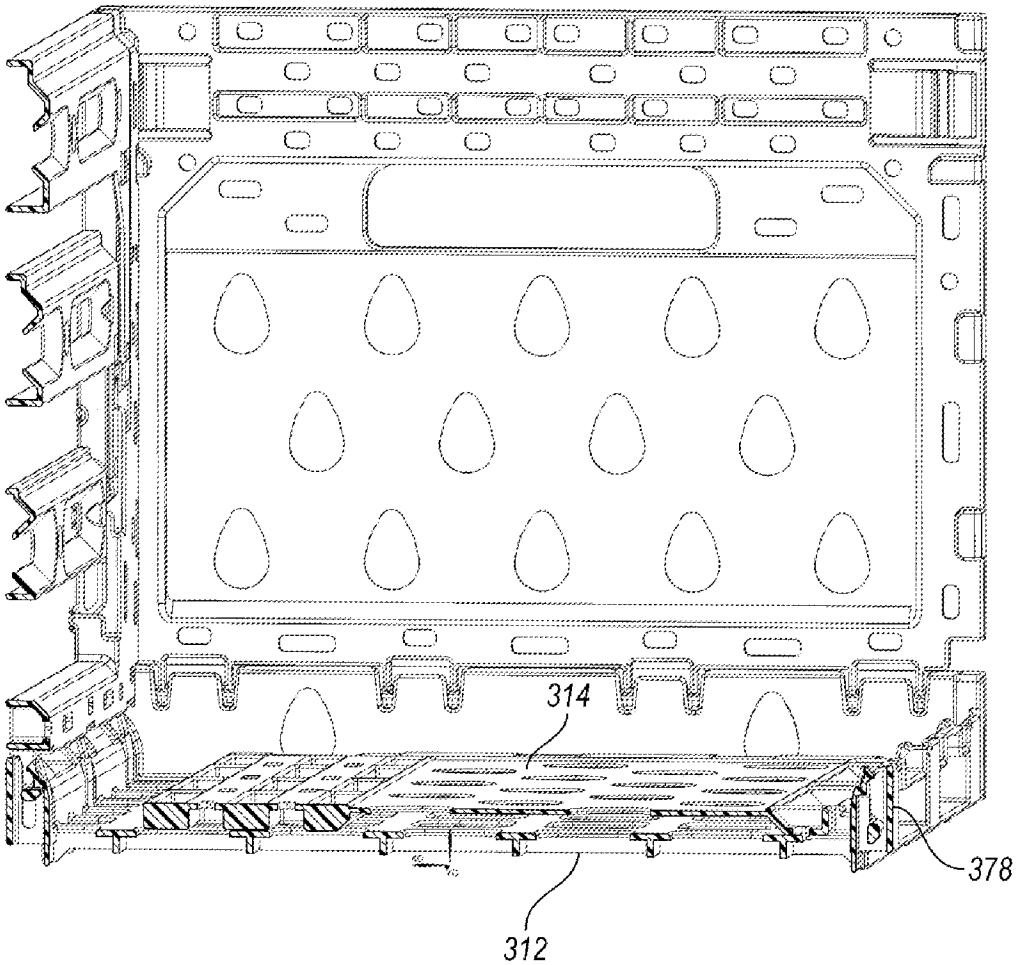
In FIGS. 75 and 76, the rear wall lies substantially flat and flush against the base because the hinge pin has slid downward within the slot.
Figure 76:
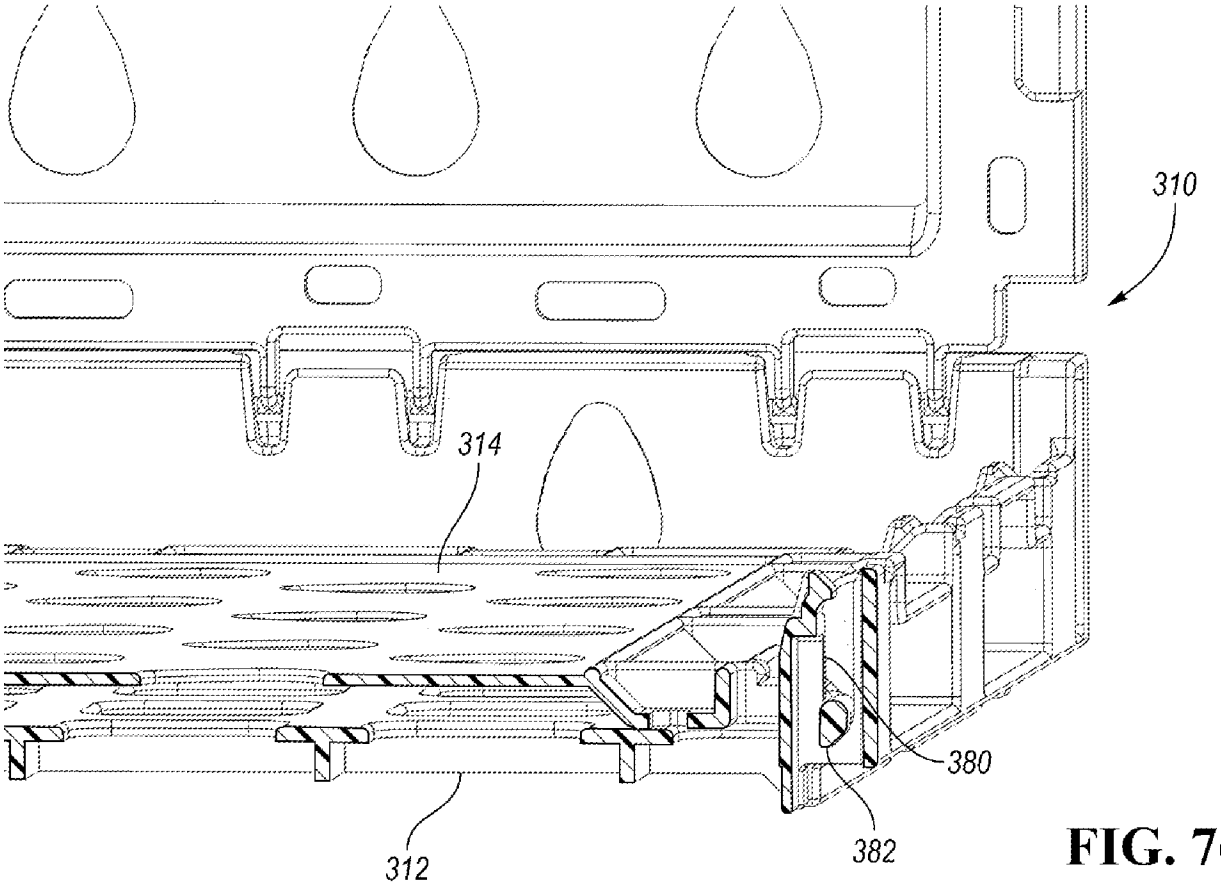

In FIG. 72, the rear wall 314 is being pivoted downward toward the base 312. The hinge pin 382 rotates within the slot 380. In FIGS. 73 and 74, the rear wall 314 has been pivoted approximately ninety degrees about the hinge 378. In FIGS. 75 and 76, the rear wall 314 lies substantially flat and flush against the base 312 because the hinge pin 382 has slid downward within the slot 380. Again, the hinge 378 for the front wall 318 is the same, so the front wall 318 can be pivoted to lie substantially flat and flush onto the rear wall 314, or the front wall 318 can be collapsed onto the base 312 first, with the rear wall 314 collapsed onto the front wall 318.

Figure 77:
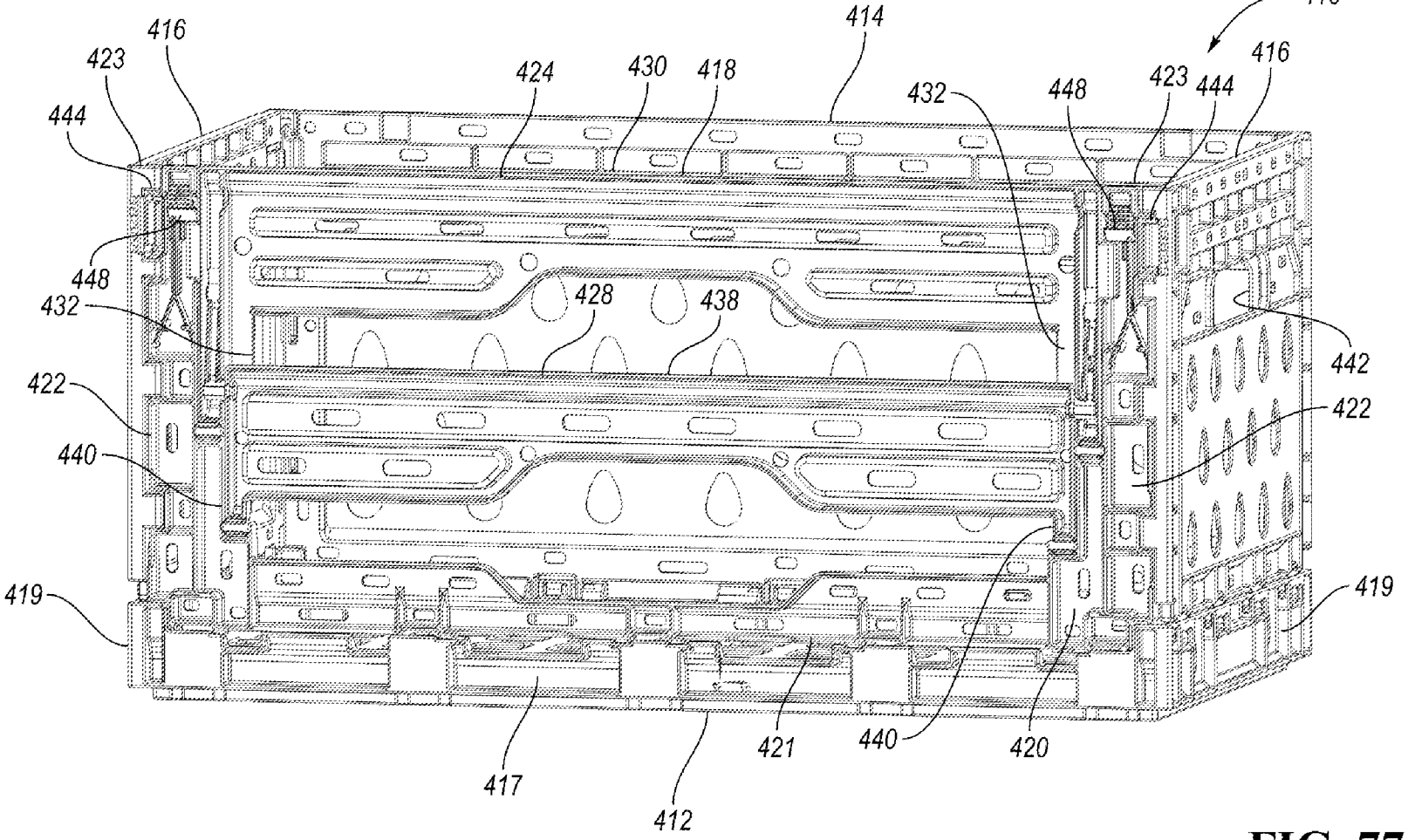
FIG. 77 is a perspective view of a fifth example collapsible container.

A collapsible container 410 according to a fifth embodiment is shown in FIGS. 77-82. The container 410 is similar to the container 310 except as shown or described below. In FIG. 77, the container 410 is in an upright, assembled position. The container 410 includes a base 412. A rear wall 414, end walls 416 and a front wall 418 are pivotably connected at a periphery of the base 412. The base 412 includes upstanding flanges 417 projecting upward from rear and front edges of the base 412 and formed integrally with the rest of the base 412.

The front wall 418 includes a frame 420 pivotably connected to the flange 417 at the front of the base 412. The frame 420 includes a lower horizontal portion 421 and a pair of upright vertical portions 422, together forming a U shape. The front wall 418 further includes an upper (or "first") portion 424 and a lower (or "second") portion 428 within the frame 420. In FIG. 77, the front wall 418 is in the closed position with the upper portion 424 and lower portion 428 substantially closing the large opening in the frame 420.

The upper portion 424 includes a horizontal wall portion 430 and a pair of arms 432 extending from ends of the horizontal wall portion 430 in a direction generally in the plane of the horizontal wall portion 430 to form generally a U-shape (opening downward in FIG. 77). In FIG. 77, the upper portion 424 is selectively secured to the frame 420 in an upper, closed position by latches 448. The arms 432 of the upper portion 424 are pivotably connected to the vertical portions 422 of the frame 420.

The lower portion 428 includes a horizontal wall portion 438 and a pair of arms 440 extending from ends of the horizontal wall portion 438 in a direction generally in the plane of the horizontal wall portion 438 to form generally a U-shape (opening downward in FIG. 77). The lower portion 428 is partially received between the arms 432 of the upper portion 424. In this example, the horizontal wall portion 438 and upper portions of the arms 440 are received between lower portions of the arms 432 of the upper portion 424.

In FIG. 77, the walls 414, 416, 418 are in their upright, use position. The front wall 418 is in its deployed, closed position, with the horizontal wall portions 430, 438 of the upper portion 424 and lower portion 428 extending across an upper portion and a lower portion respectively, of a large opening defined by the frame 420. In the deployed, closed position, the front wall 418 keeps objects, such as egg cartons, in the container 410.

Each end wall 416 includes a pair of side flanges 423 projecting perpendicularly from ends thereof. The end walls 416 are pivotably connected to upstanding end flanges 419 at end edges of the base 412. Each end wall includes a handle opening 442 near an upper edge thereof. Each side flange 423 of each end wall 416 includes latch 444 molded therein for selectively securing the end wall 416 to the rear wall 414 or to the front wall 418 (more specifically to the frame 420).

Figure 78:
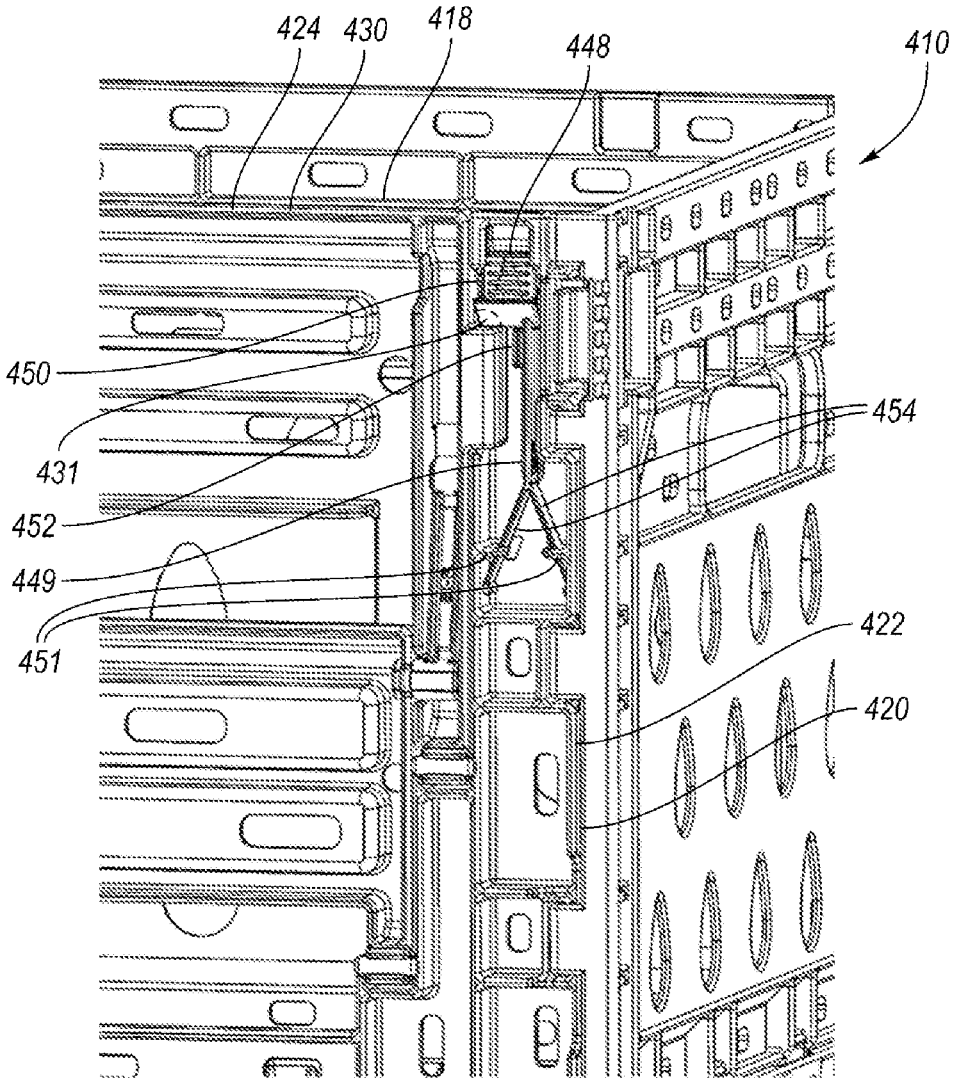
FIG. 78 is an enlarged perspective view of one front corner of the container of FIG. 77.

FIG. 78 is an enlarged perspective view of one front corner of the container 410 of FIG. 77, with the latch 448 in the down, latched position. The other front corner would be mirror image. The latch 448 is shown in more detail. The latch 448 is an elongated vertical member slidably mounted for vertical translation within a vertical channel molded into the vertical portion 422 of the frame 420. The latch 448 includes an elongated portion 449 having a pair of integrally molded lower springs 454 extending downward and outward therefrom and biasing the latch 448 downward relative to the frame 420. The latch 448 further includes an interference portion 450 at an upper end thereof. The interference portion 450 may include ribs to facilitate activation by a user's finger or thumb. The elongated portion 449 is slidably captured by tabs 452 integrally molded with the frame 420. The lower springs 454 are also captured by tabs 451 (shown more clearly in FIG. 68), which also provide a biasing surface against which the lower springs 454 will bias the latch 448 downward when the latch 448 is moved upward relative to the frame 420.

The horizontal wall portion 430 of the upper portion 424 of the front wall 418 includes a projection 431 (shown in broken lines) which projects behind the interference portion 450 of the latch 448. In this manner, the interference portion 450 of the latch 448 keeps the front wall 418 in the closed position until the latch 448 is released by being moved upward.

Figure 79:
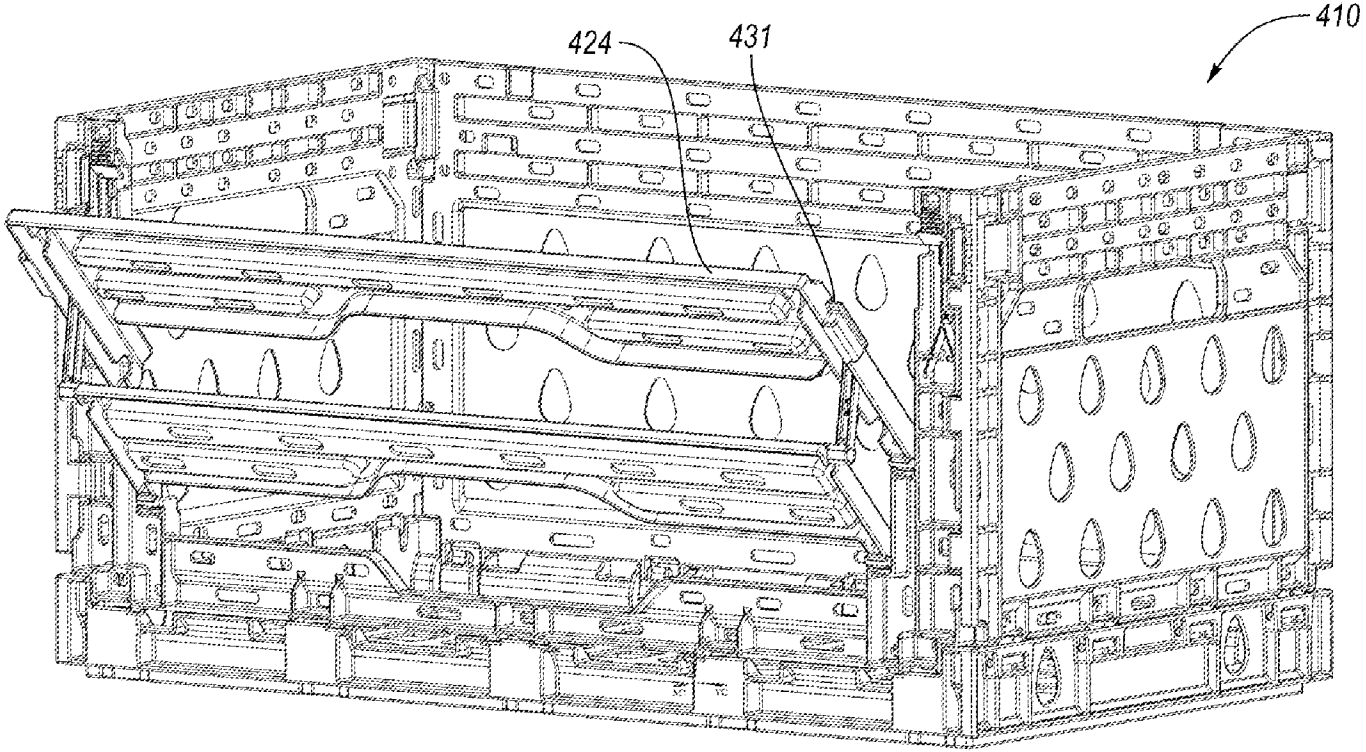
FIG. 79 is a perspective view of the container of FIG. 77 with the front wall moved toward a retracted position.
Figure 80:
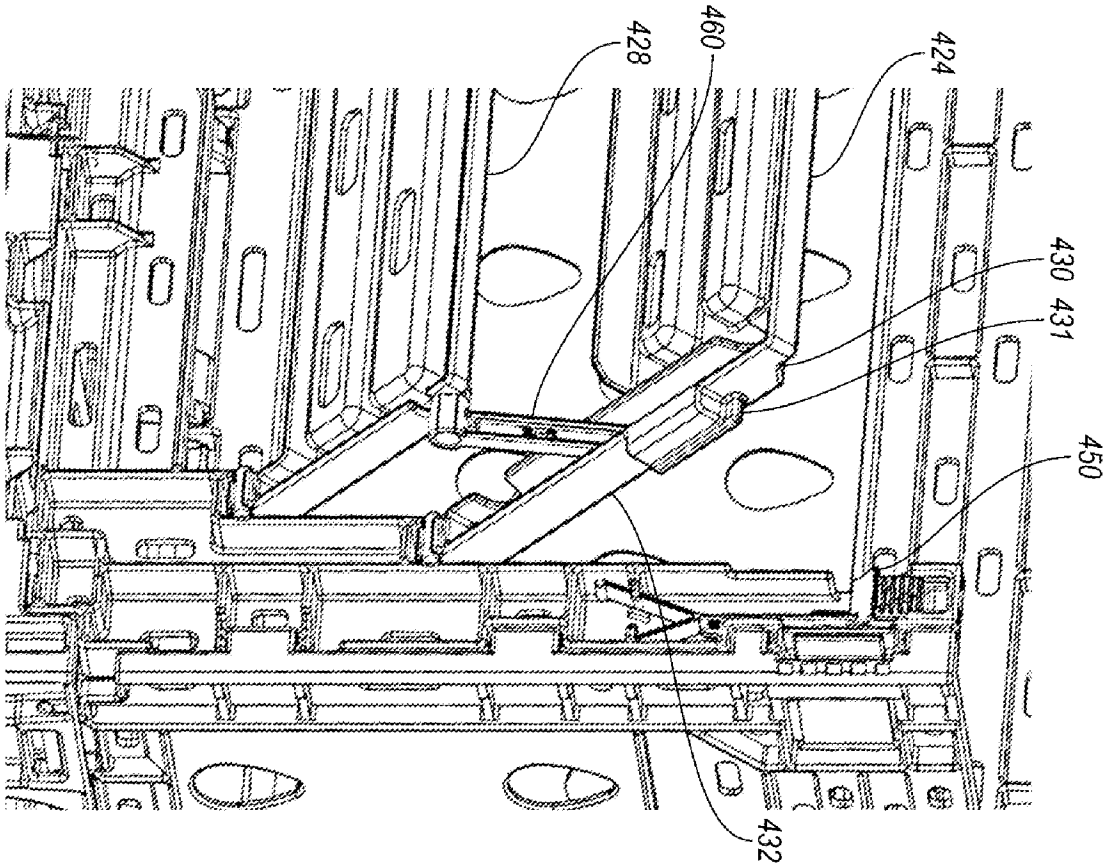
FIG. 80 is an enlarged view of a portion of FIG. 79.

The upper portion 424 can be pivoted outward and the front wall 418 moved to the retracted, open position by first releasing the latches 448 by moving the latches 448 upward relative to the frame 420, biasing the lower springs 454. The upper portion 424 is then pivoted outward as shown in FIGS. 79-80 (the latch 448 is shown returned to the lower position). The projection 431 of the horizontal wall portion 430 of the upper portion 424 of the front wall 418 is shown in FIG. 80.

As can also be seen in FIG. 80, the arms 432 of the upper portion 424 each have an elongated recess for receiving a link 460 pivotably securing the upper portion 424 to the lower portion 428.

Figure 81:
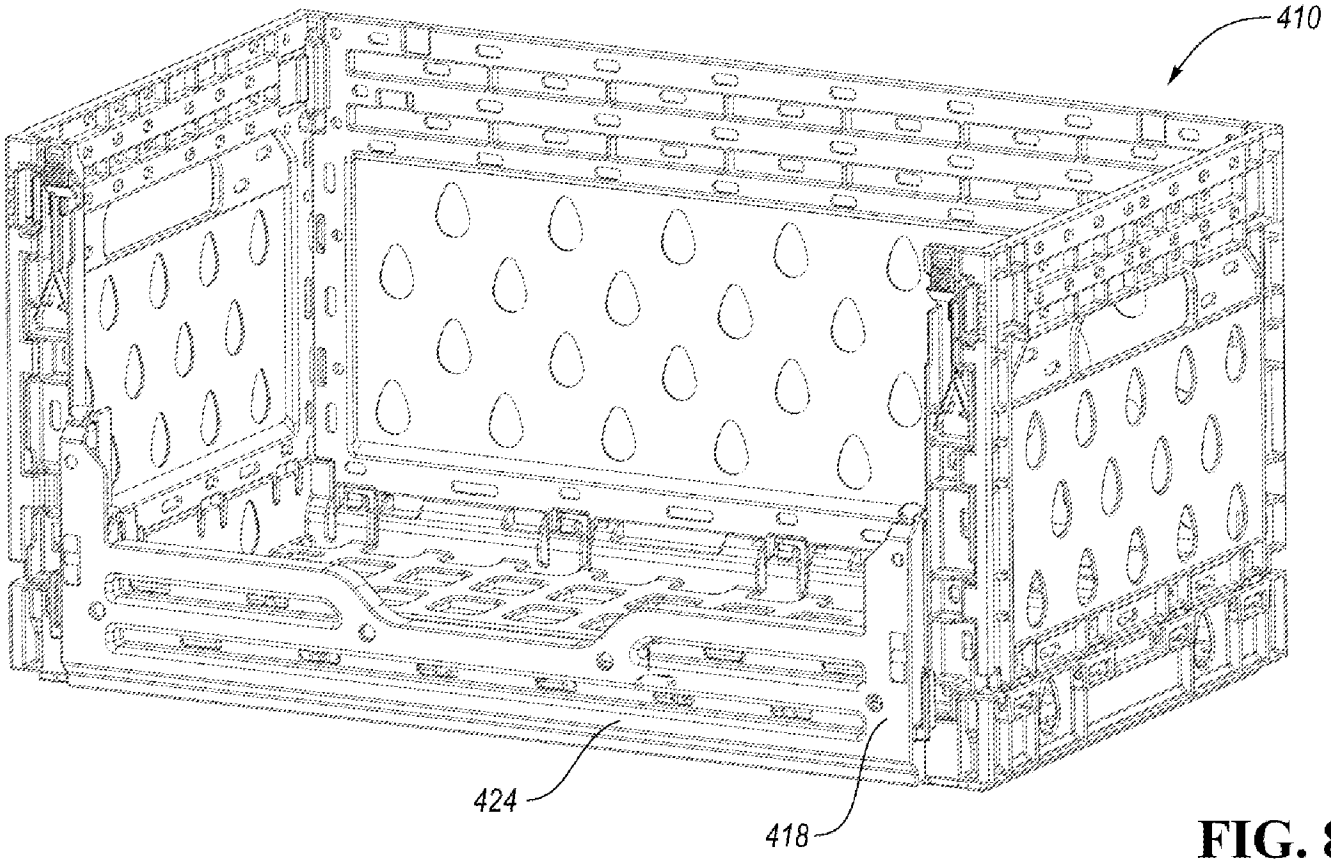
FIG. 81 shows the container of FIG. 77 with the front wall in the retracted, open position.

FIG. 81 shows the container 410 with the front wall 418 in the retracted, open position. The front wall 418 can be moved to the retracted, open position while another container 410 is stacked thereon. The retracted, open position provides access to the interior of the container 410 to retrieve goods, such as egg cartons, being sold in the store.

Figure 82:
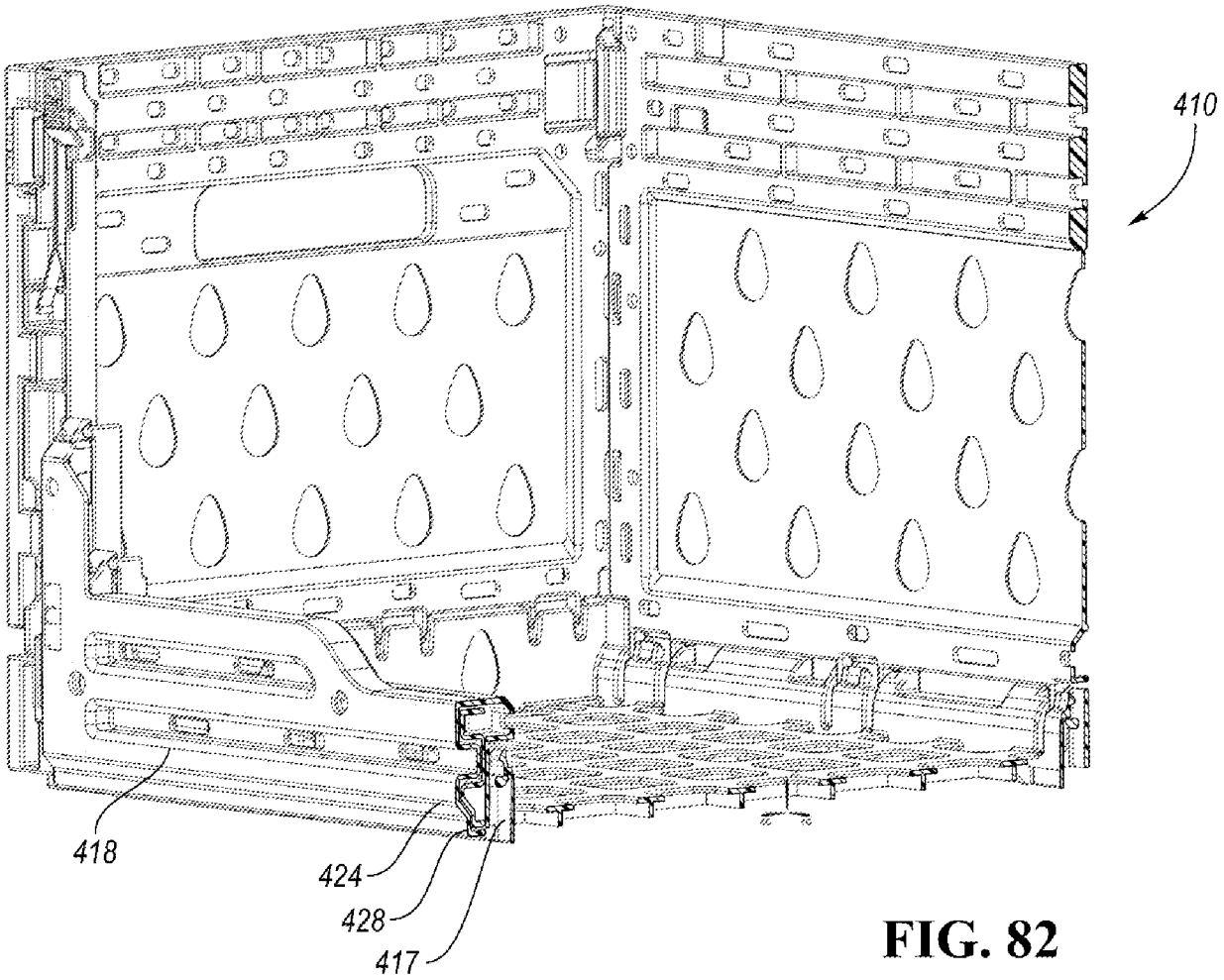
FIG. 82 shows the container of FIG. 81, partially broken away.

FIG. 82 shows the nesting of the upper portion 424 and the lower portion 428 when the front wall 418 is in the retracted position.

In accordance with the provisions of the patent statutes and jurisprudence, exemplary configurations described above are considered to represent preferred embodiments of the invention. However, it should be noted that the invention can be practiced otherwise than as specifically illustrated and described without departing from its spirit or scope. For example, the illustrated examples show two or three portions in the front wall, but different numbers of portions could be used within the front walls in each embodiment, depending on the size of the container and the size of the items to be held within the container. Further, it should be apparent that many of the features disclosed in each of the example containers herein could be practiced independently and may not require the presence of other disclosed features. Although all of the examples disclosed are collapsible containers, and there are some advantages to collapsible containers, it is also possible to implement any of the retractable walls disclosed herein in a non-collapsible container, such as a nestable container or a non-collapsible stackable container.

What is claimed is:

1. A container comprising:

a base; and a wall extending upward from the base, the wall including a frame and a first wall portion pivotably connected to the frame, the wall further including a second wall portion pivotably connected to the frame, the first wall portion and the second wall portion each pivotable relative to the frame between a deployed, closed position restricting access to the container through the frame and a retracted, open position permitting access to the container through the frame, wherein the second wall portion is nestably received within the first wall portion when the first wall portion and the second wall portion are in the retracted, open position.

2. The container of claim 1 wherein the first wall portion and the second wall portion lie flat against a lower horizontal portion of the frame when the first wall portion and the second wall portion are in the retracted, open position.

3. The container of claim 1 wherein the first wall portion and the second wall portion each include a horizontal portion and a pair of arms extending from the horizontal portion, wherein the pair of arms of the second wall portion are received between the pair of arms of the first wall portion when the first wall portion and the second wall portion are in the retracted, open position.

4. The container of claim 1 wherein the frame includes a lower horizontal portion and vertical portions extending upward from opposite ends of the lower horizontal portion, and wherein a pair of arms of the first wall portion is pivotably connected to the vertical portions of the frame.

5. The container of claim 4 wherein a pair of arms of the second wall portion is pivotably connected to the vertical portions of the frame.

6. The container of claim 5 further including a third wall portion having a horizontal portion and a pair of arms pivotably connected to the frame, wherein the third wall portion is nestably received within the second wall portion when the second wall portion and third wall portion are in the retracted, open position.

7. The container of claim 6 wherein the horizontal portion of the second wall portion is positioned between the arms of the first wall portion when the first wall portion and the second wall portion are in the deployed, closed position.

8. The container of claim 7 wherein the horizontal portion of the third wall portion is positioned between the arms of the second wall portion when the second wall portion and the third wall portion are in the deployed, closed position.

9. The container of claim 1 wherein the first wall portion and the second wall portion each include a horizontal portion and a pair of arms extending from the horizontal portion, wherein the horizontal portion of the second wall portion is received in the horizontal portion of the first wall portion when the first wall portion and the second wall portion are in the retracted, open position.

10. The container of claim 9 wherein the frame includes a lower horizontal portion and a pair of vertical portions extending upward from ends of the lower horizontal portion, wherein the first wall portion and the second wall portion lie flat against the lower horizontal portion of the frame when the first wall portion and the second wall portion are in the retracted, open position.

11. The container of claim 10 wherein the pair of arms of the second wall portion are received between the pair of arms of the first wall portion when the first wall portion and the second wall portion are in the retracted, open position.

12. The container of claim 11 wherein the pair of arms of the first wall portion is pivotably connected to the vertical portions of the frame.

13. The container of claim 12 further including a third wall portion having a horizontal portion and a pair of arms pivotably connected to the frame, wherein the third wall portion is nestably received within the second wall portion when the second wall portion and third wall portion are in the retracted, open position.

14. The container of claim 13 wherein the horizontal portion of the second wall portion is positioned between the arms of the first wall portion when the first wall portion and the second wall portion are in the deployed, closed position.

15. The container of claim 14 wherein the horizontal portion of the third wall portion is positioned between the arms of the second wall portion when the second wall portion and the third wall portion are in the deployed, closed position.

16. A container comprising:

a base; and a wall extending upward from the base, the wall including a frame and a first wall portion pivotably connected to the frame, the wall further including a latch slidably captured in the frame and configured to connect the first wall portion to the frame and disconnect the first wall portion from the frame, wherein the latch is movable vertically relative to the frame to release the first wall portion from the frame.

17. The container of claim 16 wherein the latch is movable relative to the frame in a direction perpendicular to the base to release the first wall portion from the frame.

18. The container of claim 16 wherein a spring biases the latch toward a latched position in which the latch connects the first wall portion to the frame.

19. The container of claim 18 wherein the spring is formed integrally with the latch.

20. The container of claim 16 further including a secondary latch and a cam, wherein the secondary latch is movable between a latched position preventing movement of the first wall portion relative to the frame and an unlatched position permitting movement of the first wall portion relative to the frame, wherein movement of the latch vertically causes the secondary latch to move from the latched position to the unlatched position via the cam.

21. The container of claim 16 wherein the first wall portion includes a first horizontal wall portion and arms extending downward from the first horizontal wall portion when the first wall portion is in a deployed, closed position, the arms pivotably connected to the frame such that the first wall portion is pivotable between the deployed, closed position and a retracted, open position.

22. The container of claim 21 further including a second wall portion pivotably connected to the frame and movable between a deployed, closed position and a retracted, open position.

23. The container of claim 22 wherein the second wall portion is connected to the first wall portion by links pivotably connected to the first wall portion and pivotably connected to the second wall portion.

24. The container of claim 22 wherein the second wall portion is nested within the first wall portion when the first wall portion and the second wall portion are moved to the retracted, open position.

25. The container of claim 24 wherein the base includes an upstanding flange, the wall connected to the upstanding flange, wherein the first wall portion and the second wall portion lie flat against the upstanding flange in the retracted, open position.

26. The container of claim 24 wherein the second wall portion includes a second horizontal portion and arms extending downward from the second horizontal portion when the second wall portion is in the deployed, closed position, and wherein the arms of the second wall portion are received between the arms of the first wall portion when the first wall portion and the second wall portion are in the retracted, open position.

27. The container of claim 16 wherein the base includes an upstanding flange, wherein the wall is pivotably connected to the upstanding flange and movable between an upright, use position and a collapsed position generally parallel to the base.

28. The container of claim 16 wherein the wall is a first wall, the container further including a second wall perpendicular to the first wall, the container further including a wall latch configured to connect and disconnect the first wall to the second wall.

29. The container of claim 28 wherein second wall includes a side flange extending parallel to the first wall and wherein the wall latch is disposed in the side flange, wherein the wall latch is configured to connect and disconnect the side flange to the frame.

30. The container of claim 28 wherein the first wall is pivotably connected to the base about a first axis, wherein the second wall is pivotably connected to the base about a second axis, wherein the first axis is further from the base than is the second axis.

31. The container of claim 28 wherein the first wall is pivotably connected to the base about a first axis, wherein the second wall is pivotably connected to the base about a second axis, wherein the first axis is closer to the base than is the second axis.

32. The container of claim 16 further including a second wall portion pivotably connected to the frame and movable between a deployed, closed position and a retracted, open position, the container further including a secondary latch and a cam, wherein the secondary latch is movable between a latched position preventing movement of the second wall portion relative to the frame and an unlatched position permitting movement of the second wall portion relative to the frame, wherein movement of the latch vertically causes the secondary latch to move from the latched position to the unlatched position via the cam.

33. A container comprising:

a base;

a wall extending upward from the base;

a latch movable relative to the wall;

a cam; and a secondary latch, wherein the secondary latch is movable between a latched position and an unlatched position, wherein movement of the latch moves the secondary latch from the latched position to the unlatched position via the cam.

34. The container of claim 33 wherein the latch is movable vertically between a latched position in which the latch secures a first wall portion to a frame of the wall and an unlatched position in which the first wall portion can pivot relative to the frame.

35. The container of claim 34 wherein the latch is movable in a direction perpendicular to the base to move the secondary latch between the latched position and the unlatched position.

36. The container of claim 33 wherein the latch is slidably mounted for vertical translation to a portion of the wall.

37. The container of claim 36 wherein the latch is configured such that vertical translation of the latch moves the secondary latch in a direction transverse to the vertical translation.

38. The container of claim 33 wherein the wall includes a frame having a lower horizontal portion and a pair of upstanding portions extending upward from opposite ends of the lower horizontal portion, wherein the latch is slidably mounted to one of the upstanding portions of the frame, the wall further including a first wall portion pivotably mounted to the upstanding portions, wherein movement of the latch moves the secondary latch between the latched position and the unlatched position, wherein the first wall portion is secured against pivoting to the one of the upstanding portions when the secondary latch is in the latched position, and wherein the first wall portion is capable of being pivoted away from the upstanding portions when the secondary latch is in the unlatched position.

39. The container of claim 33 wherein movement of the latch causes movement of the secondary latch in a direction different from the movement of the latch.

40. The container of claim 33 wherein the cam includes a pin received in an elongated slot.

41. The container of claim 40 wherein movement of the latch causes movement of the secondary latch in a direction different from the movement of the latch.

42. The container of claim 33 wherein the cam includes a pin received in an elongated slot such that movement of the latch causes relative movement between the pin and the slot, thereby causing movement of the secondary latch in a direction different from the movement of the latch.

* * * * *